US012768137B2

(12) United States Patent
Fukuda

(10) Patent No.: US 12,768,137 B2
(45) Date of Patent: Oct. 20, 2026

(54) WORKING MACHINE INCLUDING CONTROLLER THAT DETERMINES MOVEMENT OF ATTACHMENT AND TRAVEL OF THE WORKING MACHINE

(71) Applicant: Kubota Corporation, Osaka (JP)

(72) Inventor: Yuji Fukuda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 20 days.

(21) Appl. No.: 18/983,572

(22) Filed: Dec. 17, 2024

(65) Prior Publication Data

US 2026/0168206 A1 Jun. 18, 2026

(51) Int. Cl.
*E02F 9/20* (2006.01)
*E02F 3/34* (2006.01)
*E02F 3/36* (2006.01)

(52) U.S. Cl.
CPC ..... *E02F 9/2029* (2013.01); *E02F 3/3414* (2013.01); *E02F 3/3609* (2013.01)

(58) Field of Classification Search
CPC ..... E02F 9/2029; E02F 3/3414; E02F 3/3609
USPC ..... 701/50
See application file for complete search history.

(56) References Cited

U.S. PATENT DOCUMENTS 6,615,114 B1 * 9/2003 Skiba ..... G01L 27/005 73/1.01
2014/0212081 A1 * 7/2014 Takahashi ..... G01L 5/0019 384/448
2019/0144247 A1 * 5/2019 Albinger ..... B66C 13/16 701/50
2020/0199851 A1 * 6/2020 Yamamoto ..... G09B 19/24
2020/0249045 A1 * 8/2020 Schott ..... E02F 9/267
2022/0396932 A1 * 12/2022 Fujio ..... E02F 9/262
2023/0024622 A1 * 1/2023 Hoaby ..... E02F 3/436
2023/0102419 A1 * 3/2023 Graham ..... E02F 9/2246 172/1
2023/0193593 A1 * 6/2023 Odegaard ..... B62D 11/003 701/41
2024/0132054 A1 * 4/2024 Weston ..... B60W 30/02
2024/0315155 A1 * 9/2024 Zhang ..... A01B 63/112
2025/0024772 A1 * 1/2025 Tagalpallewar ..... E02F 3/847
(Continued)

FOREIGN PATENT DOCUMENTS

JP 3442665 B2 * 9/2003
JP 2012207531 A 10/2012

*Primary Examiner* — Andrew R Dyer
(74) *Attorney, Agent, or Firm* — Keating & Bennett, LLP

(57) ABSTRACT

A work device includes a machine body, a traveling device to support the machine body, an attachment mount directly or indirectly supported on the machine body to detachably attach a work attachment thereto, the work attachment being operable to perform a function corresponding to work, a manual operator to be operated by a user, and a controller configured or programmed to actuate the traveling device based on an operation state of the manual operator. The controller is configured or programmed to directly or indirectly recognize at least one of a load acting on the attachment mount or presence or absence of the load, associate a travel condition corresponding to the recognized load with an operation state of the manual operator, and actuate the traveling device according to the travel condition associated with the operation state as the manual operator is operated.

17 Claims, 28 Drawing Sheets

(56) References Cited

U.S. PATENT DOCUMENTS

| | | | | |
|---|---|---|---|---|
| 2025/0027292 | A1* | 1/2025 | Tevis | E02F 9/0841 |
| 2025/0093838 | A1* | 3/2025 | Shanib | G05B 19/40938 |
| 2025/0241243 | A1* | 7/2025 | Angal | A01D 41/145 |
| 2026/0015820 | A1* | 1/2026 | Roberts | E02F 3/841 |

* cited by examiner

| Identification information | Attachment name | Symbol (pictogram) | Movement condition for attachment | | Sudden-operation condition | With-load movement condition | Travel conditions | During-speed-change travel condition | Sudden-operation travel condition |
|---|---|---|---|---|---|---|---|---|---|
| | | | Ascending/descending condition | Tilting condition | | | | | |
| A1 | Bucket | | Va1 | Vb1 | Vc1 | Vd1 | Ve1 | Vf1 | Vg1 |
| A2 | Pallet fork | | Va2 | Vb2 | Vc2 | Vd2 | Ve2 | Vf2 | Vg2 |
| A3 | Ripper | | Va3 | Vb3 | Vc3 | Vd3 | Ve3 | Vf3 | Vg3 |
| A4 | Snow pusher | | Va4 | Vb4 | Vc4 | Vd4 | Ve4 | Vf4 | Vg4 |
| A5 | Dozer blade | | Va5 | Vb5 | Vc5 | Vd5 | Ve5 | Vf5 | Vg5 |
| A6 | Crusher | | Va6 | Vb6 | Vc6 | Vd6 | Ve6 | Vf6 | Vg6 |
| A7 | Grapple | | Va7 | Vb7 | Vc7 | Vd7 | Ve7 | Vf7 | Vg7 |
| A8 | Skid grader | | Va8 | Vb8 | Vc8 | Vd8 | Ve8 | Vf8 | Vg8 |
| A9 | Spreader | | Va9 | Vb9 | Vc9 | Vd9 | Ve9 | Vf9 | Vg9 |
| A10 | Sweeper | | Va10 | Vb10 | Vc10 | Vd10 | Ve10 | Vf10 | Vg10 |
| A11 | Skid cutter | | Va11 | Vb11 | Vc11 | Vd11 | Ve11 | Vf11 | Vg11 |
| A12 | Breaker | | Va12 | Vb12 | Vc12 | Vd12 | Ve12 | Vf12 | Vg12 |
| A13 | Earth auger | | Va13 | Vb13 | Vc13 | Vd13 | Ve13 | Vf13 | Vg13 |
| A14 | Rotary tiller | | Va14 | Vb14 | Vc14 | Vd14 | Ve14 | Vf14 | Vg14 |
| A15 | Broom (angle broom) | | Va15 | Vb15 | Vc15 | Vd15 | Ve15 | Vf15 | Vg15 |
| A16 | Cold planer | | Va16 | Vb16 | Vc16 | Vd16 | Ve16 | Vf16 | Vg16 |
| A17 | Stump grinder | | Va17 | Vb17 | Vc17 | Vd17 | Ve17 | Vf17 | Vg17 |
| A18 | Snow blower | | Va18 | Vb18 | Vc18 | Vd18 | Ve18 | Vf18 | Vg18 |
| A19 | Trencher | | Va19 | Vb19 | Vc19 | Vd19 | Ve19 | Vf19 | Vg19 |
| A20 | Mower | | Va20 | Vb20 | Vc20 | Vd20 | Ve20 | Vf20 | Vg20 |
| ⋮ | ⋮ | ⋮ | ⋮ | ⋮ | ⋮ | ⋮ | ⋮ | ⋮ | ⋮ |

Fig.19

WORKING MACHINE INCLUDING CONTROLLER THAT DETERMINES MOVEMENT OF ATTACHMENT AND TRAVEL OF THE WORKING MACHINE

BACKGROUND OF THE INVENTION

1. Field of the Invention

The present invention relates to working machines such as skid-steer loaders and compact track loaders.

2. Description of the Related Art

Working machines such as skid-steer loaders and compact track loaders each include a machine body, a traveling device to support the machine body such that the machine body is allowed to travel, an attachment mount to attach thereto a work attachment to perform a predetermined work such that the work attachment is replaceable, and a manual operator to be operated to perform control relating to the traveling device, the work attachment, and/or the like (see, for example, Japanese Unexamined Patent Application Publication No. 2012-207531). In such a working machine, the attachment mount is configured such that a plurality of types of work attachments are individually attachable thereto. That is, a work attachment with a function corresponding to the content of work is attached to the attachment mount.

SUMMARY OF THE INVENTION

The plurality of types of work attachments perform different functions, and therefore have different structures. Therefore, the plurality of types of work attachments have different weights and dimensions. Thus, the working machine having a work attachment attached to its attachment mount differs in weight balance depending on which work attachment is attached to the attachment mount, resulting in a tendency that travel performance and maneuverability during ravel may also differ.

Example embodiments of the present invention provide working machines each of which is capable of achieving stable travel even if the work attachment attached to the attachment mount is replaced with another one.

A working machine includes a machine body, a traveling device to support the machine body such that the machine body is allowed to travel, an attachment mount directly or indirectly supported on the machine body to detachably attach a work attachment thereto, the work attachment being operable to perform a function corresponding to work, a manual operator to be operated by a user, and a controller configured or programmed to actuate the traveling device based on an operation state of the manual operator, wherein the controller is configured or programmed to directly or indirectly recognize at least one of a load acting on the attachment mount or presence or absence of the load, or directly or indirectly recognize a moment about a pivot of the attachment mount, associate a travel condition corresponding to the recognized load or moment with the operation state of the manual operator, and actuate the traveling device according to the travel condition associated with the operation state as the manual operator is operated.

The controller may be configured or programmed to directly or indirectly recognize at least one of a load acting on the attachment mount or presence or absence of the load, associate a travel condition corresponding to the recognized load with the operation state of the manual operator, and actuate the traveling device according to the travel condition associated with the operation state as the manual operator is operated.

The controller may be configured or programmed to recognize the presence or absence of the load acting on the attachment mount based on whether or not the work attachment is attached to the attachment mount.

The attachment mount may be operable to replaceably attach thereto each of a plurality of the work attachments of different types, the work attachments each being operable to perform a function corresponding to work. The controller may be configured or programmed to recognize the load acting on the attachment mount or the moment based on a type of the work attachment attached to the attachment mount.

The travel condition may include a speed change per unit time. The controller may be configured or programmed to if the controller determines that there is no load or the load is below a predetermined amount, define a smaller speed change as the travel condition than when a larger load is present, and actuate the traveling device according to the defined travel condition as the manual operator is operated.

The traveling device may be operable to change a speed thereof between a first speed stage and a second speed stage which is a higher speed stage than the first speed stage. The controller may be configured or programmed to, if the controller determines that there is no load or the load is below a predetermined amount, define a smaller speed change as the travel condition for when the first speed stage is changed to the second speed stage than when the controller determines that the load is above a predetermined amount.

The attachment mount may be operable to replaceably attach thereto each of a plurality of the work attachments of different types, the work attachments each being operable to perform a function corresponding to work. The controller may be configured or programmed to recognize the work attachment attached to the attachment mount, define the travel condition depending on a weight of the recognized work attachment, and actuate the traveling device according to the defined travel condition as the manual operator is operated.

The working machine may further include an identification information reader to read identification information. The work attachments of different types may have attached thereto respective tags with respective pieces of identification information unique thereto. The identification information reader may be configured or programmed to read, from a tag of one of the work attachments that is attached to the attachment mount, a corresponding piece of identification information that is unique to the one of the work attachments. The controller may be configured or programmed to recognize the one of the work attachments that is attached to the attachment mount based on the corresponding piece of identification information read by the identification information reader.

The working machine may further include a storage and/or a memory to record the work attachments of different types, and an attachment selector to select one of the work attachments recorded in the storage and/or the memory that is to be used for work. The controller may be configured or programmed to recognize the one of the work attachments selected via the attachment selector as the work attachment attached to the attachment mount.

The storage and/or the memory may be operable to store a plurality of the travel conditions corresponding to the work attachments of different types and each associated with the operation state of the manual operator, the plurality of travel conditions each being defined depending on a weight of a corresponding one of the work attachments. The controller may be configured or programmed to recognize the one of the work attachments selected via the attachment selector as the work attachment attached to the attachment mount, extract a corresponding one of the plurality of travel conditions that corresponds to the selected work attachment from the storage and/or the memory, and actuate the traveling device according to the extracted travel condition.

The controller may be configured or programmed to recognize an operation speed which is a speed at which the manual operator is operated by the user. The controller may be configured or programmed to define, depending on the work attachment attached to the attachment mount, a sudden-operation travel condition which is the travel condition for sudden operation in which the operation speed is higher than a predetermined speed, associate the defined sudden-operation travel condition with a sudden operation of the manual operator, and, when the controller determines that the operation speed of the manual operator is higher than the predetermined speed and that there is the sudden operation, actuate the traveling device according to the defined sudden-operation travel condition associated with the sudden operation as the manual operator is operated.

A speed change included in the sudden-operation travel condition may be smaller than a speed change included in the travel condition for normal operation other than the sudden operation.

The traveling device may be operable to achieve straight travel in which the machine body travels straight and pivot turn travel. The travel condition may include a first travel condition for the straight travel and a second travel condition for the pivot turn travel that differs from the first travel condition. A speed change included in the second travel condition may be smaller than a speed change included in the first travel condition.

A speed change included in the travel condition may be smaller when no work attachments are attached to the attachment mount than when the work attachment is attached to the attachment mount.

The attachment mount may include a linkage to connect the work attachment thereto. The linkage may include an engaging portion switchable between an engaging position in which the engaging portion engages with the work attachment to connect the work attachment thereto and a disengaging position in which the engaging portion disengages the work attachment therefrom to disconnect the work attachment therefrom. The controller may be configured or programmed to determine that no work attachments are attached to the attachment mount when the engaging portion is in the disengaging position.

The working machine may further include an attachment support structure supported on the machine body to support the attachment mount such that the attachment mount is movable along a predetermined path, and an actuator to cause the attachment mount to move along the path.

The attachment support structure may include an arm supported on the machine body such that the arm is rotatable about a first shaft extending in a lateral direction perpendicular to an up-down direction, the arm being connected to the attachment mount. The arm may extend in a front-rear direction perpendicular to the up-down direction, and the attachment mount may be located forward of the machine body.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

FIG. 19 is a conceptual diagram of a database to be stored in a storing unit of a working machine according to the same example embodiment of the present invention.

DETAILED DESCRIPTION OF THE EXAMPLE EMBODIMENTS

Figure 1:
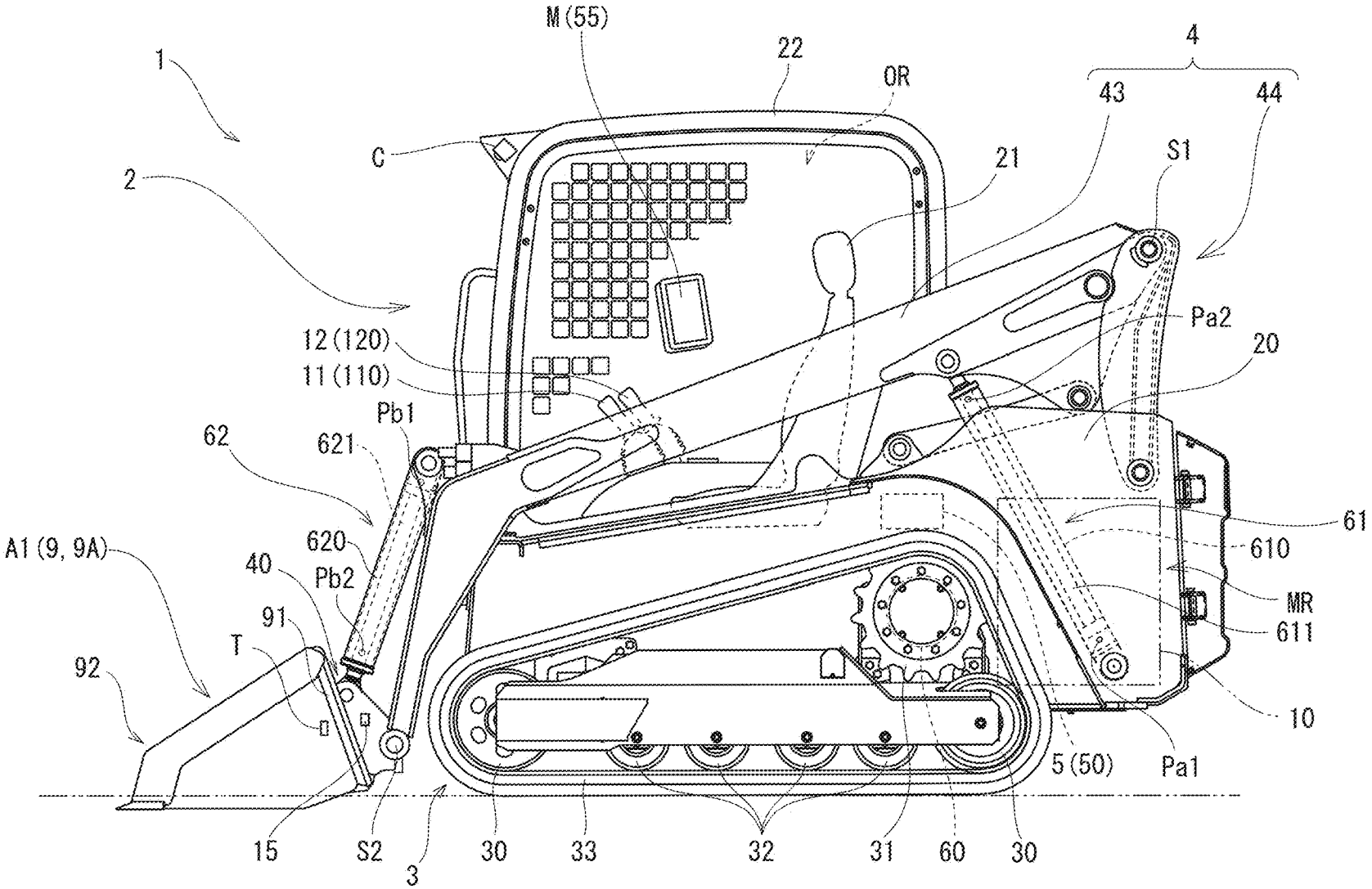
FIG. 1 is a schematic side view showing a working machine according to an example embodiment of the present invention with a bucket attached as a work attachment.

Example embodiments will now be described with reference to the accompanying drawings, wherein like reference numerals designate corresponding or identical elements throughout the various drawings. The drawings are to be viewed in an orientation in which the reference numerals are viewed correctly.

The following description discusses working machines according to example embodiments of the present invention with reference to the drawings as needed. Note that, in the following description, assuming that the working machine is configured to travel, the direction along which the working machine travels straight (travels forward or rearward) is referred to as a front-rear direction, and a direction perpendicular to the front-rear direction and the up-down direction is referred to as a lateral direction. One of the opposite sides of the working machine in the lateral direction, as seen from the driver (user) facing in the direction of forward travel, is referred to as the right side, whereas the other of the opposite sides of the working machine in the lateral direction, as seen from the driver (user) facing in the direction of forward travel, is referred to as the left side.

As illustrated in FIGS. 1 to 8, a working machine 1 includes a machine body 2. The working machine 1 includes traveling device(s) 3 to support the machine body 2 such that the machine body 2 is allowed to travel. The working machine 1 includes an attachment mount 40 to attach thereto a work attachment 9 to perform a function corresponding to work such that the work attachment 9 is replaceable with another work attachment 9 (detachable and attachable). That is, the working machine 1 includes an attachment mount 40 to attach thereto each of a plurality of types of work attachments 9 (work attachments 9 of different types).

In the present example embodiment, the working machine 1 includes an attachment support structure 4 which supports the attachment mount 40 such that the attachment mount 40 is movable along a predetermined path and which is supported by the machine body 2, and actuators (operation actuators) 61 and 62 to cause the attachment mount 40 to move along the path. The working machine 1 also includes actuator(s) (travel actuator(s)) 60 to drive the traveling devices 3.

The working machine 1 includes manual operators 11 and 12 to be operated by a user. Specifically, the working machine 1 includes a manual operator 11 to be operated by the user to perform control relating to travel of the traveling devices 3 (hereinafter referred to as "travel manual operator"). The working machine 1 also includes a manual operator 12 to be operated by the user to perform operations relating to the movement of the attachment mount 40 along a predetermined path (hereinafter referred to as "work manual operator"). The working machine 1 further includes a controller 5.

The working machine 1 includes a storing unit (storage and/or memory) 50 to record a plurality of types of work attachments 9 (work attachments 9 of different types), and an attachment selector 55 to be used to select a work attachment 9 for use in work from the plurality of types of work attachments 9 recorded in the storing unit 50. The working machine 1 includes a monitor M to display information. The working machine 1 further includes a camera C to capture an image or video (angle of view) which includes at least a portion of the work attachment 9 attached to the attachment mount 40. The working machine 1 includes an identification information reader 15 to read identification information.

Figure 9:
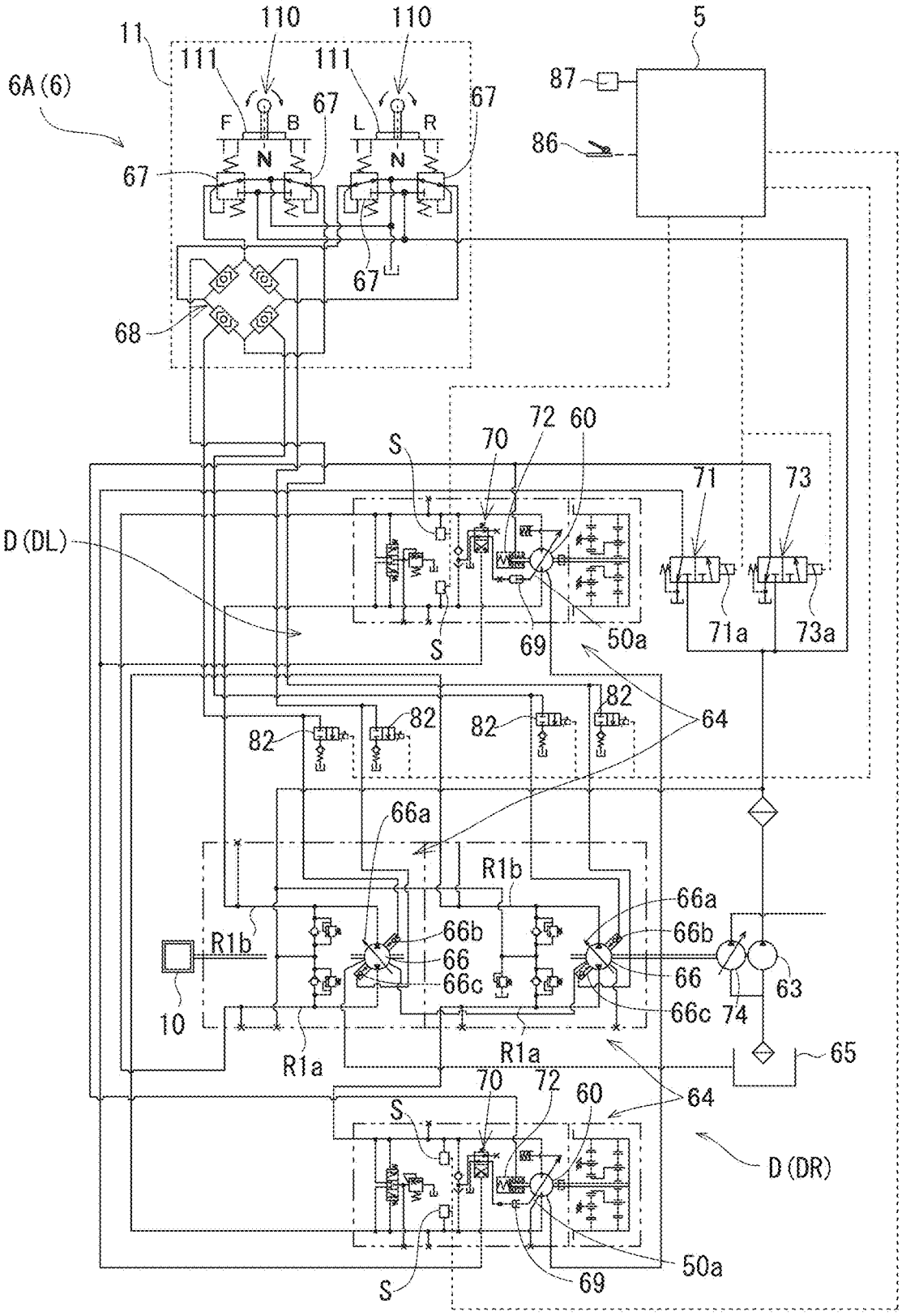
FIG. 9 shows a travel-related hydraulic circuit included in a hydraulic circuit of a working machine according to the same example embodiment of the present invention.
Figure 10:
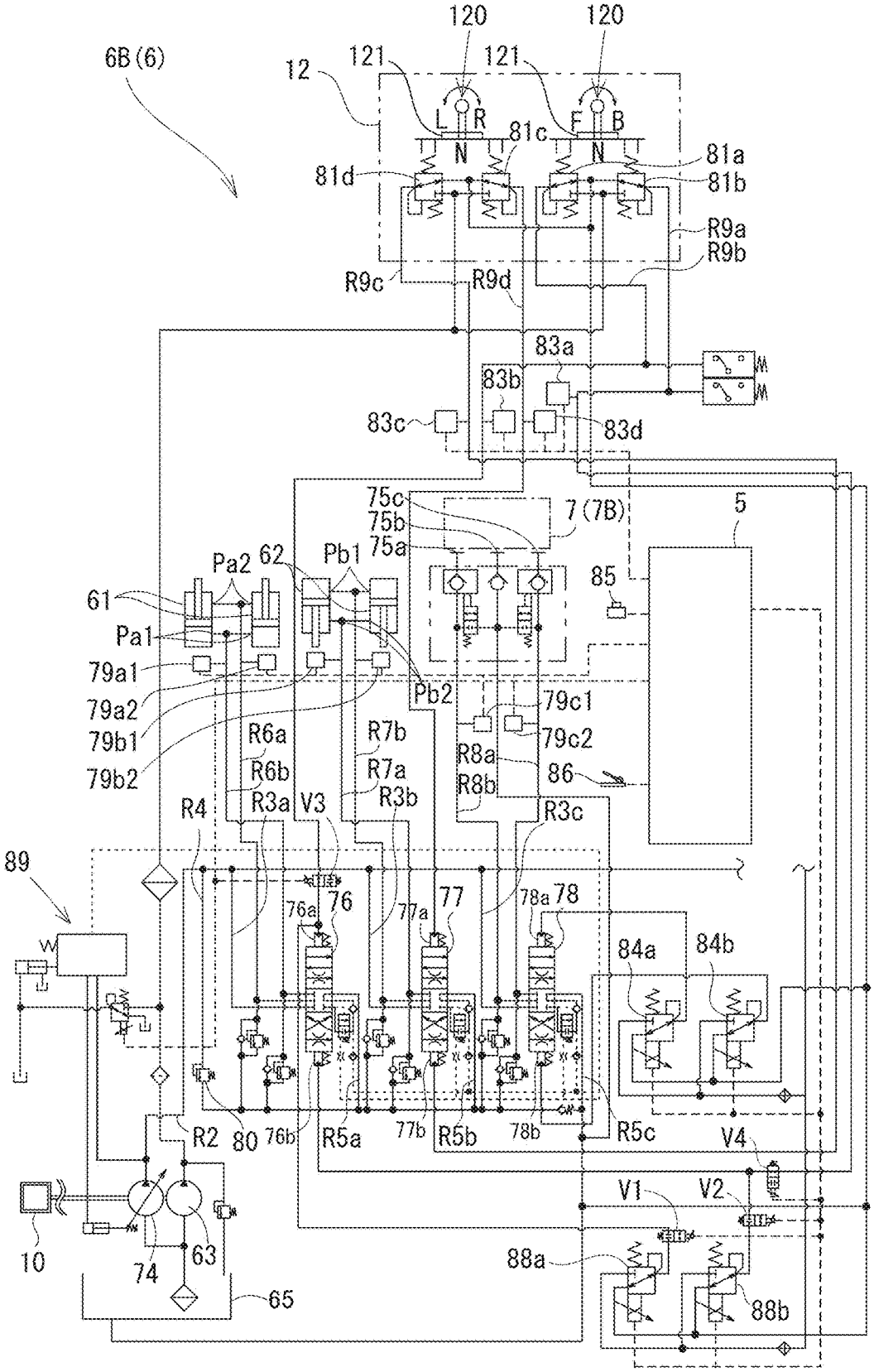
FIG. 10 shows a work-related hydraulic circuit included in a hydraulic circuit of a working machine according to the same example embodiment of the present invention.

In the present example embodiment, each of the actuators 60, 62, and 61 includes a hydraulic actuator. That is, the working machine 1 includes hydraulic actuators 60 to drive the traveling devices 3 and hydraulic actuators 61 and 62 to cause the attachment mount 40 to move along the path. Accordingly, as illustrated in FIGS. 9 and 10, the working machine 1 includes a hydraulic circuit 6 (hydraulic system) including hydraulic pumps 66 and 74 to supply hydraulic fluid to the hydraulic actuators 60, 62, and 61, and a prime mover 10 to drive the hydraulic pumps 66 and 74.

Referring back to FIGS. 1 to 8, the machine body 2 includes a frame chassis 20, a seat 21 on the frame chassis 20, and a seat protection structure 22 to protect the seat 21.

The frame chassis 20 is made of sheet metal and has a three-dimensional shape corresponding to the shape and size of the working machine 1. The frame chassis 20 defines a prime mover room MR to house the prime mover 10 at a rear in the front-rear direction.

The seat 21 is located forward of the prime mover room MR (prime mover 10), and is fixed to the frame chassis 20. In the present example embodiment, the seat protection structure 22 is a so-called cabin to surround the seat 21. As described above, since the seat 21 is located forward of the prime mover room MR, the cabin 22 (seat protection structure 22) is also located forward of the prime mover room MR. That is, the cabin 22 defines, at a position forward of the prime mover room MR, an operation cab OR in which the user stays sitting in the seat 21.

The cabin 22 includes front, rear, right, and left windows, and houses the travel manual operator 11 and the work manual operator 12 therein (in the operation cab OR). In the working machine 1 of this type, the front window of the cabin 22 is openable and closable. This allows the user to enter and exit the operation cab OR through the front portion of the cabin 22. The travel manual operator 11 and the work manual operator 12 are positioned such that the user sitting on the sear 21 can operate the travel manual operator 11 and the work manual operator 12. In the present example embodiment, the travel manual operator 11 and the work manual operator 12 are located at a front portion of the seat 21.

The traveling devices 3 can achieve straight travel in which the traveling devices 3 cause the machine body 2 to travel straight, and achieve pivot turn travel. The traveling devices 3 can also achieve spin turn travel.

Specifically, the traveling devices 3 are provided at the left and right of the machine body 2. That is, the working machine 1 includes a pair of traveling devices 3 to support the opposite sides in the width direction (left and right sides) of the machine body 2 (the frame chassis 20 in the present example embodiment). In the present example embodiment, each of the pair of traveling devices 3 is a crawler traveling device. That is, the working machine 1 according to the present example embodiment is a crawler compact track loader.

Each of the pair of traveling devices 3 (crawlers) includes idlers 30, a driving wheel 31 driven by the corresponding travel actuator 60, track rollers 32, and an endless crawler belt 33. The travel actuator 60 is a motor to output rotation.

A pair of the idlers 30 are arranged with a space therebetween in the front-rear direction. The track rollers 32 are provided between the pair of idlers 30. The driving wheel 31 is located higher than the track rollers 32. The crawler belt 33 is looped over the idlers 30, the driving wheel 31, and the track rollers 32.

The travel actuator 60 drives the driving wheel 31 to rotate. In the present example embodiment, the travel actuator 60 is a motor to output rotation. Accordingly, in the following description, the travel actuator 60 is referred to as a travel motor 60. As described above, since the travel actuator 60 is a hydraulic actuator 95, the travel motors 60 are hydraulic motors. Accordingly, the travel motors 60 are included in the hydraulic circuit 6. The travel motors 60 are provided such that the travel motors 60 correspond to a respective pair of left and right traveling devices 3. That is, the working machine 1 includes the pair or left and right travel motors 60, and the pair of travel motors 60 drive the respective pair of left and right traveling devices 3. When the driving wheels 31 receive the output from the travel motors 60, the pair of left and right traveling devices 3 cause the respective crawler belt 33 to rotate. Since the crawler belts 33 are in contact with the ground, the crawler belts 33 achieve a traveling state by indirectly receiving drive from the travel motors 60 and rotating.

The attachment mount 40 is directly or indirectly supported on the machine body 2. In the present example embodiment, the attachment mount 40 is supported on the machine body 2 via the attachment support structure 4 (arms 43 described later). As described earlier, the attachment mount 40 can individually attach thereto each of the plurality of types of work attachments 9. That is, each of the plurality of types of work attachments 9 to perform functions corresponding to different types of work is replaceably attached to the attachment mount 40.

Figure 11:
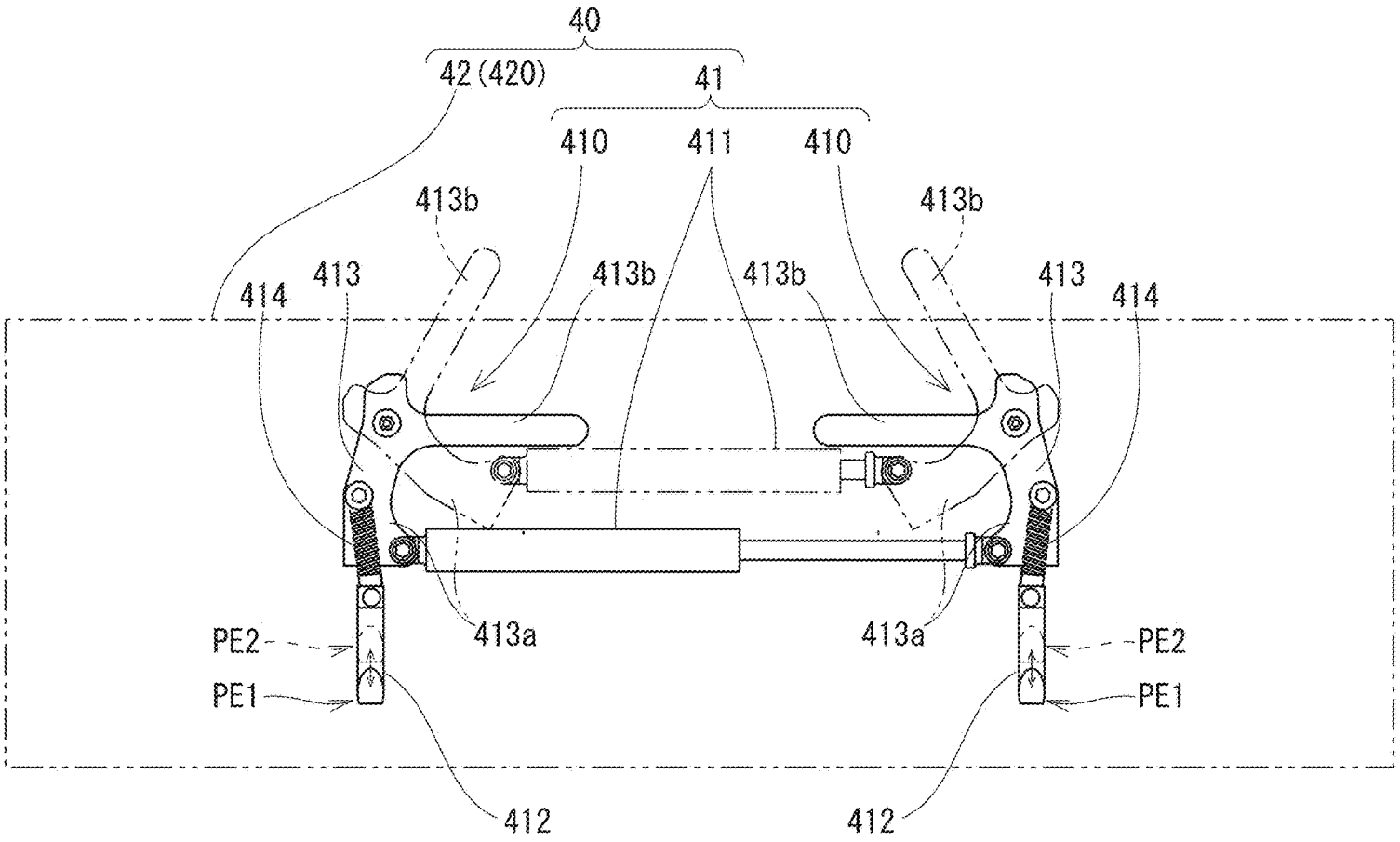
FIG. 11 is a schematic front view showing an attachment mount of a working machine according to the same example embodiment of the present invention.
Figure 12:
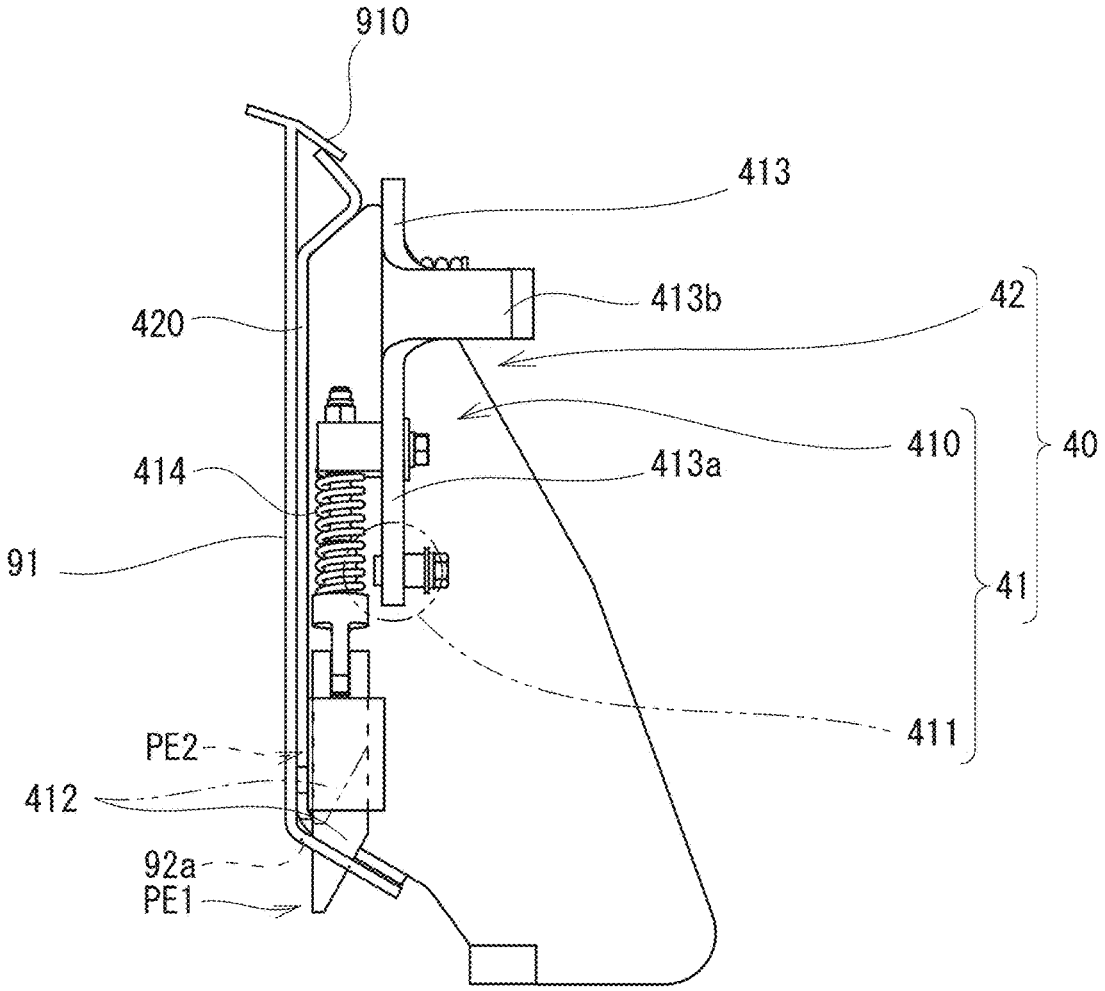
FIG. 12 is a schematic side view showing an attachment mount of a working machine according to the same example embodiment of the present invention.

Specifically, as illustrated in FIGS. 11 and 12, the attachment mount 40 includes a linkage 41 to connect a work attachment 9. The linkage 41 includes engaging portion(s) 412 switchable between an engaging position PE in which the engaging portion 412 engages with the work attachment 9 to connect the work attachment 9, and a disengaging position PE2 in which the engaging portion 412 disengages the work attachment 9 therefrom to disconnect the work attachment 9.

Specifically, the attachment mount 40 includes a frame 42 to be connected to the distal portions of the arms 43, and the linkage 41 attached to the frame 42.

As illustrated in FIG. 12, the frame 42 includes a plate-shaped frame body 420. A mounting base 91 of the work attachment 9 includes a hook portion 910 for engagement, and, in the present example embodiment, the hook portion 910 engages with the top edge of the frame body 420.

The linkage 41 is a so-called quick hitch (hitch) to connect (attach) and disconnect (detach) the work attachments 9 thereto and therefrom, and is also called a "quick changer". The linkage 41, by engaging with the mounting base 91 with its hook portion 910 engaging with the top edge of the frame body 420, keeps the work attachment 9 (mounting base 91) in the connected state.

Specifically, the linkage 41 is provided within an area corresponding to the surface of the frame body 420 of the frame 42. That is, the linkage 41 is located between the top edge and the bottom edge of the frame body 420, and is fixed to the frame body 420.

As illustrated in FIGS. 11 and 12, the linkage (quick hitch) 41 includes latching mechanism(s) 410 and a latching cylinder 411 to actuate the latching mechanisms 410.

Each latching mechanism 410 includes a latch pin 412 (which is the engaging portion 412) movable in its axial direction and switchable between (i) the engaging position PE1 in which the latch pin 412 engages with an engagement portion 92*a* (periphery of an engagement hole 92*a* in the present example embodiment) of the mounting base 91 of the work attachment 9, and (ii) the disengaging position PE2 in which the latch pin 412 disengages from the mounting base 91 of the work attachment 9. In the present example embodiment, the latching mechanism 410 includes a lever body 413 rotatable about a predetermined axis to, by rotating about the axis, cause the latch pin 412 to change its position (move) between the engaging position PE1 and the disengaging position PE2.

With this, the latching mechanism 410 is switchable between (i) a latching state (engaged state) in which the latch pin (engaging portion) 412 is in the engaging position PE1 to fix the work attachment 9, and (ii) an unlatching state (disengaged state) in which the latch pin (engaging portion) 412 is in the disengaging position PE2 to allow the work attachments 9 to be detached.

The latching cylinder 411 actuates the latching mechanisms 410. In the present example embodiment, each latching mechanism 410 includes a spring 414 to cause the latch pin 412 in the disengaging position PE2 to return to the engaging position PE1. Accordingly, in the present example embodiment, the spring 414 keeps the latching state, whereas the latching cylinder 411 switches the latching mechanism 410 from the latching state to the unlatching state.

In the present example embodiment, the linkage 41 includes a plurality of such latch pins 412 and, with the plurality of latch pins 412 engaging with a plurality of portions of the mounting base 91 of the work attachment 9, holds the work attachment 9. That is, the linkage 41 includes a plurality of the latching mechanisms 410 including the latch pins 412. In the present example embodiment, the linkage 41 includes a pair of the latching mechanisms 410 configured as described above. The pair of latching mechanisms 410 are provided symmetrically with respect to the widthwise center of the frame 42.

The latching cylinder 411 is connected to the lever bodies 413 (first lever portions 413*a*, described later) of the latching mechanisms 410, and cause the lever bodies 413 to rotate about a predetermined axis by extending or retracting. In the present example embodiment, since the pair of latching mechanisms 410 are provided symmetrically, the latching cylinder 411 extends from one of the lever bodies 413 of the pair of latching mechanisms 410 to the other. With this, the pair of latching mechanisms 410 are actuated in a synchronized manner by a single latch cylinder 411. That is, the latching cylinder 411 causes each of the lever bodies 413 of the pair of latching mechanisms 410 to rotate, and causes each of the latch pins 412 of the pair of the latching mechanisms 410 to switch between the engaging position PE1 and the disengaging position PE2 in a synchronized manner.

In the present example embodiment, each lever body 413 includes a first lever portion 413*a* extending from the center of rotation, and a second lever portion 413*b* extending from the center of rotation in a direction different from the first lever portion 413*a*. The first lever portion 413*a* is connected to the corresponding latch pin 412 (spring 414, which is an engaging portion) and the latching cylinder 411. When the latch pin 412 is in the engaging position PE1, the second lever portion 413*b* of the lever body 413 overlaps (are hidden by) the frame 42 as viewed from the front-rear direction, and when the latch pin 412 is in the disengaging position PE2, the second lever portion 413*b* of the lever bodies 413 projects outward from the top edge of the frame 42. With this, the attachment mount 40 of the present example embodiment is configured such that whether the attachment mount 40 is in the latching state or the unlatching state can be visually recognized (checked) by checking, from the outside (from the operation cab OR), whether or not the second lever portions 413*b* project from the frame 42.

As shown in FIGS. 1 to 8, the attachment mount 40 is connected to the attachment support structure 4 (arms 43, described later) rotatably about a second shaft S2 extending in the lateral direction. More specifically, the frame 42 of the attachment mount 40 is connected, to the distal ends of the arms 43, rotatably via the second shaft S2 which has an axis (central axis) extending in the lateral direction. With this, the attachment mount 40 is movable along a path (second path) in the shape of an arc centered on the second shaft S2. Accordingly, the work attachment 9 attached (connected) to the attachment mount 40 is, similar to the attachment mount 40, movable along a path in the shape of an arc centered on the second shaft S2. That is, the work attachment 9 is movable along a path in the shape of an arc concentric with and similar to the second path of the attachment mount 40.

Each of the plurality of types of work attachments 9 is a working tool with a distinctive function corresponding to the content of work. A tag T with unique identification information is attached to each of the plurality of types of work attachments 9. The unique identification information here is a piece of information to identify the work attachment 9, for example, a unique ID, model name, model number, and/or the like. In the present example embodiment, the tag T is a beacon tag to transmit unique identification information via a wireless signal (advertisement signal Q1) compliant with Bluetooth (registered trademark) Low Energy.

The following description discusses the work attachments 9. Each of the plurality of types of work attachments 9 includes a mounting base 91 attachable to the attachment mount 40, and a functioning portion 92 connected to the mounting base 91 to perform a predetermined function corresponding to work.

The mounting bases 91 of the respective plurality of types of work attachments 9 have the same configuration (common configuration), and each of the mounting bases 91 is replaceably attachable to the attachment mount 40 of the working machine 1. As shown in FIG. 12, and as described earlier, the mounting base 91 includes, at the top edge thereof, a hook portion 910 configured to engage with the top edge of the frame body 420. The mounting base 91 includes engagement hole(s) 92*a* located lower than the top edge and configured to engage with the engaging portion(s) 412 (latch pin(s) 412) of the attachment mount 40. That is, the mounting base 91 includes engagement holes 92*a* at positions corresponding to the engaging portions 412 (latch pins 412) of the attachment mount 40.

With this, the mounting base 91 is configured such that, when the mounting base 91 is in a predetermined attaching position with respect to the attachment mount 40 (when the hook portion 910 engages with the frame body 420), when the latch pins (engaging portions) 412 of the linkage 41 are in the engaging position PE1, the latch pints 412 engage with the mounting base 91 (engagement holes 92*a*) to achieve the connected state, whereas, when the latch pins (engaging portions) 412 of the linkage 41 are in the disengaging position PE2, the latch pins 412 disengage from the mounting base 91 (engagement holes 92*a*) to allow the mounting base 91 to be detached.

Note that, although the description of the working machine 1 is still unfinished, the work attachment 9 will be described to help understanding the rest of the description. As shown in FIGS. 1 to 8, examples of the plurality of types of work attachments 9 include non-drive work attachments 9A without a driving system and drive work attachments 9B with a driving system to perform a predetermined function. That is, the plurality of types of work attachments 9 include non-drive work attachments 9A without hydraulic actuators 95, 96 in the functioning portion 92 (see FIGS. 1 to 3), and drive work attachments 9B including hydraulic actuator(s) 95, 96 in the functioning portion 92 (see FIGS. 4 to 8).

Each drive work attachment 9B includes at least a hydraulic actuator to be actuated (driven) as necessary during work. Specifically, examples of the drive work attachment 9B include drive work attachments including only a hydraulic cylinder 95 as the hydraulic actuator 95 to be actuated as necessary during work (see FIGS. 4 and 13, hereinafter referred to as type-I drive work attachments 9Ba), and drive work attachments including a hydraulic motor 96 as the hydraulic actuator 96 to be actuated as necessary during work (see FIGS. 5 and 14, hereinafter referred to as type-II drive work attachments 9Bb).

Examples of the drive work attachment 9B also include drive work attachments including, in addition to the hydraulic cylinder 95 as the hydraulic actuator 95 to be actuated as needed during work, a hydraulic motor 96 as the hydraulic actuator 96 to be actuated constantly (see FIGS. 6 to 8 and FIGS. 15 and 16, hereinafter referred to as type-III drive work attachments 9Bc). That is, examples of the drive work attachments 9B include type-III drive work attachments 9Bc including a plurality of hydraulic actuators 95 and 96 including at least one hydraulic motor 96 to drive a rotor to perform a function corresponding to work, and configured such that the hydraulic actuator (hydraulic cylinder) 95 other than the hydraulic motor 96 operates in a different manner than the hydraulic motor 96.

Figure 13:
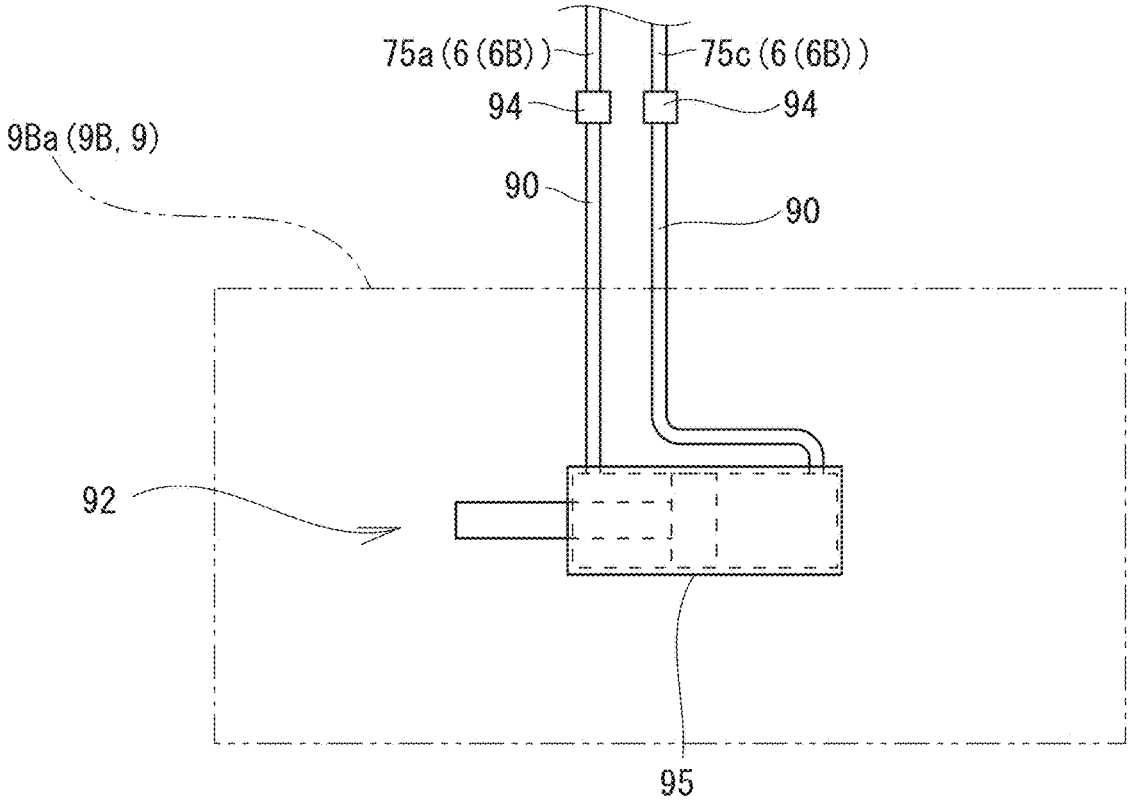
FIG. 13 is a schematic illustration of a hydraulic system of a type-I drive work attachment attached to a working machine according to the same example embodiment of the present invention.
Figure 14:
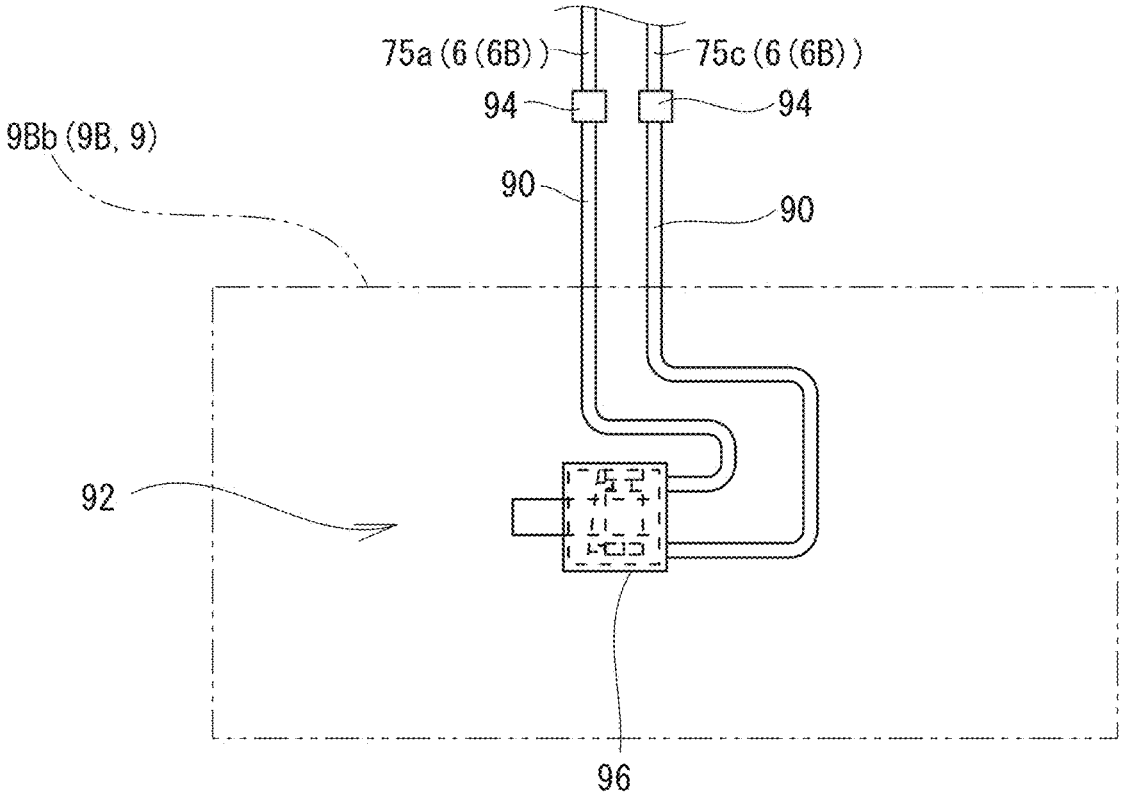
FIG. 14 is a schematic illustration of a hydraulic system of a type-II drive work attachment attached to a working machine according to the same example embodiment of the present invention.

As shown in FIGS. 13 and 14, these drive work attachments 9B each include fluid passage(s) 90 connectable fluidly to the hydraulic circuit 6 (AUX port(s) 75*a*, 75*b*, 75*c*, described later) of the working machine 1. Specifically, as shown in FIG. 13, each type-I drive work attachment 9Ba includes fluid passage(s) 90 connected to the hydraulic cylinder 95 and connected to the AUX ports 75*a*, 75*b* and/or 75*c*, and, as shown in FIG. 14, each type-II drive work attachment 9Bb includes fluid passage(s) 90 connected to the hydraulic motor 96 and connected to the AUX ports 75*a*, 75*b* and/or 75*c*. Regarding the type-I drive work attachment 9Ba and the type-II drive work attachment 9Bb, since the hydraulic actuator 95, 96 is actuated at a single point in time, the supply of hydraulic fluid and the stopping of supply of hydraulic fluid are switched by the operation of the AUX switch 85 (turning ON or OFF the AUX switch 85) provided inside the operation cab OR, and the hydraulic actuator 95, 96 is actuated accordingly.

Figure 15:
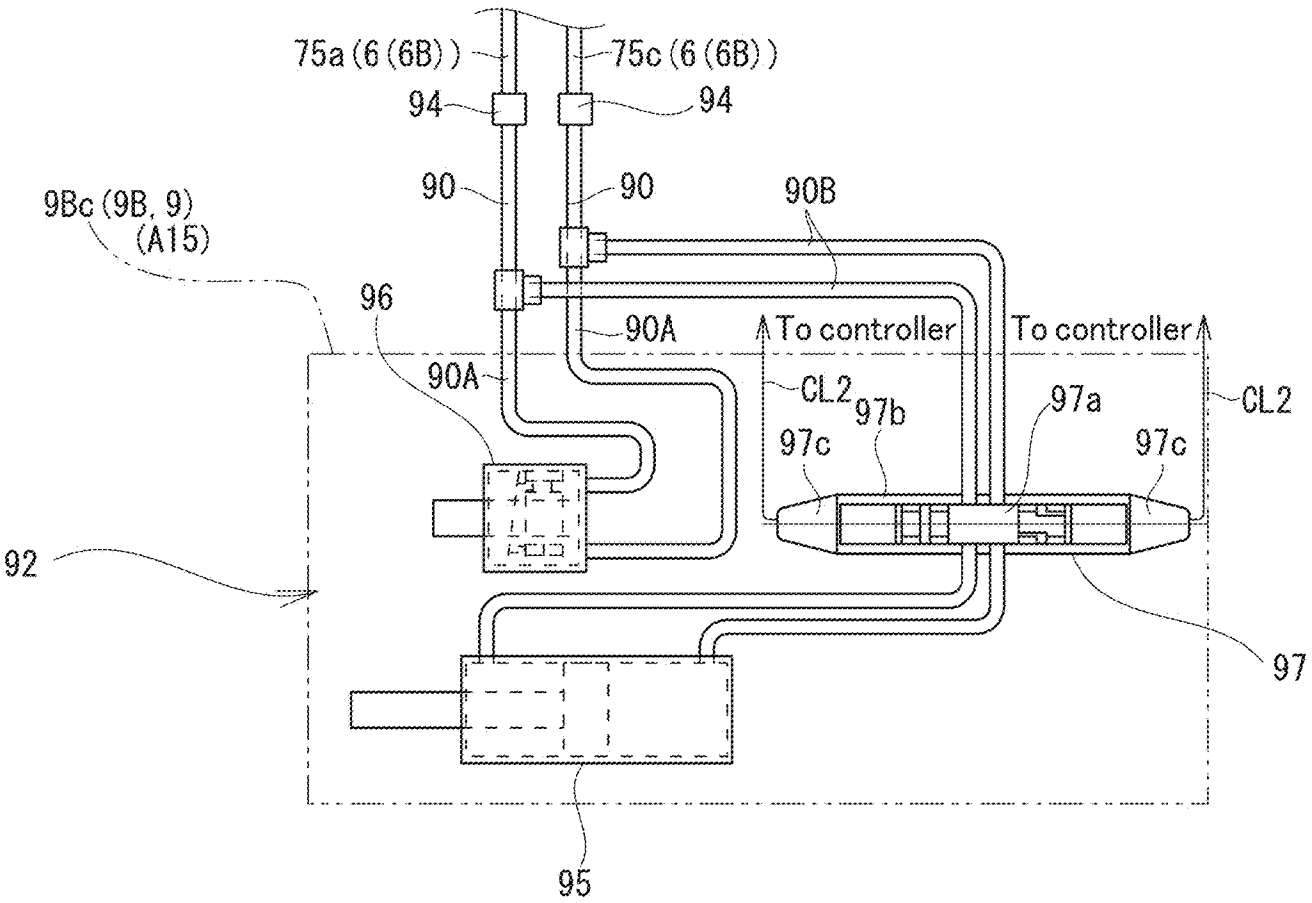
FIG. 15 is a schematic illustration of a hydraulic system of a type-III drive work attachment (angle broom) attached to a working machine according to the same example embodiment of the present invention.
Figure 16:
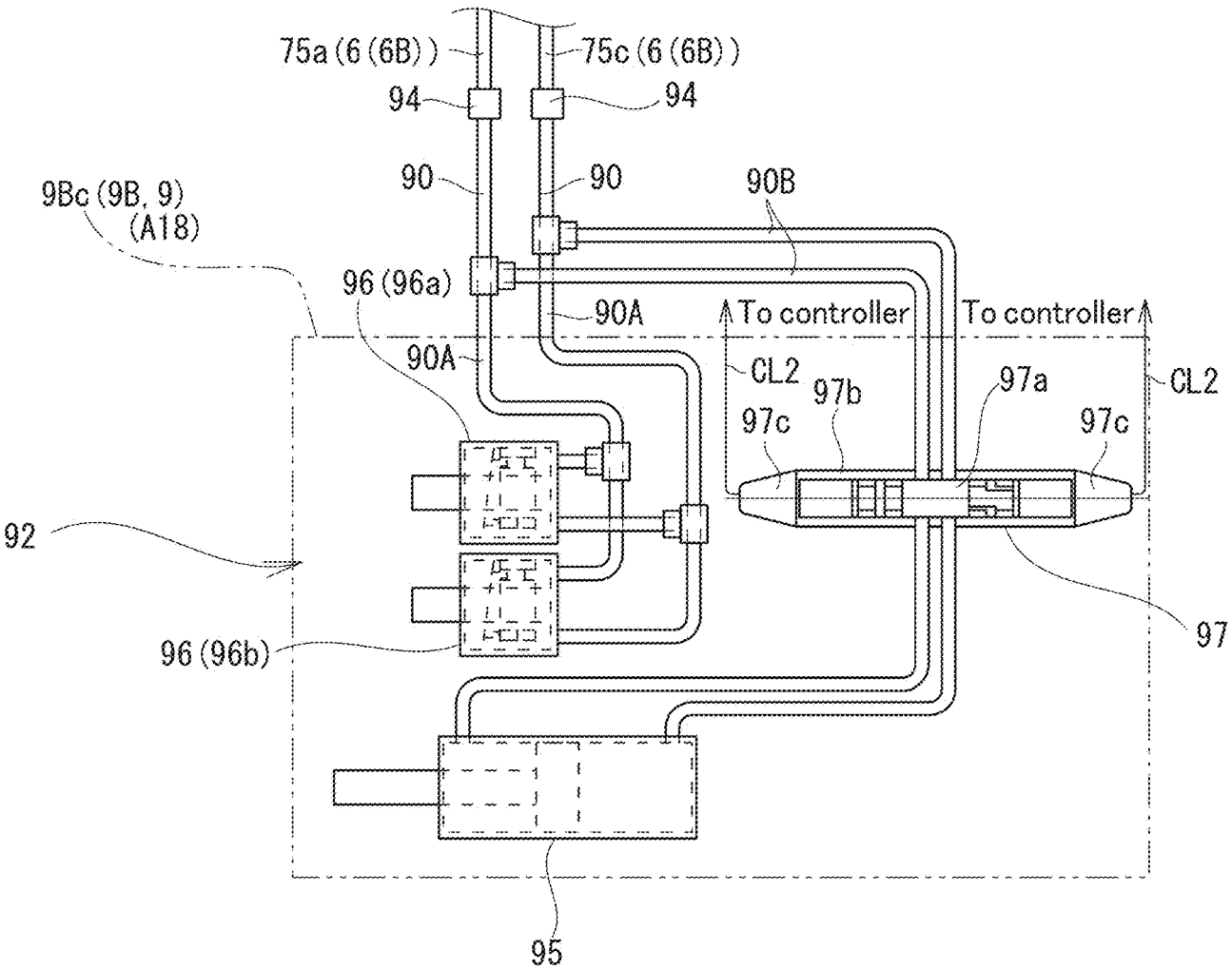
FIG. 16 is a schematic illustration of a hydraulic system of a type-III drive work attachment (snow blower) attached to a working machine according to the same example embodiment of the present invention.

On the other hand, as shown in FIGS. 15 and 16, each type-III drive work attachment 9Bc includes fluid passage(s) 90 connected to the AUX ports 75*a*, 75*b* and/75*c*, first fluid passage(s) 90A connected to the fluid passage(s) 90 and connected to the hydraulic motor 96, second fluid passage(s) 90B branching from the junction of the fluid passage(s) 90 and the first fluid passage(s) 90A and connected to the hydraulic actuator (hydraulic cylinder) 95 other than the hydraulic motor 96, and a control valve 97 provided in the second fluid passage(s) 90B. That is, the type-III drive work attachment 9Bc, which includes a plurality of hydraulic actuators 95 and 96 including at least one hydraulic motor 96 to drive a rotor to perform a function corresponding to work, includes a solenoid control valve 97 to control the flow rate of hydraulic fluid for the hydraulic actuator 95 other than the hydraulic motor 96 among the plurality of hydraulic actuators 95 and 96.

Figure 2:
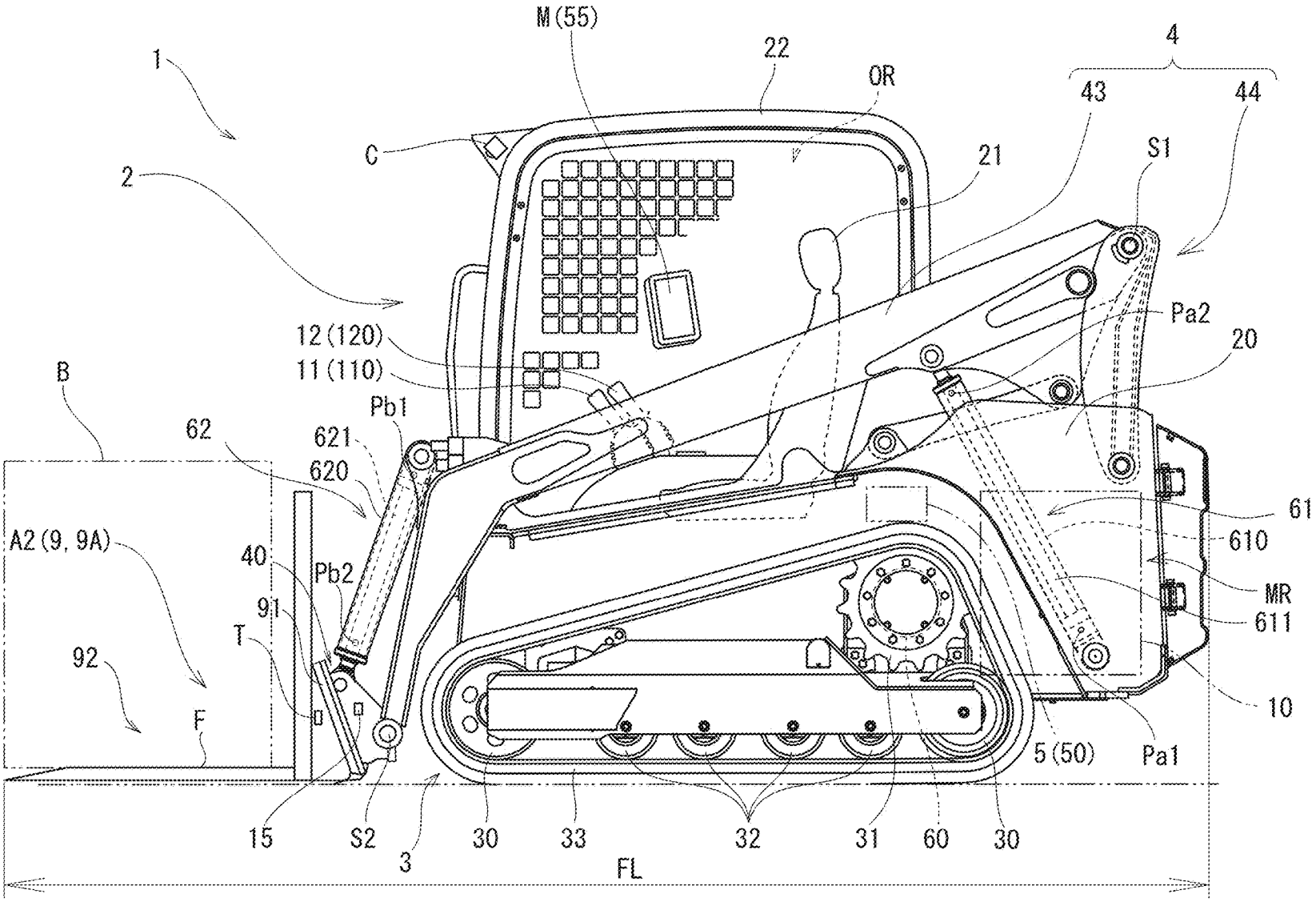
FIG. 2 is a schematic side view showing a working machine according to the same example embodiment of the present invention with a pallet fork attached as a work attachment.
Figure 3:
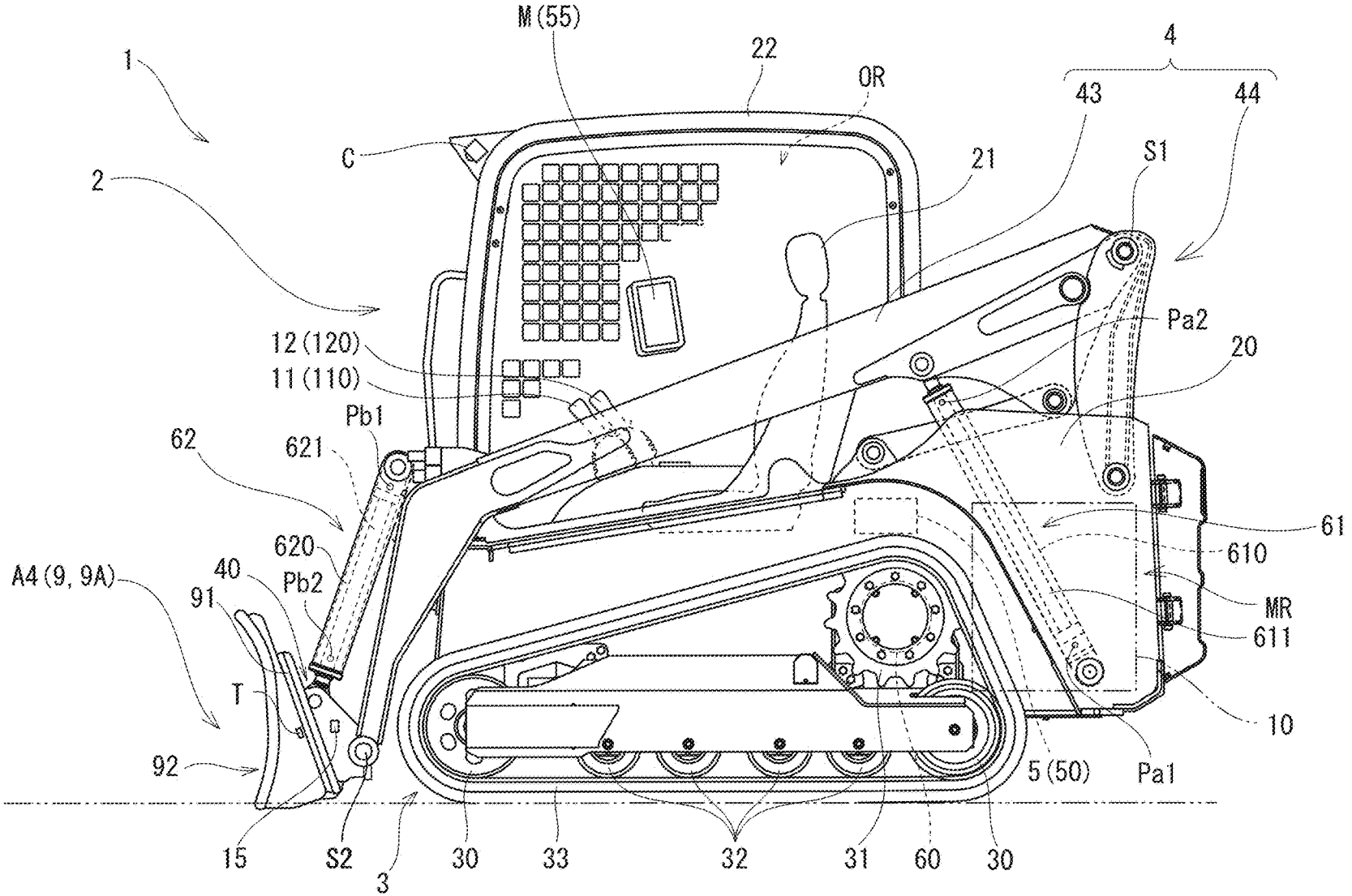
FIG. 3 is a schematic side view showing a working machine according to the same example embodiment of the present invention with a snow pusher attached as a work attachment.
Figure 4:
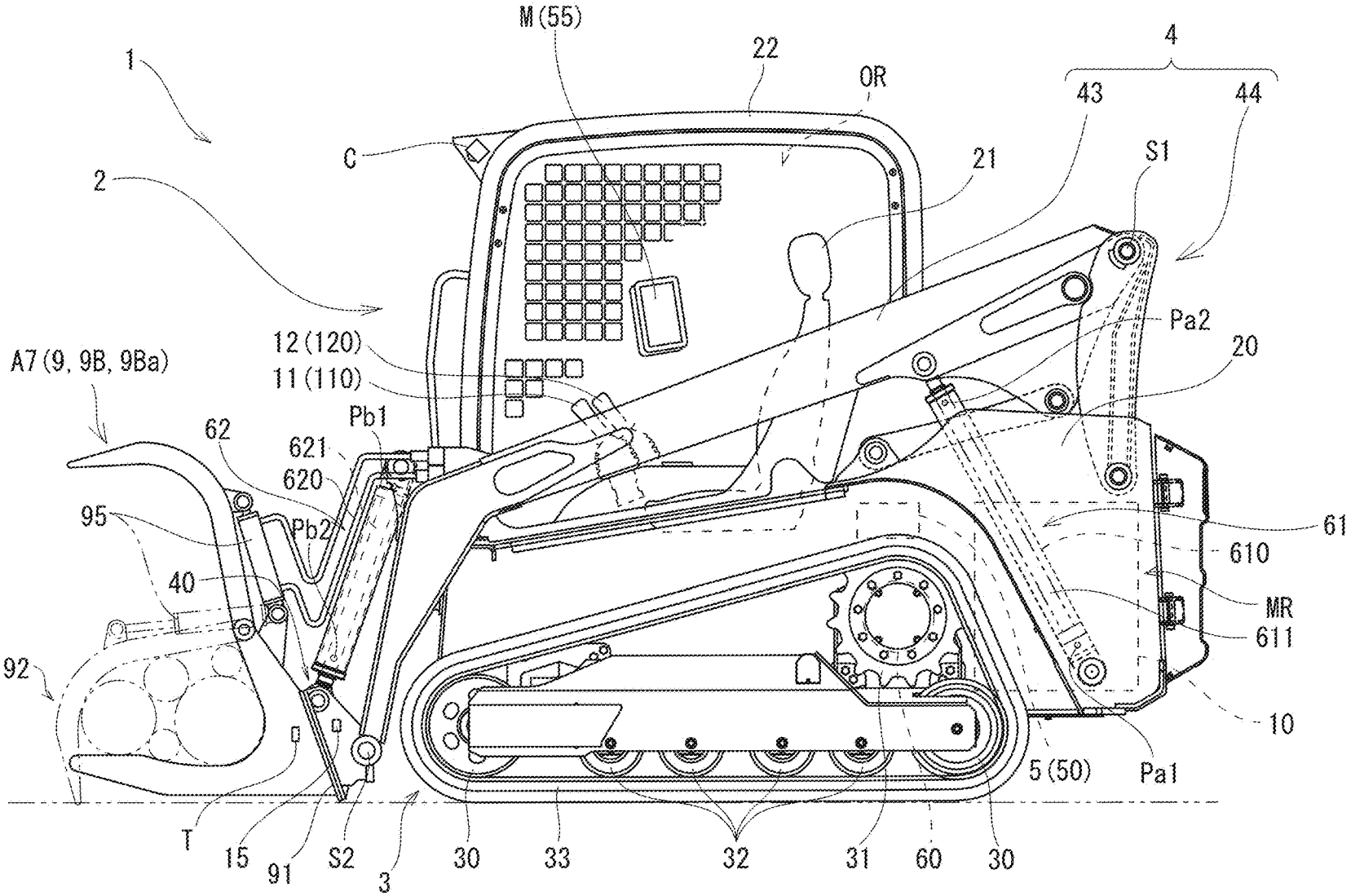
FIG. 4 is a schematic side view showing a working machine according to the same example embodiment of the present invention with a grapple attached as a work attachment.
Figure 5:
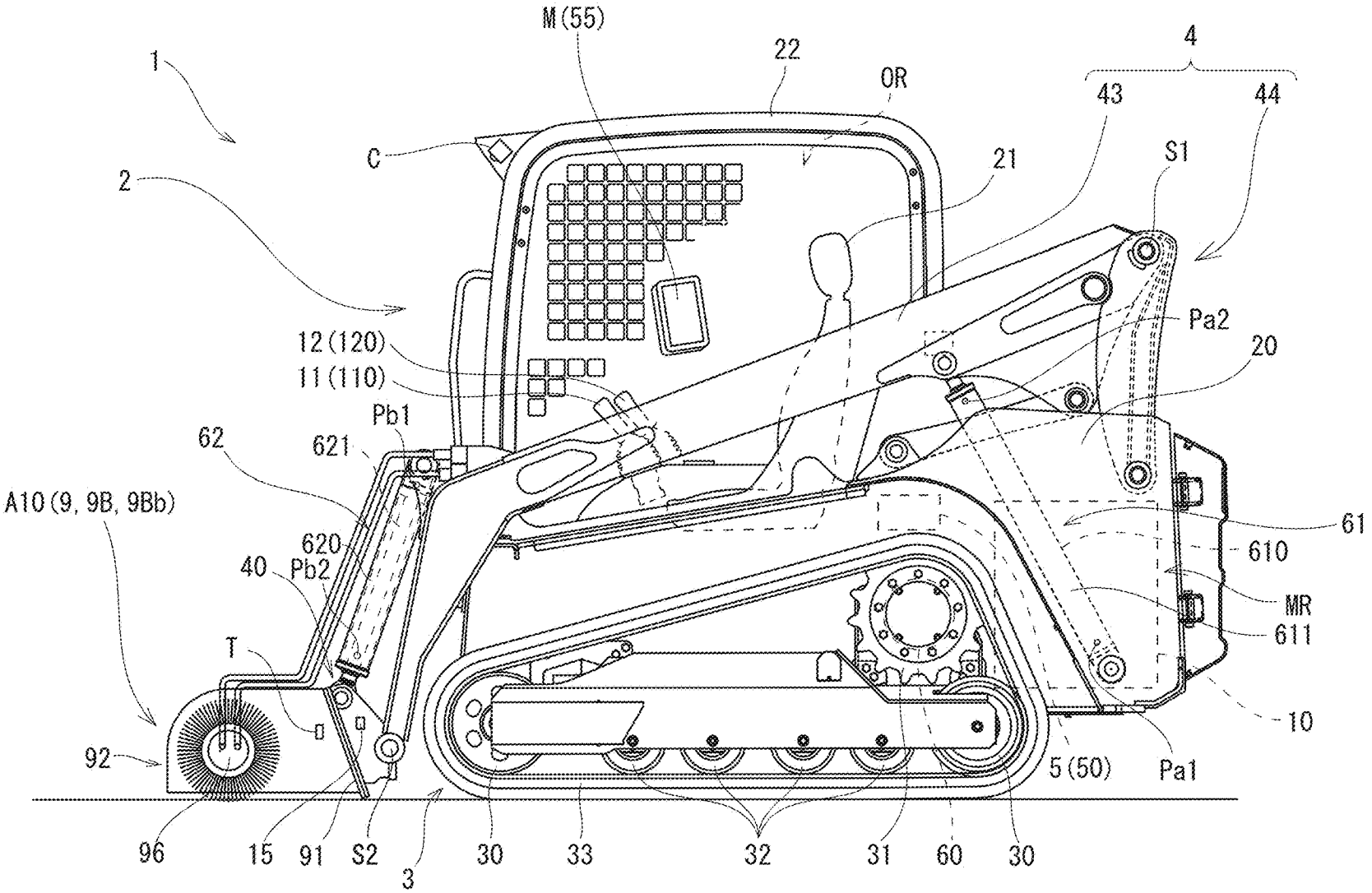
FIG. 5 is a schematic side view showing a working machine according to the same example embodiment of the present invention with a sweeper attached as a work attachment.
Figure 6:
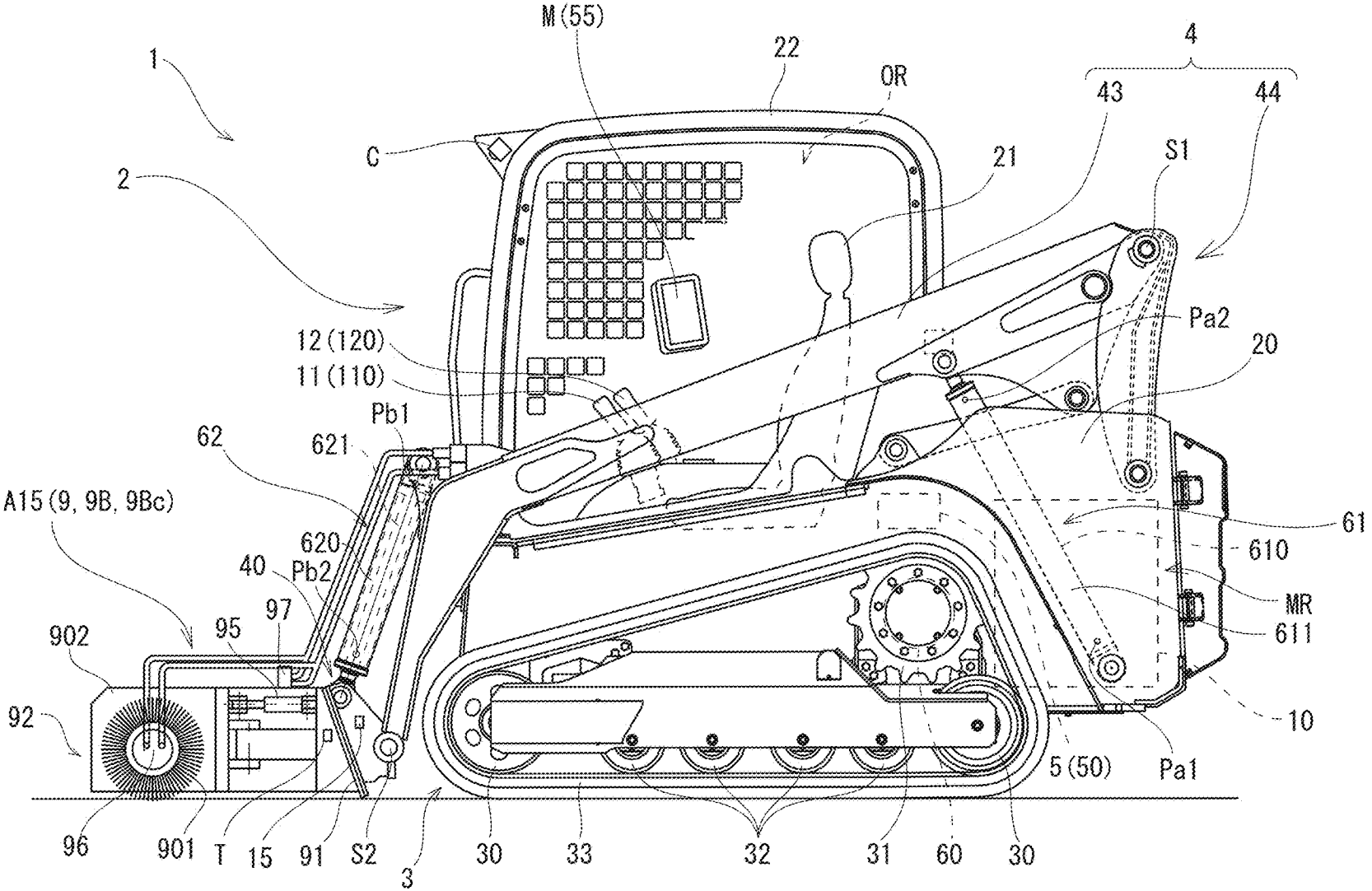
FIG. 6 is a schematic side view showing a working machine according to the same example embodiment of the present invention with a broom (angle broom) attached as a work attachment.
Figure 7:
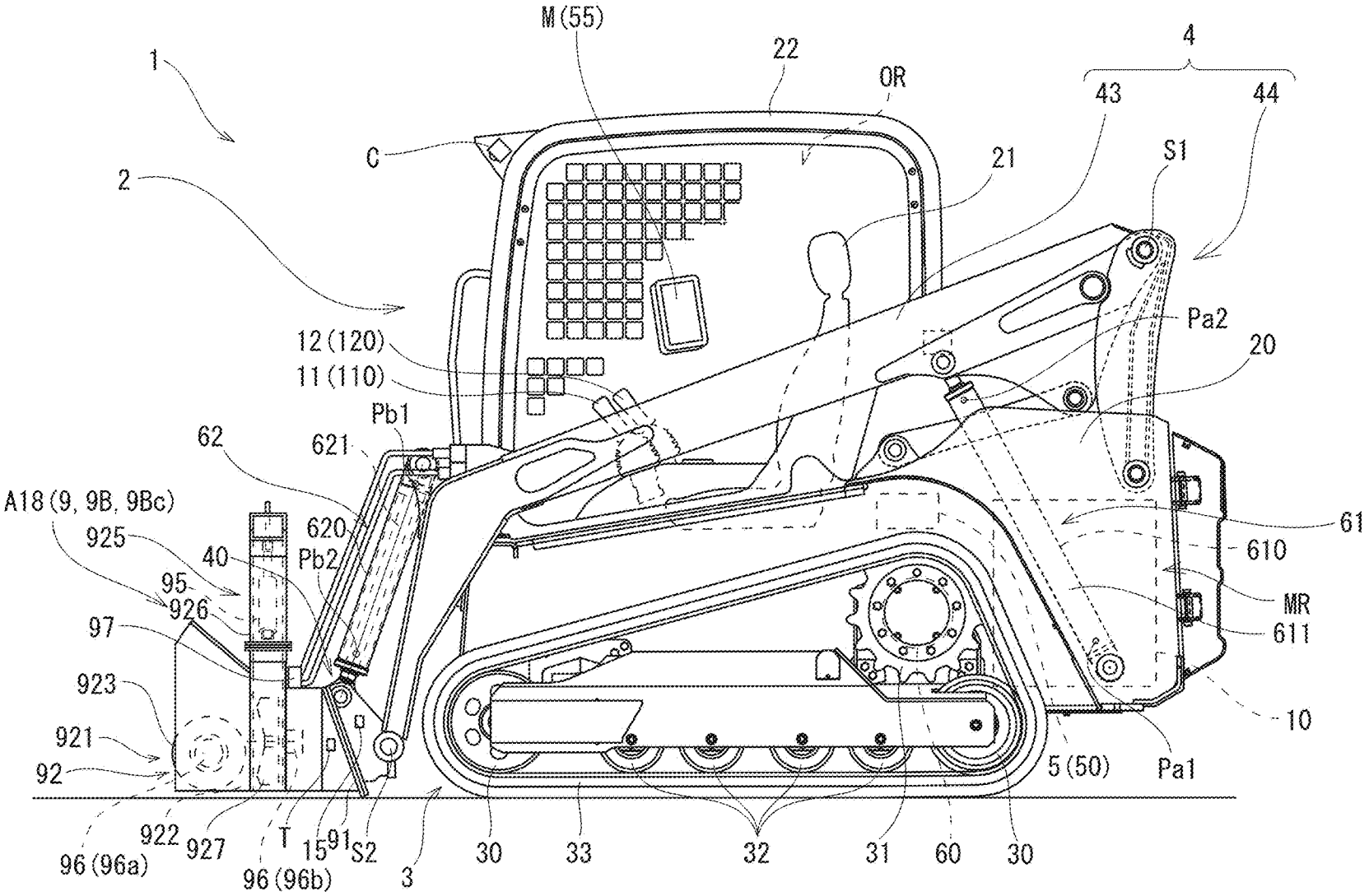
FIG. 7 is a schematic side view showing a working machine according to the same example embodiment of the present invention with a snow blower attached as a work attachment.
Figure 8:
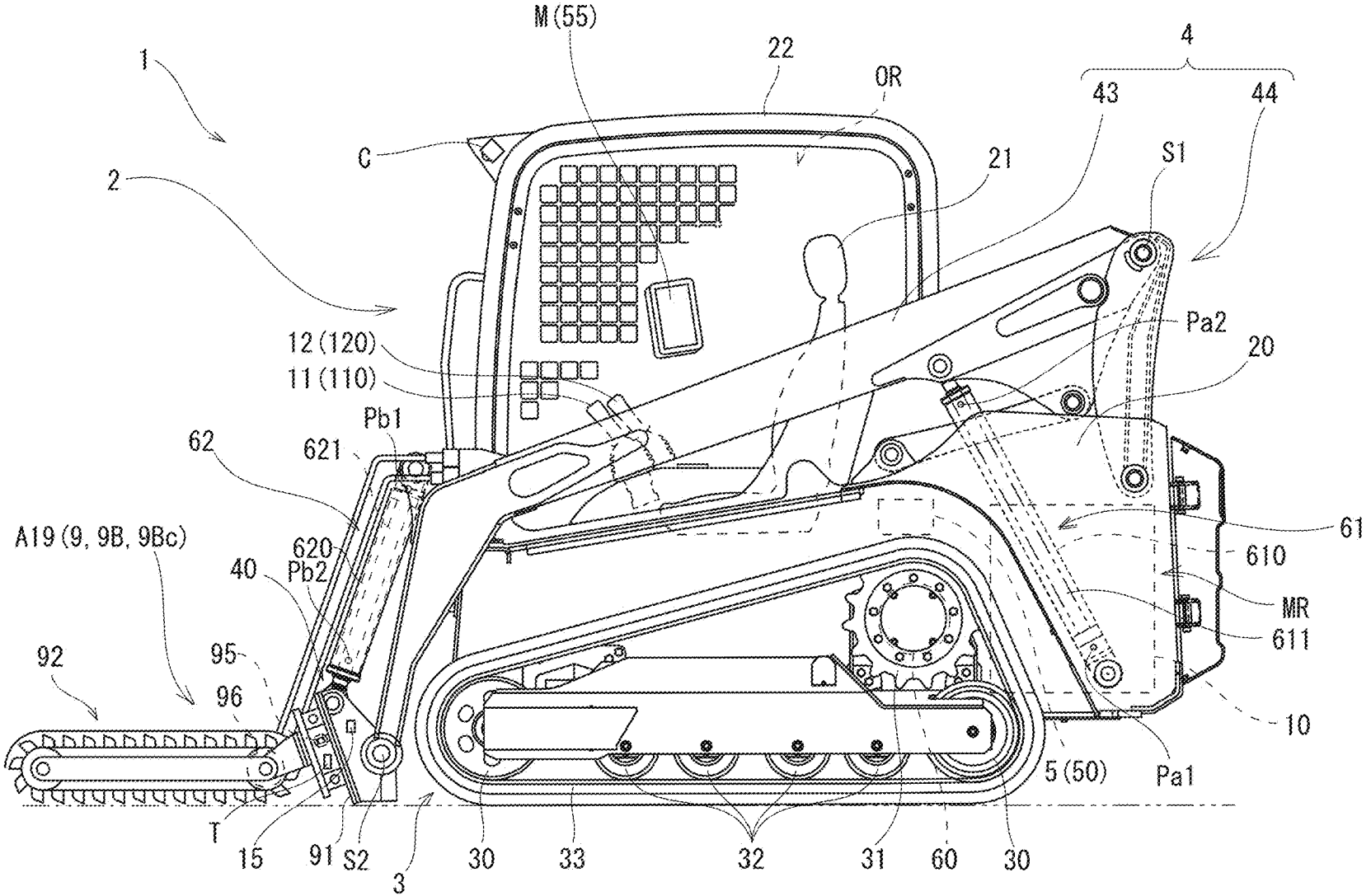
FIG. 8 is a schematic side view showing a working machine according to the same example embodiment of the present invention with a trencher attached as a work attachment.

The following more specifically discusses the work attachments 9 (9A and 9B (9Ba, 9Bb and 9Bc)). Examples of the work attachments 9 attachable to the working machine 1 (the work attachments recorded (registered) in the storing unit 50) in the present example embodiment include a bucket A1, a pallet fork A2, a ripper A3, a snow pusher A4, a dozer blade A5, a crusher A6, a grapple A7, a skid grader A8, a spreader A9, a sweeper A10, a skid cutter A11, a breaker A12, an earth auger A13, a rotary tiller A14, a broom (angle broom) A15, a cold planer A16, a stump grinder A17, a snow blower A18, a trencher A19, and a mower A20 (see FIG. 19). Note that, to illustrate examples of those listed above, FIG. 1 shows the working machine 1 with the bucket A1 attached, FIG. 2 shows the working machine 1 with the pallet fork A2 attached, FIG. 3 shows the working machine 1 with the snow pusher A4 attached, FIG. 4 shows the working machine 1 with the grapple A7 attached, FIG. 5 shows the working machine 1 with the sweeper A10 attached, FIG. 6 shows the working machine 1 with the angle broom A15 attached, FIG. 7 shows the working machine 1 with the snow blower A18 attached, and FIG. 8 shows the working machine 1 with the trencher A19 attached.

Of these examples, the bucket A1, the pallet fork A2, the ripper A3, the snow pusher A4, and the like are classed as non-drive work attachments 9A, and the others are classed as drive work attachments 9B.

Of the drive work attachments 9B, the dozer blade A5, the crusher A6, the grapple A7, the skid grader A8, the spreader A9 and the like are classed as type-I drive work attachments 9Ba. The sweeper A10, the skid cutter A11, the breaker A12, the earth auger A13, the rotary tiller A14 and the like are classed as type-II drive work attachments 9Bb. The angle broom A15, the cold planer A16, the stump grinder A17, the snow blower A18, the trencher A19, the mower A20 and the like are classed as type-III drive work attachments 9Bc.

The functioning portion 92 of the non-drive work attachment 9A is made of a metal sheet and/or the like and has a shape to perform the function. As shown in FIG. 2, the pallet fork A2 includes a fork F configured to place a cargo B thereon and extending in a direction perpendicular to the up-down direction and the lateral direction. The fork F of the pallet fork A2 has a dimension in the direction perpendicular to the up-down direction and the lateral direction long enough to have different cargoes B placed thereon. Thus, the total dimension of the pallet fork A2 in the direction perpendicular to the up-down direction and the lateral direction is longer than the total dimension of the other work attachments 9 in the same direction.

As described above, the drive work attachment 9B includes hydraulic actuator(s) 95 and/or 96 in the functioning portion 92, and the functioning portion 92 performs a predetermined function upon actuation of the hydraulic actuator(s) 95 and/or 96. The following description discusses the angle broom A15 and the snow blower A18 classed as type-III drive work attachments as examples of the drive work attachments 9B.

As shown in FIG. 6, the angle broom A15 is configured to perform work to remove dust, garbage or the like on the road. The angle broom A15 includes a rotary brush 901 which is a rotor to brush dust off the road, the hydraulic motor 96 as the hydraulic actuator 96 to drive the rotary brush 901, and the hydraulic cylinder 95 as the hydraulic actuator 95 to change the posture of the rotary brush 901.

Specifically, the angle broom A15 includes the rotary brush 901 extending in the width direction, the hydraulic motor 96 to drive the rotary brush 901 to rotate, and the hydraulic cylinder 95 to cause a frame 902 to rotate about an axis to change the posture of the rotary brush 901. The angle broom A15 includes the frame 902 to support rotatably opposite ends of the rotary brush 901 and connected to the mounting base 91 rotatably about an axis extending in the up-down direction. The hydraulic motor 96 is fixed to the frame 902, and the hydraulic cylinder 95 is provided such that the hydraulic cylinder 95 extends from the mounting base 91 to the frame 902.

In the angle broom A15, as shown in FIG. 15, the upstream portion (primary portion) of each fluid passage 90 is provided with a coupler 94 (joint) connectable to the AUX port 75*a*, 75*b* or 75*c*, and the downstream portion (secondary portion) of the fluid passage 90 branches (is divided), from the primary portion, into a plurality of passages. That is, the angle broom A15 includes a first fluid passage 90A connected to the fluid passage 90 attached to the coupler 94 and connected to the hydraulic motor 96, and a second fluid passage 90B (i.e., a branched fluid passage) branching from the first fluid passage 90A and connected to the hydraulic cylinder 95.

The control valve 97 is provided in the second fluid passages 90B connected to the hydraulic cylinder 95. The control valve 97 includes a spool 97*a* movable in a direction perpendicular to the direction of flow of hydraulic fluid in the fluid passages 90 (second fluid passages 90B), a housing 97*b* to house the spool 97*a*, and solenoid(s) 97*c* connected to the controller 5 to cause the spool 97*a* to move (slide). The control valve 97 is configured such that, upon actuation of the solenoid(s) 97*c* in accordance with an instruction from the controller 5, the spool 97*a* is slid within the housing 97*b* to switch allowing/disallowing the flow and the directions of the flow of hydraulic fluid in the second fluid passages 90B. With this, the hydraulic cylinder 95 extends or retracts, so that the orientation (posture) of the rotary brush 901 is changed. In the present example embodiment, the solenoids 97*c* of the control valve 97 are connected to control lines CL2 of the attachment connectable to control line(s) CL1 (see FIG. 18).

The angle broom A15, as has been described, removes dust, garbage and the like during travel, when the traveling devices 3 are driven while the rotary brush 901 is driven to constantly rotate. That is, while the working machine 1 is traveling, the rotary brush 901 is driven by the hydraulic motor 96 to constantly rotate, so that dust, garbage and the like are brushed away. Then, when the posture (orientation) of the rotary brush 901 is appropriately changed via extension or retraction of the hydraulic cylinder 95 according to the situation, dust, garbage and the like are brushed away in an appropriate direction (to the road shoulder, for example), so that dust, garbage and the like are removed from the road.

The snow blower A18 is configured to remove snow on the road and, as shown in FIG. 7, the snow blower A18 includes a collector 921 to collect snow on the road, and a discharger (chute) 925 to discharge the snow collected at the collector 921 in the desired direction. The collector 921 includes a blade 922, an auger 923 located forward of the blade 922, and a hydraulic motor 96 (96*a*) to drive the auger 923. The discharger 925 includes a tubular discharge passage 926 (discharge duct) connected to the blade 922 to guide the snow collected at the blade 922 in the desired direction, a feed impeller 927 to feed the collected snow into the discharge passage 926, a hydraulic motor 96 (96*b*) to drive the feed impeller 927, and a hydraulic cylinder 95 as the hydraulic actuator to change the direction of snow discharge through the discharge passage 926.

As shown in FIG. 16, in the snow blower A18, the upstream portion (primary portion) of each fluid passage 90 is provided with a coupler 94 (joint) connectable to the AUX port 75*a*, 75*b* or 75*c*, and the downstream portion (secondary portion) of the fluid passage 90 branches (is divided), from the primary portion, into a plurality of fluid passages. That is, the snow blower A18 includes a first fluid passage 90A connected to the fluid passage 90 having the coupler 94 attached thereto and connected to the hydraulic motors 96, and a second fluid passage 90B (i.e., branched fluid passage) branching from the first fluid passage 90A and connected to the hydraulic cylinder 95, and the first fluid passage 90A branches into a plurality of (two) passages directed to a plurality (two) of hydraulic motors 96 (96*a* and 96*b*). That is, in the snow blower A18, the first fluid passage 90A is divided into two passages at a position downstream of the junction at which the second fluid passage 90B branches, and the two passages are connected to a hydraulic motor 96 (96*a*) to drive the auger 923 and a hydraulic motor 96 (96*b*) to drive the feed impeller 927.

The control valve 97 is provided in the second fluid passages 90B connected to the hydraulic cylinder 95. The control valve 97 includes a spool 97*a* movable in a direction perpendicular to the direction of flow of hydraulic fluid in the fluid passages 90 (second fluid passages 90B), a housing 97*b* to house the spool 97*a*, and solenoid(s) 97*c* connected to the controller 5 to cause the spool 97*a* to move (slide). The control valve 97 is configured such that the solenoids 97*c*, which are actuated according to an instruction from the controller 5, cause the spool 97*a* to slide within the housing 97*b*, thus switching allowing or not allowing the flow and the direction of the flow of hydraulic fluid in the fluid passage 90 (second fluid passage 90B). With this, the hydraulic cylinder 95 extends or retracts, so that the orientation (height) of the discharge port of the discharge passage 926 (discharge duct) is changed. In the present example embodiment, the solenoids 97*c* of the control valve 97 are connected to the control lines CL2 of the attachment connectable to the control line(s) CL1 (FIG. 18) connected to the controller 5.

The snow blower A18, as has been described, performs snow removal while the working machine 1 travels. That is, while the working machine 1 is traveling, the auger 923 constantly rotates and collects the snow on the road to the widthwise central portion of the blade 922, the feed impeller 927 feeds the snow collected at the widthwise central portion of the blade 922 into the discharge passage 926 (discharge duct), and causes the snow to be discharged from the discharge port of the discharge passage 926. In so doing, when the orientation (height) of the discharge port of the discharge passage 926 is changed by extension or retraction of the hydraulic cylinder 95 appropriately according to the situation, the snow is discharged to an appropriate location (direction).

Referring back to FIGS. 1 to 8, the attachment support structure 4 includes arm(s) 43 connected to the attachment mount 40 and supported on the machine body 2 such that the arm(s) 43 is/are rotatable about first shaft(s) S1 extending in the lateral direction perpendicular to the up-down direction.

The arms 43 extend in a direction perpendicular to the up-down direction and the lateral direction (hereinafter referred to as "arm extension direction"), and each include a proximal portion and a distal portion which are arranged in the arm extension direction. The proximal portion of each arm 43 is connected to the machine body 2 rotatably about the first shaft S1 including an axis (central axis) extending in the lateral direction. In the present example embodiment, the arms 43 are connected to the machine body 2 via linker(s) 44 connected to the machine body 2. On the other hand, the attachment mount 40 is connected to the distal portions of the arms 43.

With this, the attachment mount 40 is movable along a path (first path) in the form of an arc centered on the first shaft S1 via the rotation of the arms 43. The proximal portions of the arms 43 are connected to the rear portion of the machine body 2. When the arms 43 are in the position where the arms 43 extend from the rear portion of the machine body 2 toward the front of the machine body 2 (the arm extension direction extends from the rear of the machine body 2 toward the front), the distal portions of the arms 43 (the connected attachment mount 40) is located forward of the machine body 2. The arms 43 rotate about their first shafts S1, allowing the attachment mount 40 to move along the first path to switch between a low position in proximity to the ground and a high position higher than the low position. The high position and the low position are determined by the rotation range of the arms 43.

In the present example embodiment, the arms 43 are provided on the left and right sides of the cabin 22. That is, the working machine 1 includes a pair of the arms 43 with the cabin 22 therebetween. The shapes and positions of the pair of arms 43 are symmetrical with respect to the center of the cabin 22 in the width direction (left and right direction). Accordingly, there are also a pair of the left and right linkers 44 connected to the arms 43. In FIGS. 1 to 8, since the left side of the working machine 1 is shown, only the arm 43 and the linker 44 that are provided at the left side are shown, similar to the traveling devices 3.

In the present example embodiment, the operation actuators 61 and 62 include a first actuator 61 to cause the arms 43 to rotate about the first shafts S1 and to cause the attachment mount 40 to ascend and descend along the up-down direction. In the present example embodiment, the operation actuators 61 and 62 include a second actuator 62 to cause the attachment mount 40 to rotate about the second shaft S2 to tilt. That is, the working machine 1 of the present example embodiment includes, as the operation actuators 61 and 62, a first actuator 61 to cause the attachment mount 40 to move along a predetermined path (first path), and a second actuator 62 to cause the attachment mount 40 to move along a predetermined path (second path) different from the first path.

In the present example embodiment, the first actuator 61 and the second actuator 62 are hydraulic cylinders. That is, the first actuator 61 and the second actuator 62 are each a hydraulic cylinder that can extend and retract along the axial direction by receiving and discharging hydraulic fluid. Accordingly, in the following description, the first actuator 61 is referred to as a first hydraulic cylinder 61, and the second actuator 62 is referred to as a second hydraulic cylinder 62.

In the present example embodiment, the first hydraulic cylinder 61 extends or retracts by receiving and discharging hydraulic fluid, to cause the corresponding arm 43 to rotate about the first shaft S1. That is, the extent of extension or retraction of the first hydraulic cylinder 61 determines the rotation range of the arm 43. The first hydraulic cylinder 61 and the second hydraulic cylinder 62 each include a tubular cylinder 610 or 620, and a piston rod 611 or 621 inserted such that the piston rod is extendable and retractable into and from the tubular cylinder 610 or 620. The first hydraulic cylinder 61 and the second hydraulic cylinder 62 each include a first port Pa1 or Pb1 to allow hydraulic fluid to be supplied to the tubular cylinder 610 or 620 to cause the piston rod 611 or 621 to move in a direction in which the piston rod projects from the cylinder 610 or 620, and a second port Pa2 or Pb2 to allow hydraulic fluid to be supplied to the tubular cylinder 610 or 620 to cause the piston rod 611 or 621 to move in a direction in which the piston rod retracts into the cylinder 610 or 620. That is, the first hydraulic cylinder 61 and the second hydraulic cylinder 62 are double-acting type hydraulic cylinders.

The first hydraulic cylinder 61 is provided for each arm 43. That is, the working machine 1 includes a pair of such first hydraulic cylinders 61 provided on opposite sides of the cabin 22. The pair of first hydraulic cylinders 61 are provided symmetrically with respect to the center in the width direction (left-right direction) of the cabin 22 to correspond to the pair of arms 43.

Each of the pair of first hydraulic cylinders 61 is provided to link the corresponding arm 43 and the frame chassis 20. That is, the distal end of the piston rod 611 of the first hydraulic cylinder 61 is connected to the arm 43 rotatably about an axis perpendicular to the up-down direction, and the proximal end of the tubular cylinder 610 of the first hydraulic cylinder 61 is connected to the frame chassis 20 rotatably about an axis perpendicular to the up-down direction.

In the present example embodiment, a pair of the second hydraulic cylinders 62 are provided with a space between them in the width direction. The pair of second hydraulic cylinders 62 are provided symmetrically with respect to the center in the width direction (left-right direction) of the cabin 22. Each of the pair of second hydraulic cylinders 62 is provided to link the corresponding arm 43 and the frame 902 of the attachment mount 40. That is, the distal end of the piston rod 621 of the second hydraulic cylinder 62 is connected to the frame 42 of the attachment mount 40 rotatably about an axis perpendicular to the up-down direction, and the proximal end of the tubular cylinder 620 of the second hydraulic cylinder 62 is connected to the arm 43 rotatably about an axis perpendicular to the up-down direction.

With this, the arms 43 rotate about the first shafts S1 and the distal end portions ascend or descend via the extension or retraction of the first hydraulic cylinders 61. The attachment mount 40 rotates about the second shaft S2 and swings along the up-down direction via the extension or retraction of the second hydraulic cylinders 62. With this, attachment mount 40 is movable along the first path, and also movable along the second path. Note that when the first hydraulic cylinders 61 and the second hydraulic cylinders 62 operate at the same time, the attachment mount 40 moves along the second path while moving along the first path, which means that the attachment mount 40 moves along a path which is the combination of the first path and the second path. Since the work attachment 9 is attached (connected) to the attachment mount 40, the work attachment 9 behaves the same way as the attachment mount 40.

As shown in FIGS. 9 and 10, the travel manual operator 11 and the work manual operator 12 are mechanical lever operators. That is, the travel manual operator 11 and the work manual operator 12 each include an operating lever 110 or 120 pivotable forward, rearward, leftward, and rightward. The operation lever 110 of the travel manual operator 11 is hereinafter referred to as a travel operating lever 110, and the operating lever 120 of the work manual operator 12 is hereinafter referred to as a work operating lever 120. Accordingly, the operation state of each of the manual operators 11 and 12 (the travel manual operator 11 and the work manual operator 12) includes the amount (extent) or the angle of pivoting of the operating lever 110, 120 (travel operating lever 110, work operating lever 120). In the present example embodiment, since the operating levers 110 and 120 (travel operating lever 110 and work operating lever 120) are pivotable forward, rearward, leftward, and rightward, the operation state of each of the manual operators 11 and 12 (travel manual operator 11 and work manual operator 12) also includes the direction of pivoting of the operating lever 110, 120 (travel operating lever 110, work operating lever 120).

More specifically, as shown in FIG. 9, the travel manual operator 11 controls the direction of travel of the traveling devices 3 according to the direction of pivoting of the travel operating lever 110, and controls the travel speed of the traveling devices 3 according to the amount of pivoting of the travel operating lever 110.

As shown in FIG. 10, the work manual operator 12 controls the vertical motion of the arms 43 and the tilting (rotation) of the attachment mount 40 (work attachment 9) by switching the direction of pivoting of the work operating lever 120, and controls the speed of vertical motion of the arms 43, i.e., the ascending/descending speed of the attachment mount 40 and/or the tilting speed of the attachment mount 40 (work attachment 9), according to the amount of pivoting of the work operating lever 120. Note that in the present example embodiment, the travel manual operator 11 and the work manual operator 12 include Hall sensors 111 and 121 (see FIGS. 9 and 10) to detect the pivoting of the operating levers 110 and 120.

That is, the travel manual operator 11 includes a Hall sensor 111 (see FIG. 9) to detect the operation (pivoting) of the travel operating lever 110, and the work manual operator 12 includes a Hall sensor 121 (see FIG. 10) to detect the pivoting of the work operating lever 120. Each of the Hall sensors 111 and 121 is provided in the vicinity of the corresponding operating lever 110 or 120 (work operating lever 120 or travel operating lever 110), and measures the amount and the direction of pivoting of the operating lever 110 or 120 (work operating lever 120 or travel operating lever 110) based on changes of magnetism (magnetic force) caused by the pivoting of the operating lever 110 or 120 (work operating lever 120 or travel operating lever 110).

In the working machine 1 of the present example embodiment, in the case where the work attachment 9 attached to the attachment mount 40 is a type-I drive work attachment 9Ba or a type-II drive work attachment 9Bb (see FIGS. 4 and 5), hydraulic fluid can be supplied to the work attachment 9 via the operation of an AUX switch 85 (see FIG. 10) as another manual operator different from the work operating lever 120. In the present example embodiment, it is possible to switch, via predetermined operation(s) of the AUX switch 85 (for example, pressing and holding the switch), between a normal mode in which the operation of the AUX switch 85 supplies or stops supplying hydraulic fluid for the work attachment 9, and a steady deliver mode to constantly supply hydraulic fluid to the work attachment 9 (at least one of the three AUX ports 75*a*, 75*b* and 75*c*) regardless of the operation of the AUX switch 85. That is, the controller 5 includes a steady deliver mode in which the controller 5 causes hydraulic fluid to constantly flow through the AUX ports 75*a*, 75*b* and\or 75*c*.

The controller 5 is configured or programmed to directly or indirectly recognize (i) at least one of a load acting on the attachment mount 40 or the presence or absence of the load or (ii) the moment about the pivot of the attachment mount 40. In the present example embodiment, the controller 5 indirectly recognizes a load acting on the attachment mount 40 and the presence or absence of the load. Specifically, the controller 5, assuming that the machine weight of the work attachment 9 is the load on the attachment mount 40, indirectly recognizes the load acting on the attachment mount 40 and the presence or absence of the load based on whether the work attachment 9 is attached to the attachment mount 40, and based on the type of the work attachment 9. Note that the controller 5 may recognize the load and the presence or absence of the load directly in a numerical manner. However, for example, the controller 5 need only be able to determine the state of the load, without recognizing an actual numerical value. Accordingly, the controller 5 of the present example embodiment is configured or programmed to recognize whether or not a work attachment 9 is attached and the type of the work attachment 9, as an example of recognizing the load on the attachment mount 40.

Furthermore, the controller 5 of the present example embodiment is configured or programmed to recognize an increase in the load acting on the work attachment 9 attached to the attachment mount 40. Increases in the load acting on the work attachment 9 may be recognized by a sensor such as a load cell attached to the attachment mount 40. However, in the present example embodiment, the controller 5 recognizes an increase in load (for example, the pallet fork A2) acting on the work attachment 9 (such an increase is caused by a cargo B) based on a change (increase) in a pressure of the hydraulic fluid in the first hydraulic cylinder(s) 61.

The controller 5 controls the entirety of the working machine 1. The controller 5 actuates the actuators 61 based on the operation state of the work manual operator (manual operator) 12. That is, the controller 5 actuates the first hydraulic cylinder(s) 61 and the second hydraulic cylinder(s) 62 (causes them to extend or retract) based on the operation state of the work manual operator (manual operator) 12. The controller 5 also actuates the traveling devices 3 based on the operation state of the travel manual operator 11. The controller 5 actuates the travel motors 60 according to the operation state of the travel manual operator 11.

The controller 5 includes (i) a normal operation mode in which the controller 5 actuates the first hydraulic actuator(s) 61 based on the operation state of the work manual operator 12, and (ii) an attachment operation mode to be performed under a condition in which the work attachment 9 attached to the attachment mount 40 is a drive work attachment 9B, the control line CL1 is in electrical connection with the control valve 97, and the AUX ports 75*a*, 75*b* and/or 75*c* allow(s) hydraulic fluid to flow constantly therethrough, the attachment operation mode being a mode in which the controller 5 stops the normal operation mode and actuates the control valve 97 based on the operation state of the work manual operator 12. The controller 5 of the present example embodiment is in the normal operation mode under normal conditions.

Figure 17:
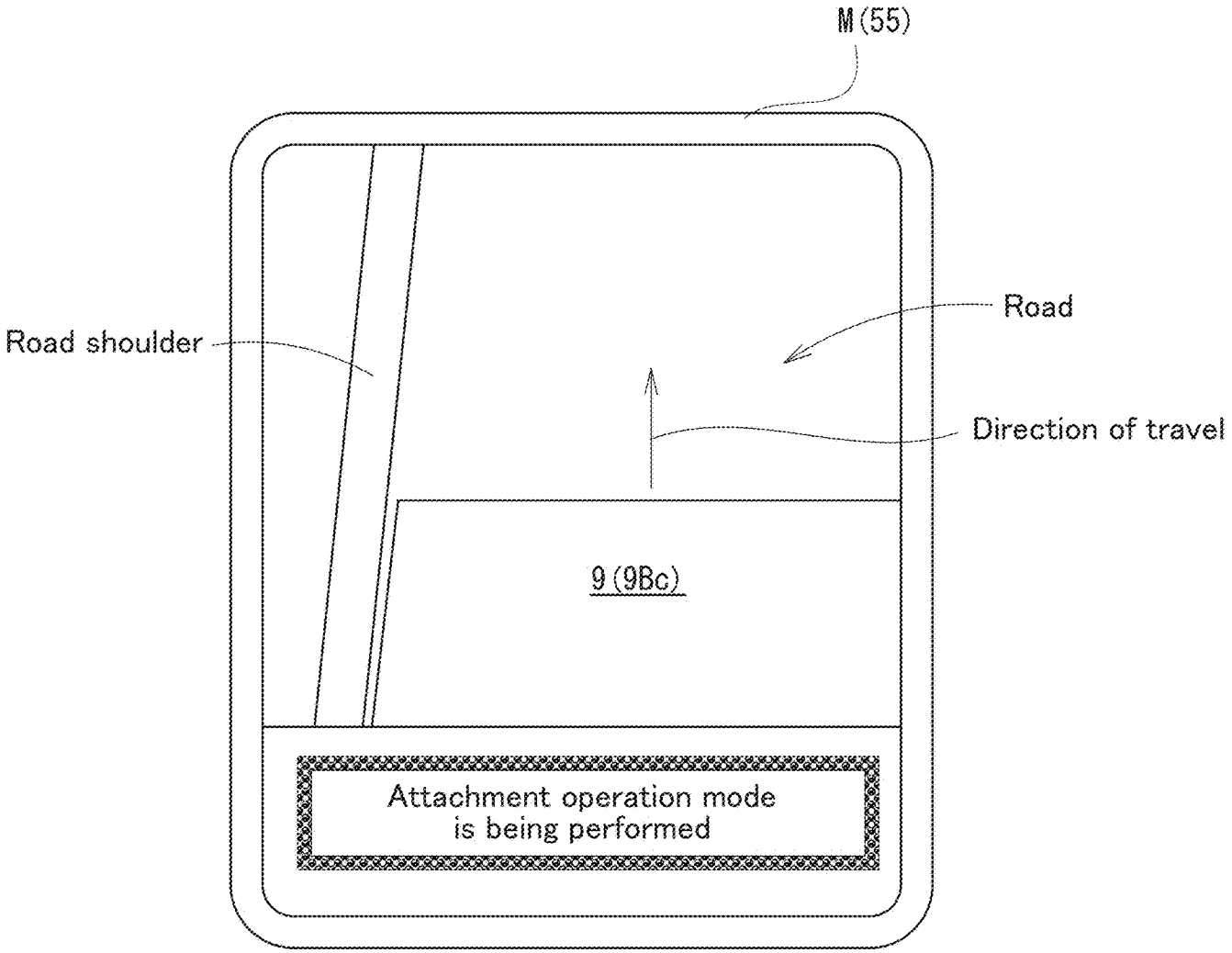
FIG. 17 schematically illustrates a monitor of a working machine according to the same example embodiment of the present invention that displays a screen during an attachment operation mode.

That is, when performing work, a non-drive work attachment 9A is often used, and therefore the controller 5 is in the normal operation mode under normal conditions. Furthermore, the controller 5 enters the attachment operation mode under the condition in which a drive work attachment 9B is attached to the attachment mount 40. That is, the controller 5 determines whether or not to perform (enter) the attachment operation mode based on the type of the recognized work attachment 9 and, if determining that the recognized work attachment 9 is a drive work attachment 9B, the controller 5 performs (enters) the attachment operation mode. Accordingly, as shown in FIG. 17, when the controller 5 enters the attachment operation mode, the controller 5 causes the monitor M to indicate that the attachment operation mode is currently performed.

Specifically, the working machine 1 (controller 5) of the present example embodiment includes an attachment operation mode in which a type-III drive work attachment 9Bc can be controlled by operating the work manual operator 12 (work operating lever 120), and, when the attachment operation mode is entered, the controller 5 causes the monitor M to indicate that the attachment operation mode is currently performed in order for the user not to misunderstand the content of the operation of the work manual operator 12. Accordingly, the controller 5 causes the monitor M to display image(s) captured by the camera C at least when the attachment operation mode is performed. That is, the controller 5 causes the monitor M to display an image or video, captured by the camera C, which includes at least a portion of the work attachment 9.

Figure 18:
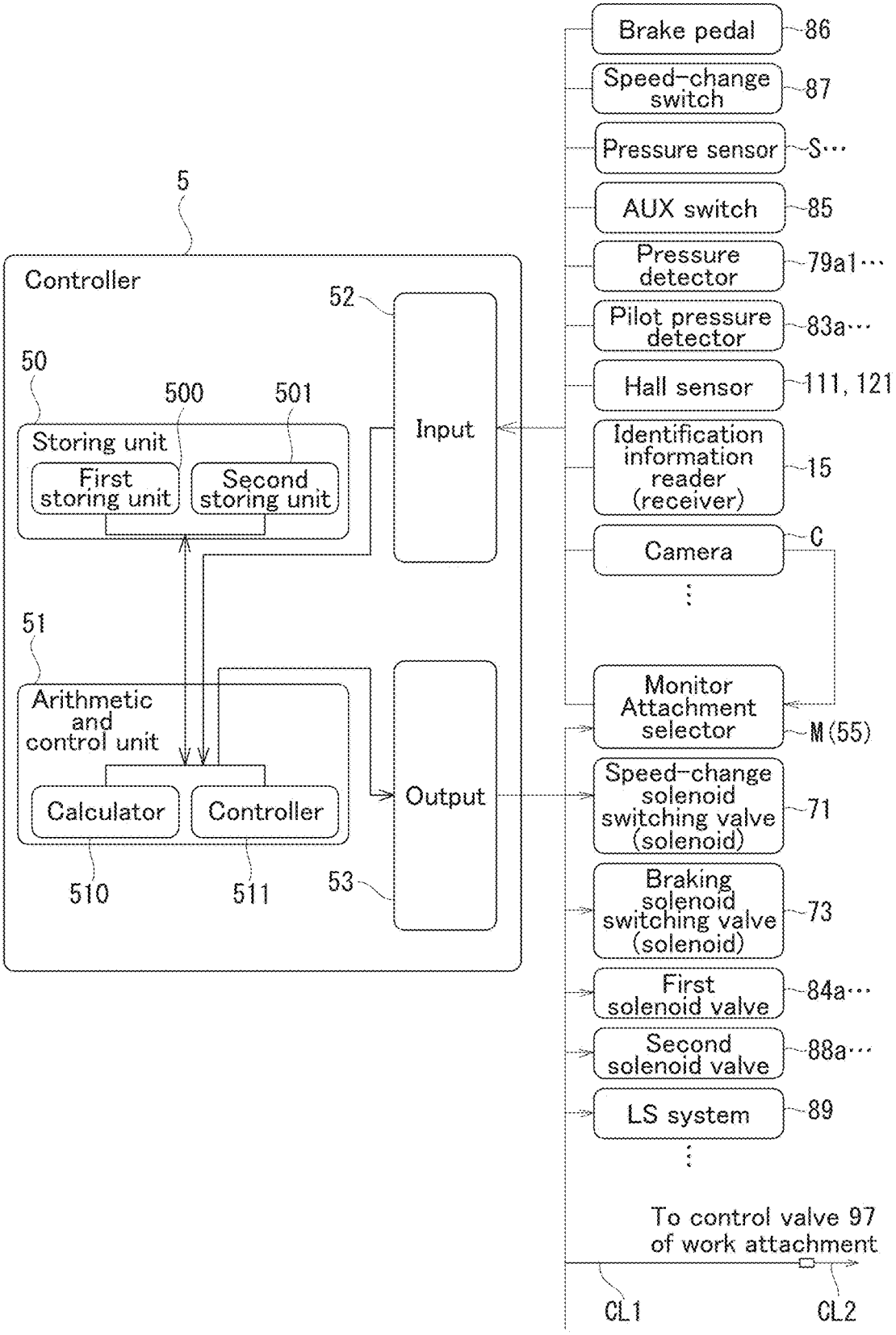
FIG. 18 is a block diagram of a controller of a working machine according to the same example embodiment of the present invention.
Figure 20:
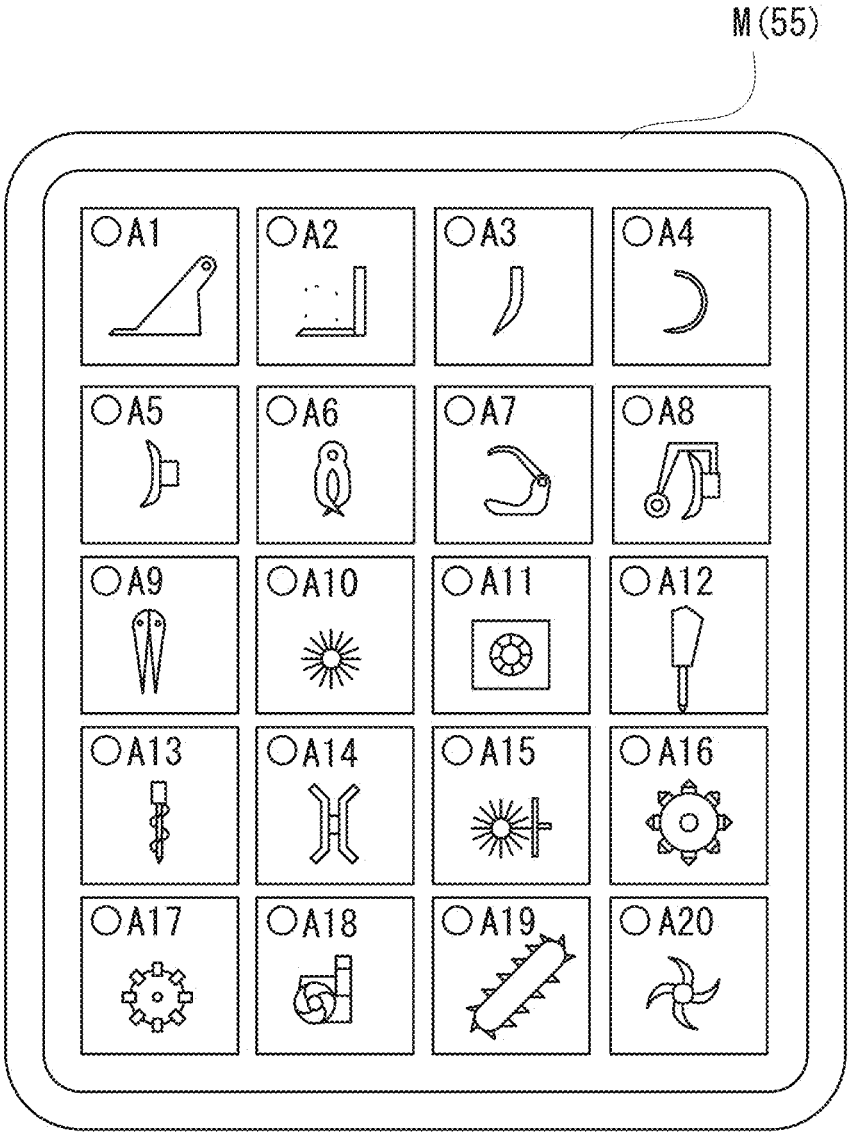
FIG. 20 schematically illustrates an attachment list to be displayed on a monitor of a working machine according to the same example embodiment of the present invention.

As shown in FIG. 18, the storing unit 50 is included in the controller 5. Specifically, the controller 5 is configured or programmed to include (i) an arithmetic and control unit 51, (ii) the storing unit 50 to store information for use in processing by the arithmetic and control unit 51, (iii) an input 52 electrically connected to the arithmetic and control unit 51 to input electrical signals from external electrical equipment as input information into the arithmetic and control unit 51, and (iv) an output 53 electrically connected to the arithmetic and control unit 51 to output instruction signals (electrical signals) as output information from the arithmetic and control unit 51 toward the external electrical equipment.

The arithmetic and control unit 51 includes a so-called CPU, and includes a calculator 510 and a controller 511. In the controller 5 of the present example embodiment, the storing unit 50 includes a first storing unit 500 to store temporarily or for a short time information for use in the processing by the arithmetic and control unit 51 (calculator 510 and controller 511), and a second storing unit 501 to store for a long time information for use in the processing by the arithmetic and control unit 51 (calculator 510 and controller 511). The first storing unit 500 includes a so-called memory, and the second storing unit 501 includes a storage such as a hard disk or a solid state drive (SSD).

In the present example embodiment, as shown in FIG. 19, a plurality of types of work attachments 9 (work attachments 9 of different types) (A1 to A20) attachable to the attachment mount 40 are recorded (registered) in the storing unit 50. More specifically, a plurality of types of work attachments 9 (A1 to A20) and pieces of identification information allocated to the respective plurality of types of work attachments 9 (A1 to A20) are associated with each other and stored in the storing unit 50.

The storing unit 50 stores movement conditions corresponding to the respective plurality of types of work attachments 9. Each of the movement conditions is a condition according to which the attachment mount 40, which has attached thereto a work attachment 9 (A1 to A20), moves along a path (first path, second path). The movement conditions are each associated with the operation state of the work manual operator 12 (work operating lever 120) and stored in the storing unit 50. In the present example embodiment, the operation state of the work manual operator 12 includes the direction and the amount (angle) of pivoting of the work operating lever 120.

In the present example embodiment, the movement conditions stored in the storing unit 50 are as follows. The storing unit 50 stores therein ascending/descending conditions (movement conditions (Va1 to Va20) for the movement along the up-down direction between a low position and a high position) for attachment mount 40, and tilting conditions (rotation conditions (Vb1 to Vb20) for the rotation about the second shaft S2) for the attachment mount 40, such that the ascending/descending conditions and the tilting conditions correspond to the respective plurality of work attachments 9 and associated with the operation state of the work manual operator 12 (work operating lever 120). Note that in the present example embodiment, the movement conditions are associated with the operation state of the work manual operator 12 (work operating lever 120) and stored in the storing unit 50. However, for example, the operation state of the work manual operator 12 (for example, the directions of pivoting of the work operating lever 120, and the postures (angles) in each direction) may be stored in the storing unit 50 as data different from the movement conditions. In such a case, the controller 5 may be configured or programmed to, when using a movement condition (when actuating the first hydraulic cylinder(s) 61 and the second hydraulic cylinder(s) 62 which are the actuators 61 and 62 according to the movement condition), associate the operation state of the work manual operator 12 (work operating lever 120) with the movement condition, and actuate the first hydraulic cylinder(s) 61 and/or the second hydraulic cylinder(s) 62 which are the actuators 61 and 62 according to the movement condition associated with the operation state as the work manual operator 12 is operated.

In the present example embodiment, the ascending/descending conditions Va1 to Va20 are each the ascending/descending speed of the attachment mount 40, and the tilting conditions Vb1 to Vb20 are each the rotation speed (tilting speed) of the attachment mount 40 about the second shaft. Note that in FIG. 19, each of the ascending/descending conditions (Va1 to Va20) and the tilting conditions (Vb1 to Vb20) is represented as a single speed (symbol). However, as described earlier, the ascending/descending conditions (Va1 to Va20) and the tilting conditions (Vb1 to Vb29) are associated with the operation state of the work manual operator 12 (work operating lever 120), and therefore, actually, each of them includes speeds for operation state (respective operation statuses) of the work manual operator 12 (for respective angles of pivoting of the work operating lever 120).

The storing unit 50 stores ascending/descending conditions for the attachment mount 40 and the operation state of the work manual operator 12 (operating lever 120) associated with the ascending/descending conditions, and stores tilting conditions for the attachment mount 40 and the operation state of the work manual operator 12 (work operating lever 120) associated with the tilting conditions.

The ascending/descending conditions for the attachment mount 40 differ depending on the total length of the work attachment 9 in the front-rear direction perpendicular to the up-down direction and the lateral direction, and the ascending/descending speeds are set lower for work attachments 9 with longer total lengths in the front-rear direction. The ascending/descending conditions for the attachment mount 40 differ depending on the total length of the work attachment 9 in the front-rear direction perpendicular to the up-down direction and the lateral direction, and the maximum ascending/descending speeds are set lower for work attachments 9 with longer total lengths in the front-rear direction.

The tilting conditions for the attachment mount 40 differ depending on the total length of the work attachment 9 in the front-rear direction perpendicular to the up-down direction and the lateral direction, and the tilting speeds are set lower for work attachments 9 with longer total lengths in the front-rear direction. The tilting conditions for the attachment mount 40 differ depending on the total length of the work attachment 9 in the front-rear direction perpendicular to the up-down direction and the lateral direction, and the maximum tilting speeds are set lower for work attachments 9 with longer total lengths in the front-rear direction.

The ascending/descending conditions for the attachment mount 40 differ depending on the weight (machine weight) of the work attachment 9, and the ascending/descending speeds are set lower for heavier work attachments 9. Note that, in the present example embodiment, since the ascending/descending conditions based on the total length of the work attachments 9 in the front-rear direction and the ascending/descending conditions based on the weight of the work attachments 9 are stored in the storing unit 50 as the ascending/descending conditions for the attachment mount 40, the controller 5 uses one of such two types of ascending/descending conditions. That is, in the case where the two types of ascending/descending conditions are different (in case of conflict), the controller 5 uses the ascending/descending condition with a lower ascending/descending speed.

The tilting conditions for the attachment mount 40 differ depending on the weight (machine weight) of the work attachment 9, and tilting speeds are set lower for heavier work attachments 9. Note that, in the present example embodiment, since the tilting conditions based on the total length of the work attachments 9 in the front-rear direction and the tilting conditions based on the weight of the work attachments 9 are stored in the storing unit 50 as the tilting conditions for the attachment mount 40, the controller 5 uses one of such two types of tilting conditions. That is, in the case where the two tilting conditions are different (in case of conflict), the controller 5 uses the tilting condition with a lower tilting speed.

Furthermore, the storing unit 50 stores sudden-operation conditions Vc1 to Vc20, which are defined for respective work attachments 9 and each of which is a condition for sudden operation in which the operation speed of the work operating lever 120 (the speed at which the work operating lever 120 is pivoted) is higher than a predetermined speed. The sudden-operation conditions Vc1 to Vc20 are set such that ascending/descending speeds are lower than the ascending/descending speeds Va1 to Va20 set as the movement conditions. In the present example embodiment, the sudden-operation conditions Vc1 to Vc20 are set such that tilting speeds are lower than the tilting speeds Vb1 to Vb20 set as the movement conditions. That is, the sudden-operation conditions Vc1 to Vc20 include conditions relating to the raising/lowering of the attachment mount 40 and conditions relating to the tilting of the attachment mount 40 such that they correspond to the operation state of the work manual operator 12. The storing unit 50 stores the sudden-operation conditions Vc1 to Vc20 associated with the sudden operation of the work manual operator 12. Note that each of the sudden-operation conditions (Vc1 to Vc20) may include speeds (ascending/descending speeds, tilting speeds) for operation state (respective operation statuses, respective angles of pivoting of the work operating lever 120) of the work manual operator 12 suddenly operated. However, provided that the ascending/descending conditions Va1 to Va20 and the tilting conditions Vb1 to Vb20 are speeds, the sudden-operation conditions (Vc1 to Vc20) may include the rate of decrease in such speed. In the present example embodiment, the sudden-operation conditions Vc1 to Vc20 are the rates of speed decrease with respect to the ascending/descending conditions (ascending/descending speeds) Va1 to Va20 and the tilting conditions (tilting speeds) Vb1 to Vb20 which are the movement conditions.

As described above, since each of the ascending/descending conditions Va1 to Va20 and the tilting conditions Vb1 to Vb20 include speeds (a plurality of types of speeds) corresponding to the operation state (operation statuses) of the work manual operator 12 (angles of pivoting of the work operating lever 120), the controller 5 (arithmetic and control unit 51), by applying the rate of speed decrease corresponding to the situation of the sudden operation (operation state of the work manual operator 12) to any of the ascending/descending conditions Va1 to Va20 and the tilting conditions Vb1 to Vb20, derives the ascending/descending speed and/or the tilting speed corresponding to the operation state of the work manual operator 12, as the movement condition for the sudden operation.

Furthermore, the storing unit 50 stores with-load movement conditions Vd1 to Vd20 for when a load acts on the work attachment 9 attached to the attachment mount 40.

The with-load movement conditions Vd1 to Vd20 are set such that ascending/descending speeds are lower than the ascending/descending speeds Va1 to Va20 defined as the movement conditions. The with-load movement conditions Vd1 to Vd20 are defined such that ascending/descending speeds are lower than the maximum ascending/descending speeds Va1 to Va20 defined as the movement conditions. In the present example embodiment, the with-load movement conditions Vd1 to Vd20 include conditions corresponding to the ascending/descending conditions and conditions corresponding to the tilting conditions. Accordingly, the with-load movement conditions are defined such that tilting speeds are lower than the tilting speeds Vb1 to Vb20 defined as movement conditions. Furthermore, the with-load movement conditions Vd1 to Vd20 are defined such that the tilting speeds are lower than the maximum tilting speeds Vb1 to Vb20 defined as movement conditions. Note that the with-load movement conditions Vd1 to Vd20 stored in the storing unit 50 may be numerical speeds. However, similar to the sudden-operation conditions, the with-load movement conditions Vd1 to Vd20 may be the rates of speed decrease with respect to the speeds defined as the movement conditions (ascending/descending speeds Va1 to Va20, tilting speeds Vb1 to Vb20).

That is, the with-load movement conditions Vd1 to Vd20 determine the behavior (movement) of the attachment mount 40 when a load occurs. Provided that the behavior (movement) of the attachment mount 40 can be directly or indirectly derived, the content of information stored in the storing unit 50 may be appropriately selected.

In the above description, the ascending/descending conditions Va1 to Va20 are described based on raising/lowering (ascending/descending speed) of the attachment mount 40, and the tilting conditions Vb1 to Vb20 are described based on tilting (tilting speed) of the attachment mount 40. However, in the present example embodiment, the ascending/descending conditions Va1 to Va20 are stored in the storing unit 50 as the extending/retracting speeds of the first hydraulic cylinder(s) 61 proportional to (corresponding to) the ascending/descending speeds of the attachment mount 40, and the tilting conditions Vb1 to Vb20 are stored in the storing unit 50 as the extending/retracting speeds of the second hydraulic cylinder(s) 62 proportional to (corresponding to) the tilting speeds of the attachment mount 40.

That is, in the present example embodiment, the ascending/descending speeds as the ascending/descending conditions Va1 to Va20 stored in the storing unit 50 are not stored as-is, and are stored in the storing unit 50 as (converted in) the extending/retracting speeds of the first hydraulic cylinder(s) 61 corresponding to the ascending/descending speeds, in consideration of controlling the ascending/descending (ascending/descending speed). Also, the tilting conditions Vb1 to Vb20 are not stored as-is in the storing unit 50, and are stored in the storing unit 50 as (converted in) the extending/retracting speeds of the second hydraulic cylinder(s) 62 corresponding to the tilting speeds.

Specifically, in the present example embodiment, the attachment mount 40 (work attachment 9) is raised or lowered (is caused to ascend or descend) by the rotation of the arms 43, and the arms 43 are rotated by the extension or retraction of the first hydraulic cylinders 61, and therefore the extending/retracting speeds of the first hydraulic cylinders 61 are stored in the storing unit 50 as the ascending/descending conditions (ascending/descending speeds) Va1 to Va20 of the attachment mount 40. Note that, since the extending/retracting speed of the first hydraulic cylinders 61 and the extending/retracting speed of the second hydraulic cylinders 62 are determined by the flow of hydraulic fluid therein and therefrom, the storing unit 50 may store the flow rate of hydraulic fluid for the first hydraulic cylinders 61 and the second hydraulic cylinders 62 as an ascending/descending condition and/or as a tilting condition, and the storing unit 50 may store the degree of opening of a fluid passage corresponding to the flow rate of hydraulic fluid flowing into/from the cylinders.

In the present example embodiment, the ascending/descending conditions Va1 to Va20, which are movement conditions for the attachment mount 40, each include the maximum extending/retracting speed of the first hydraulic cylinder 61. Specifically, the ascending/descending conditions Va1 to Va20 stored in the storing unit 50 each include the maximum extending/retracting speed of the first hydraulic cylinder(s) 61 corresponding to the maximum ascending/descending speed of the attachment mount 40 associated with the operation state in which the operation amount of the work manual operator 12 (work operating lever 120) is maximum.

The ascending/descending conditions Va1 to Va20 stored in the storing unit 50 each include ascending/descending speeds (extending/retracting speeds of the first hydraulic cylinder 61) corresponding to operation state (operation statuses, operation amounts) of the work manual operator 12 (work operating lever 120) defined based on the maximum ascending/descending speed (maximum extending/retracting speed of the first hydraulic cylinders 61).

Specifically, as the ascending/descending conditions Va1 to Va20 for the attachment mount 40, ascending/descending speeds corresponding to changes in operation state (corresponding to operation amounts) of the work manual operator 12 are each defined based on the corresponding maximum ascending/descending speed such that (i) the maximum ascending/descending speed is the maximum ascending/descending speed of the attachment mount 40 achieved when the operation amount of the work manual operator 12 (work operating lever 120) is maximum and (ii) zero ascending/descending speed is the ascending/descending speed of the attachment mount 40 achieved when the operation amount of the work manual operator 12 (work operating lever 120) is zero.

As described above, in the present example embodiment, since the ascending/descending speed of the attachment mount 40 corresponds to the extending/retracting speed of the first hydraulic cylinders 61, the extending/retracting speeds of the first hydraulic cylinders 61 are stored in the storing unit 50 as the ascending/descending speeds Va1 to Va20 of the attachment mount 40.

In the present example embodiment, with regard to the ascending/descending conditions Va1 to Va20 of the plurality of types of work attachments 9 stored in the storing unit 50, assuming that the ascending/descending conditions Va1 to Va20 differ depending on the total length of the work attachment 9 in the front-rear direction perpendicular to the up-down direction and the lateral direction, the ascending/descending speeds are set lower for work attachments 9 with longer total lengths in the front-rear direction. More specifically, with regard to the ascending/descending conditions Va1 to Va20 of the plurality of types of work attachments 9 stored in the storing unit 50, assuming that the ascending/descending conditions Va1 to Va20 differ depending on the total length of the work attachment 9 in the front-rear direction perpendicular to the up-down direction and the lateral direction, the maximum ascending/descending speeds are set lower for work attachments 9 with longer total lengths in the front-rear direction.

Note that, in the present example embodiment, the ascending/descending speeds of the attachment mount 40 (extending/retracting speeds of the first hydraulic cylinders 61) are stored as the ascending/descending conditions Va1 to Va20 of the attachment mount 40 in the storing unit 50. However, the ascending/descending conditions Va1 to Va20 of the attachment mount 40 may each be a change in extending/retracting speed per unit time or per unit distance of the first hydraulic cylinders 61, preferably a change in extending/retracting speed per unit time of the first hydraulic cylinders 61, i.e., the acceleration at the time of extension/retraction of the first hydraulic cylinders 61. Assuming that the rotation speed (angular velocity) of the arms 43 can be measured, the storing unit 50 may store the angular velocity of the arms 43 as the ascending/descending condition for the attachment mount, instead of the extending/retracting speed of the first hydraulic cylinders 61.

Since the attachment mount 40 (work attachment 9) is tilted by the rotation about the second shaft S2, and the attachment mount 40 (work attachment 9) is rotated by the extension or retraction of the second hydraulic cylinders 62, the extending/retracting speeds of the second hydraulic cylinders 62 are stored in the storing unit 50 as the tilting conditions Vb1 to Vb20 for the attachment mount 40.

In the present example embodiment, the tilting conditions Vb1 to Vb20 for the attachment mount 40 each include the maximum extending/retracting speed of the second hydraulic cylinders 62. Specifically, tilting conditions stored in the storing unit 50 each include the maximum extending/retracting speed of the second hydraulic cylinders 62 corresponding to the maximum tilting speed of the attachment mount 40 associated with the operation state in which the operation amount of the work manual operator 12 (work operating lever 120) is maximum. Furthermore, the tilting conditions stored in the storing unit 50 each include tilting speeds (extending/retracting speeds of the second hydraulic cylinder 62) corresponding to operation statues (operation amounts) of the work manual operator 12 (work operating lever 120) defined based on the maximum tilting speed (maximum extending/retracting speed of the second hydraulic cylinders 62).

Specifically, as the tilting conditions for the attachment mount 40, tilting speeds corresponding to changes in operation state (corresponding to operation amounts) of the work manual operator 12 are each defined based on the corresponding maximum tilting speed such that (i) the maximum titling speed is the maximum tilting speed of the attachment mount 40 achieved when the operation amount of the work manual operator 12 (work operating lever 120) is maximum and (ii) zero tilting speed is the tilting speed of the attachment mount 40 achieved when the operation amount of the work manual operator 12 (work operating lever 120) is zero.

As described above, in the present example embodiment, since the tilting speed of the attachment mount 40 corresponds to the extending/retracting speed of the second hydraulic cylinders 62, the extending/retracting speeds of the second hydraulic cylinders 62 are stored in the storing unit 50 as the tilting speeds Vb1 to Vb20.

In the present example embodiment, with regard to the tilting conditions Vb1 to Vb20 of the plurality of types of work attachments 9 stored in the storing unit 50, assuming that the tilting conditions Vb1 to Vb20 differ depending on the total length of the work attachment 9 in the front-rear direction perpendicular to the up-down direction and the lateral direction, the tilting speeds are set lower for work attachments 9 with longer total lengths in the front-rear direction. More specifically, with regard to the tilting conditions Vb1 to Vb20 of the plurality of types of work attachments 9 stored in the storing unit 50, assuming that the tilting conditions Vb1 to Vb20 differ depending on the total length of the work attachment 9 in the front-rear direction perpendicular to the up-down direction and the lateral direction, the maximum tilting speeds are set lower for work attachments 9 with longer total lengths in the front-rear direction.

Note that, in the present example embodiment, the tilting speeds of the attachment mount 40 (extending/retracting speeds of the second hydraulic cylinders 62) are stored as the tilting conditions Vb1 to Vb20 of the attachment mount 40 in the storing unit 50. However, the tilting conditions Vb1 to Vb20 of the attachment mount 40 may each be a change in extending/retracting speed per unit time or per unit distance of the second hydraulic cylinders 62, preferably a change in extending/retracting speed per unit time of the second hydraulic cylinders 62, i.e., the acceleration at the time of extension/retraction of the second hydraulic cylinders 62. The storing unit 50 may store the tilting conditions Vb1 to Vb20 as, instead of the extending/retracting speeds of the second hydraulic cylinders 62, rotation speeds (angular velocities) of the arms 43 corresponding to the extending/retracting speeds (tilting speeds).

The storing unit 50 stores travel conditions Ve1 to Ve20 defined depending on loads acting on the attachment mount 40. In the present example embodiment, the travel conditions are associated with the operation state of the travel manual operator 11 (travel operating lever 110) and stored in the storing unit 50.

Since the working machine 1 of the present example embodiment is configured to perform a straight travel in which the machine body 2 travels straight, and a pivot turn travel, the travel conditions each include a first travel condition for straight travel and a second travel condition for pivot turn travel that is different from the first travel condition. The second travel condition is defined such that a speed change of the second travel condition is smaller than that of the first travel condition. The storing unit 50 also stores travel conditions for when no work attachment 9 is attached to the attachment mount 40. Such travel conditions are each defined such that a speed change of this travel condition is smaller than that of a travel condition for when a work attachment 9 is attached to the attachment mount 40 (than travel conditions defined for respective work attachments 9 (A1 to A20)).

In the present example embodiment, the plurality of types of work attachments 9 (A1 to A20) are recorded in the storing unit 50, and, using each of the plurality of types of work attachments 9 (A1 to A20) (the weight of each of the plurality of types of work attachments 9) as a load acting on the attachment mount 40, the travel conditions Ve1 to Ve20 are associated with the respective plurality of types of work attachments 9 and stored in the storing unit 50. Specifically, the machine weight of each of the work attachments 9 is measured mathematically at the design phase or obtained by actually measuring the weight of the finished product, and the machine weight is a load that would act on the attachment mount 40. Therefore, the travel conditions Ve1 to Ve20 corresponding to the machine weights are defined, and the plurality of types of work attachments 9 and their corresponding travel conditions Ve1 to Ve20 are associated with each other and stored in the storing unit 50, so that the storing unit 50 stores travel conditions defined depending on the load acting on the attachment mount 40.

In the present example embodiment, each of the travel conditions Ve1 to Ve20 stored in the storing unit 50 is a change in travel speed per unit time, i.e., acceleration during travel.

In the present example embodiment, assuming that the traveling devices 3 are configured to be switchable between a first speed stage which is a lower speed stage and a second speed stage which is a higher speed stage than the first speed stage, during-speed-change travel conditions Vf1 to Vf20 for when the first speed stage is changed to the second speed stage are also defined depending on the load acting on the attachment mount 40 and stored in the storing unit 50.

Furthermore, in the present example embodiment, the storing unit 50 stores sudden-operation travel conditions Vg1 to Vg20 which are travel conditions for a sudden operation in which the travel manual operator 11 (travel operating lever 110) is operated faster than a predetermined speed and which are defined depending on the work attachment 9 attached to the attachment mount 40 (defined for the respective plurality of types of work attachments 9). The storing unit 50 also stores an operation speed (the predetermined speed) based on which whether the operation of the travel manual operator 11 (travel operating lever 110) is a sudden operation or not is determined. It is noted here that the sudden-operation travel conditions Vg1 to Vg20 are each defined such that a speed change thereof is smaller than that of the travel conditions for normal operations other than the sudden operation. Note that the operation state of the travel manual operator 11 includes the direction and the amount (angle) of pivoting of the travel operating lever 110.

Referring back to FIG. 18, the input 52 and the output 53 are each a so-called interface. The input 52 is connected to electric device(s) which output(s) electric signals as information. In contrast, the output 53 is connected to electric device(s) which receive(s) electric signals as information.

Specifically, the input 52 is connected to devices relating to the travel-related hydraulic circuit 6A such as a brake pedal 86, a speed-change switch 87, and/or a pressure sensor S. The input 52 is connected to devices relating to the work-related hydraulic circuit 6B such as an AUX switch 85, pressure detectors 79*a*1, 79*a*2, 79*b*1, 79*b*2, 79*c*1, 79*c*2, pilot pressure detectors 83*a*, 83*b*, 83*c*, 83*d*, Hall sensors 111, 121, an identification information reader 15, a camera C, a rotation sensor, and/or a posture detector. In contrast, the output 53 is connected to devices relating to the travel-related hydraulic circuit 6A such as a speed-change solenoid switching valve 71 (solenoid) and/or a braking solenoid switching valve 73 (solenoid). The output 53 is also connected to devices relating to the work-related hydraulic circuit 6B such as first solenoid valves 84*a* and 84*b*, second solenoid valves 88*a* and 88*b*, and/or an LS system 89. The output 53 is also connected to control line(s) CL1 which is/are connectable to attachment-side control line(s) CL2 connected to the solenoid(s) 97*c* of the control valve 97 of the work attachment 9 (type-III drive work attachment 9Bc). Note that, although the control line(s) CL1 connected to the controller 5 (output 53) may be connectable to the control line(s) CL2 of a specific type-III drive work attachment 9Bc, the control line(s) CL1 is/are connectable to (attachable to and detachable from) the control line(s) CL2 of each type-III drive work attachment 9Bc in the present example embodiment.

The monitor M of the present example embodiment includes a touchscreen monitor M, which is operable to receive input of information. That is, in the present example embodiment, the monitor M is also used as the attachment selector 55. Accordingly, the monitor M is connected to the input 52 and the output 53 to transmit and receive information to and from the controller 5 (arithmetic and control unit 51).

The monitor M, when functioning as the attachment selector 55, displays a list of work attachment(s) 9 attachable to the attachment mount 40 (hereinafter referred to as "attachment list"). Accordingly, in the present example embodiment, the storing unit 50 (second storing unit 501) stores an attachment list in which types (model names) of work attachments 9 and pictograms (icons) representing the work attachments 9 (A1 to A20) are associated with each other. With this, the attachment list is stored in the storing unit 50 (second storing unit 501) such that the types of work attachments 9 and pictograms (icons) representing the work attachments 9 are associated with each other and are also associated with movement conditions (ascending/descending conditions, tilting conditions) and travel conditions corresponding to the work attachments 9 (A1 to A20).

The attachment list displayed on the monitor M includes icons which include pictograms representing the work attachments 9 (A1 to A20) as illustrated in FIG. 19, and which can be selected by touching them. That is, the storing unit 50 stores the pictograms (symbols) to be displayed on the monitor M such that the pictograms are associated with the respective a plurality of types of work attachments 9 (A1 to A20) (associated with respective pieces of identification information). Note that, in FIG. 19, the attachment list includes, for example, the pictograms of a bucket A1, a pallet fork A2, a ripper A3, a snow pusher A4, a dozer blade A5, a crusher A6, a grapple A7, a skid grader A8, a spreader A9, a sweeper A10, a skid cutter A11, a breaker A12, an earth auger A13, a rotary tiller A14, an angle broom A15, a cold planer A16, a stump grinder A17, a snow blower A18, a trencher A19, and a mower A20.

As described earlier, the display includes a touchscreen monitor M, and therefore, when the user selects (touches) the icon of the work attachment 9 to be used from the attachment list displayed on the monitor M, the controller 5 (arithmetic and control unit 51) recognizes the type of the work attachment 9 to be used (selected). The controller 5 (arithmetic and control unit 51) is configured or programmed to, if the recognized type is a work attachment 9 of a type that performs travel and work, retrieve (read), from the storing unit 50 (second storing unit 501), the movement condition and travel condition for the work attachment 9 corresponding to the icon selected.

The camera C is positioned such that at least a portion of the work attachment 9 attached to the attachment mount 40 lies within the angle of view thereof. In the present example embodiment, the camera C is attached to a front portion of the roof of the cabin 22 (see FIGS. 1 to 8). The camera C has its monitoring direction and monitoring range set such that, in the case of a work attachment 9 to perform work during travel (such as the angle broom A15 or the snow blower A18) and perform work on an area including a shoulder of a road, as illustrated in FIG. 17, at least a portion of the shoulder of the road and at least a portion of the work attachment 9 lie within the angle of view. The camera C includes a communication terminal and an image output terminal, and as illustrated in FIG. 18, the communication terminal is connected to the controller 5 (input 52), and the image output terminal is connected to the monitor M. With this, the camera C starts and stops capturing images in accordance with an instruction from the controller 5, and transmits captured image data to the monitor M during image capturing. Note that, although the camera C in the present example embodiment is a fixed-point camera positioned such that at least a portion of a shoulder of a road and at least a portion of the work attachment 9 lie within the angle of view, the camera C may be a 360-degree camera or an around-view camera system configured such that a plurality of cameras C capture images of the surrounding area of the working machine 1 and the images are displayed on the monitor M.

The identification information reader 15 reads unique identification information from a tag T attached to the work attachment 9. Specifically, the identification information reader 15 reads the identification information assigned to the tag T attached to the work attachment 9 by contacting the tag T or without contacting the tag T. Accordingly, the identification information reader 15 is positioned such that the identification information reader 15 can read the identification information from the tag T attached to the work attachment 9. In the present example embodiment, the identification information reader 15 includes a receiver to receive wireless signals compliant with a near field communication standard. Specifically, the receiver 15 includes a beacon scanner to receive wireless signals (beacon signals) compliant with Bluetooth (registered trademark) Low Energy, which is a near field communication standard. The receiver (beacon scanner) 15 also measures the received signal strength indicator (RSSI) (received signal strength) of the received wireless signals. Since the identification information reader 15 in the present example embodiment is a receiver (beacon scanner), the identification information reader 15 may be attached to the machine body 2, provided that the identification information reader 15 is positioned such that the identification information reader 15 can communicate with the tag T. Note, however, that the identification information reader 15 is attached to the attachment mount 40 in FIGS. 1 to 8, for convenience.

Accordingly, the controller 5 (arithmetic and control unit 51) recognizes the type of the work attachment 9 for use (selected work attachment 9) based on the identification information read by the identification information reader 15. If the recognized type is a work attachment 9 of a type that performs work during travel, the controller 5 retrieves (reads), from the storing unit 50 (second storing unit 501), the movement condition and travel condition for the work attachment 9 corresponding to the selected icon. Note that, if a work attachment 9 is selected from the attachment list displayed on the monitor M, the controller 5 regards the work attachment 9 selected is the work attachment 9 intended by the user, and prioritizes the recognition of the selected work attachment 9 over the recognition of the work attachment 9 based on the identification information read by the identification information reader 15.

As illustrated in FIGS. 9 and 10, the hydraulic circuit 6 in the present example embodiment includes a travel-related hydraulic circuit (travel hydraulic circuit) 6A to drive the traveling devices 3 (travel motors 60) and a work-related hydraulic circuit (work hydraulic circuit) 6B to drive the arms 43 and the attachment mount 40. That is, the hydraulic circuit 6 of the working machine 1 includes a hydraulic circuit 6A to supply hydraulic fluid to the travel motors (hydraulic motors) 61 which are hydraulic actuators (such a circuit is hereinafter referred to as "travel-related hydraulic circuit 6A"). The hydraulic circuit 6 of the working machine 1 also includes a hydraulic circuit 6B to supply hydraulic fluid to the hydraulic cylinders 61 and 62 (first hydraulic cylinders 61 and second hydraulic cylinders 62) which are hydraulic actuators (such a circuit is hereinafter referred to as "work-related hydraulic circuit 6B"). Assuming the above configuration, the AUX ports 75*a*, 75*b*, and 75*c* are included in the work-related hydraulic circuit 6B.

The following description first discusses the travel-related hydraulic circuit 6A. As illustrated in FIG. 9, the travel-related hydraulic circuit 6A includes a hydraulic pump 63 to deliver hydraulic fluid by being driven by the prime mover 10 (such a pump is hereinafter referred to as a first hydraulic pump), and hydrostatic stepless transmission(s) (hereinafter referred to as "HST") 64 to be hydraulically controlled by the pressure of hydraulic fluid delivered by the first hydraulic pump 63 to drive the driving wheels 31 of the traveling devices 3. The travel-related hydraulic circuit 6A also includes a hydraulic fluid tank 65 to store hydraulic fluid.

The first hydraulic pump 63 is a fixed displacement pump. The first hydraulic pump 63 includes an input shaft. The input shaft of the first hydraulic pump 63 is connected to the output shaft of the prime mover 10. With this, the first hydraulic pump 63 rotates in synchronization with the rotation output from the prime mover 10. The first hydraulic pump 63, upon driven by the prime mover 10, sucks hydraulic fluid from the hydraulic fluid tank 65 and delivers the hydraulic fluid to the downstream portion.

A pair of the HSTs 64 are provided such that the HSTs 64 correspond to the left and right pair of traveling devices 3. Each of the pair of HSTs 64 includes a hydraulic pump 66 (hereinafter referred to as "second hydraulic pump"), a travel motor 60 which is a hydraulic motor 60, and a pair of fluid passages R1*a* and R1*b* provided between the second hydraulic pump 66 and the travel motor 60. Specifically, the travel-related hydraulic circuit 6A includes a first drive DR to drive one of the pair of traveling devices 3 (right traveling device 3), and a second drive DL to drive the other of the pair of traveling devices 3 (left traveling device 3). The first drive DR and the second drive DL each include an HST 64, a second hydraulic pump 66, a hydraulic motor 60 which is a travel motor 60, and a pair of fluid passages R1*a* and R1*b*. Note that, since the first drive DR and the second drive DL have the same configuration, in the following description, the first drive DR and the second drive DL are both referred to as "drive D", and that the "drive D" refers to either the first drive DR or the second drive DL. That is, the following description can be used as the description of either the first drive DR or the second drive DL by reading the "drive D" as "first drive DR" or "second drive DL", unless otherwise noted.

The second hydraulic pump 66 of the HST 64 of the drive D includes an input shaft. The input shaft of the second hydraulic pump 66 is connected to the output shaft of the prime mover 10. In the present example embodiment, the output from the prime mover 10 is inputted into the first hydraulic pump 63 and the second hydraulic pump 66. That is, the prime mover 10 is used to drive both the first hydraulic pump 63 and the second hydraulic pump 66. Accordingly, the output shaft of the prime mover 10, the input shaft of the first hydraulic pump 63, and the input shaft of the second hydraulic pump 66 are coaxially connected together in a line.

With this, the second hydraulic pump 66 of the drive D rotates in synchronization with the rotation output from the prime mover 10. That is, the first hydraulic pump 63 and the second hydraulic pump 66 each rotate in synchronization with the rotation output from a single prime mover 10. Note that a third hydraulic pump 74 (described later) of the work-related hydraulic circuit 6B also receives output from the same prime mover 10. Since the third hydraulic pump 74 also includes an output shaft, the output shaft of the third hydraulic pump 74 is also connected to the output shaft of the prime mover 10, the input shaft of the first hydraulic pump 63, and the input shaft of the second hydraulic pump 66 coaxially in a line (in series).

The second hydraulic pump 66 in the HST 64 of the drive D is a variable displacement pump including a movable swash plate 66*a*. Accordingly, the second hydraulic pump 66 includes a pair of pressure receivers 66*b* and 66*c*. The pair of pressure receivers 66*b* and 66*c* receive pilot hydraulic fluid. With this, the tilting direction and angle of the movable swash plate 66*a* of the second hydraulic pump 66 are controlled.

In the drive D, the second hydraulic pump 66, upon driven by the prime mover 10, sucks hydraulic fluid from the hydraulic fluid tank 65 and delivers it to the downstream portion. In the present example embodiment, the second hydraulic pump 66 delivers hydraulic fluid toward the HST 64 which is located downward. With this, a portion of the hydraulic fluid delivered by the second hydraulic pump 66 is supplied into the HST 64.

In the HST 64 of the drive D, the pair of fluid passages R1*a* and R1*b* connecting the second hydraulic pump 66 and the travel motor 60 are provided with respective pressure sensors S to detect (measure) the pressure of hydraulic fluid supplied from the second hydraulic pump 66 to the travel motor 60. The pressure sensors S are electrically connected to the controller 5, and output, to the controller 5, the value of the detected pressure of hydraulic fluid as an electric signal upon each detection.

In the present example embodiment, the first hydraulic pump 63 delivers hydraulic fluid toward the pressure receivers 66*b* and 66*c* of the second hydraulic pump 66 via pump control valves 67 and shuttle valves 68 operably connected to the travel operating lever 110. With this, the pressure of hydraulic fluid from the first hydraulic pump 63 is applied to the pressure receiver(s) 66*b* and/or 66*c* of the second hydraulic pump 66 as pilot hydraulic fluid to control the movable swash plate 66*a* of the second hydraulic pump 66. More specifically, in the present example embodiment, the travel-related hydraulic circuit 6A includes a pilot fluid passage which connects the pair of pressure receivers 66*b* and 66*c* of the second hydraulic pump 66 and the shuttle valves 68 and which allows pilot hydraulic fluid from the pump control valves 67 operably connected to the travel operating lever 110 to be supplied to the pressure receivers 66*b* and 66*c* of the second hydraulic pump 66 define the shuttle valves 68, and pilot pressure adjusting valve(s) 82 which is/are connected to an intermediate portion of the pilot fluid passage and which adjust(s) the pressure of pilot hydraulic fluid supplied to the pressure receivers 66*b* and 66*c* of the second hydraulic pump 66.

The pilot pressure adjusting valve 82 is a solenoid proportional valve and is electrically connected to the controller 5. That is, the pilot pressure adjusting valve 82 adjusts the pressure of pilot hydraulic fluid supplied from the shuttle valves 68 in accordance with an instruction from the controller 5.

Specifically, the first hydraulic pump 63 has the defined maximum delivery pressure and minimum delivery pressure, and therefore the maximum value and the minimum value of pilot pressure correspond to the maximum delivery pressure and the minimum delivery pressure of the first hydraulic pump 63. In the present example embodiment, the pressure of pilot hydraulic fluid under normal conditions is set at a pressure (hereinafter referred to as "normal set pressure") between the maximum pressure and the minimum pressure, and the pilot pressure adjusting valve 82 is operable to increase or reduce the reference normal set pressure. That is, the controller 5 controls the pilot pressure adjusting valve 82 to increase or reduce the normal set pressure.

Accordingly, when the travel operating lever 110 of the travel manual operator 11 is fully pivoted, pilot hydraulic fluid at the normal set pressure flows through the pilot fluid passage, and, as the extent to which the travel operating lever 110 is pivoted decreases, pilot hydraulic fluid having a lower pressure than the normal set pressure is supplied to the second hydraulic pump 66. Accordingly, the second hydraulic pump 66 delivers hydraulic fluid such that the delivery flow rate of the hydraulic fluid can be further increased, even if the travel operating lever 110 of the travel manual operator 11 is fully pivoted.

Accordingly, also the travel motor 60 (hydraulic motor 60), which receives hydraulic fluid from the second hydraulic pump 66, is operable to rotate such that the driving/rotation speed can be further increased (rotation speed can be increased) even if the travel operating lever 110 of the travel manual operator 11 is fully pivoted.

The controller 5 drives the second hydraulic pump 66 according to the travel condition. Specifically, the controller 5 controls the pilot pressure adjusting valve(s) 82 to drive the second hydraulic pump 66 according to the content corresponding to the travel condition. In the present example embodiment, as described earlier, the travel condition is defined depending on the work attachment 9 (A1 to A20) which is a load acting on the attachment mount 40, and therefore the controller 5 defines a travel condition depending on the work attachment 9 (A1 to A20) attached to the attachment mount 40 and controls the pilot pressure adjusting valve(s) 82 such that the manner in which travel is performed matches the travel condition.

In the present example embodiment, the travel operating lever 110 is pivotable forward, rearward, leftward, an rightward as described earlier, and has a neutral position N which is the midpoint between the leftmost and rightmost positions and the midpoint between the foremost and rearmost positions. Accordingly, when the travel operating lever 110 is in the neutral position N, the movable swash plate 66*a* of the second hydraulic pump 66 is in the neutral position such that the second hydraulic pump 66 does not deliver hydraulic fluid. With this, the travel motor 60 is maintained in its stop state. With this, the pair of traveling devices 3 both stop, and the working machine 1 (machine body 2) stops.

In contrast, when the travel operating lever 110 is pivoted forward, rearward, leftward, or rightward, the direction and angle of tilt of the movable swash plate 66*a* of the second hydraulic pump 66 are determined by the direction and angle (extent) of pivoting of the travel operating lever 110 from the neutral position N, and the driving/stopping the travel motor 60 is determined and also the direction and speed of driving/rotation of the travel motor 60 are determined. With this, the direction and speed of travel (turning) of the working machine 1 (machine body 2) are controlled according to the operation of the travel operating lever 110 (according to the direction in which the travel operating lever 110 is pivoted and the extent to which the travel operating lever 110 is pivoted).

The travel motor 60 of the drive D is a variable displacement motor including a movable swash plate 60*a*. The movable swash plate 60*a* has a high-speed tilting state in which the movable swash plate 60*a* is tilted at a small angle (small displacement position) and a low-speed tilting state in which the movable swash plate 60*a* is tilted at a large angle (large displacement position). The travel motor 60 of the drive D includes a swash plate control actuator 69 operably connected to the movable swash plate 60*a*. The swash plate control actuator 69 of the travel motor 60 is fluidly connected to the switching valve 70.

The switching valve 70 has a hydraulic fluid supplying state in which hydraulic fluid is allowed to be supplied to the swash plate control actuator 69, and a hydraulic fluid discharging state in which hydraulic fluid is allowed to be discharged from the swash plate control actuator 69. Accordingly, the tilting states of the movable swash plate 60*a* of the travel motor 60 are switched according to the switching of the states of the switching valve 70.

The switching valve 70 enters the hydraulic fluid supplying state upon receipt of the pressure (hydraulic pressure) of pilot hydraulic fluid, and returns to the hydraulic fluid discharging state when stopped receiving the pilot hydraulic fluid. The hydraulic fluid from the first hydraulic pump 63 is supplied, as pilot hydraulic fluid for the switching valve 70, to the switching valve 70 via the speed-change solenoid switching valve 71.

The speed-change solenoid switching valve 71 has an open state in which the passage of hydraulic fluid is opened and a closed state in which the passage of hydraulic fluid is closed. The speed-change solenoid switching valve 71 includes a solenoid 71*a* and a spring, and is normally closed by the biasing force of the spring. The speed-change solenoid switching valve 71, when in the closed state, blocks the hydraulic fluid from the first hydraulic pump 63 to the switching valve 70, bringing the switching valve 70 into the hydraulic fluid discharging state.

The solenoid 71*a* of the speed-change solenoid switching valve 71 is electrically connected to the controller 5. With this, the speed-change solenoid switching valve 71, upon receipt of a control signal from the controller 5, enters the open state because the solenoid 71*a* is energized, and allows the hydraulic fluid from the first hydraulic pump 63 to flow out as pilot hydraulic fluid for the switching valve 70. With this, the switching valve 70 enters the hydraulic fluid supplying state.

The working machine 1 includes the speed-change switch 87 which is electrically connected to the controller 5 and which has a high-speed mode in which the traveling devices 3 are caused to travel at high speed and a low-speed mode in which the traveling devices 3 are caused to travel at low speed. Note that the low-speed mode refers to a mode in which the travel speed of the machine body 2 (working machine 1) is lower than in the high-speed mode, and the machine body 2 (working machine 1) is caused to travel at a reference speed lower than a predetermined reference speed.

When the speed-change switch 87 is in the high-speed mode, the controller 5 controls the speed-change solenoid switching valve 71 to be in the closed state, and the switching valve 70 is brought into the hydraulic fluid discharging state. Accordingly, the movable swash plate 60*a* of the travel motor 60 is in the high-speed tilting position, and the travel motor 60 rotates at high speed. In contrast, when the speed-change switch 87 is in the low-speed mode, the controller 5 controls the speed-change solenoid switching valve 71 to be in the open state, and the switching valve 70 is brought into the hydraulic fluid supplying state. Accordingly, the movable swash plate 60*a* of the travel motor 60 enters the low-speed tilting position, and the travel motor 60 rotates at low speed.

In the present example embodiment, the travel condition differs depending on the load on the attachment mount 40. Accordingly, the high-speed mode and the low-speed mode are switched within the range of the travel condition defined based on the load on the attachment mount 40 (weight of the work attachment 9 (A1 to A20) attached).

In the present example embodiment, the travel motor 60 is provided with a braking actuator 72 which is a hydraulic actuator. The braking actuator 72, upon receipt of hydraulic fluid, brakes the travel motor 60. The hydraulic fluid from the first hydraulic pump 63 is supplied to the braking actuator 72 of the travel motor 60 via the braking solenoid switching valve 73.

The braking solenoid switching valve 73 has an open state in which the passage of hydraulic fluid is opened and a closed state in which the passage of hydraulic is closed. The braking solenoid switching valve 73 includes a solenoid 73*a* and a spring, and is normally closed by the biasing force of the spring. The braking solenoid switching valve 73, when in the closed state, blocks the hydraulic fluid from the first hydraulic pump 63 from being supplied to the braking actuator 72 of the travel motor 60.

The solenoid 73*a* of the braking solenoid switching valve 73 is electrically connected to the controller 5. The braking solenoid switching valve 73, upon receipt of a control signal from the controller 5, enters the open state because the solenoid 73*a* is energized, and allows hydraulic fluid from the first hydraulic pump 63 to be supplied to the braking actuator 72. With this, the travel motor 60 is braked.

The working machine 1 includes the brake pedal 86 which is electrically connected to the controller 5 and which turns on and off the brake on the travel motor 60. When the brake pedal 86 is not depressed by a user, the controller 5 keeps the braking solenoid switching valve 73 in the closed state. Therefore, the travel motor 60 is not braked. On the contrary, when the brake pedal 86 is depressed by a user, the controller 5 brings the braking solenoid switching valve 73 into the open state. With this, the travel motor 60 is braked.

The following description discusses the work-related hydraulic circuit 6B (system). As illustrated in FIG. 10, the work-related hydraulic circuit 6B includes a third hydraulic pump 74 to be driven by the prime mover 10 to deliver hydraulic fluid and to supply hydraulic fluid to the hydraulic actuators 61 and 62 (first hydraulic cylinders 61, second hydraulic cylinders 62) of the working machine 1 and hydraulic actuator(s) 95, 96 of the work attachment 9 (9B)). The work-related hydraulic circuit 6B also includes the hydraulic fluid tank 65 to store hydraulic fluid. The hydraulic fluid tank 65 is used by both the travel-related hydraulic circuit 6A and the work-related hydraulic circuit 6B. In the present example embodiment, the work-related hydraulic circuit 6B includes a pump controller (so-called load sensing system (LS system)) 89 to control the delivery flow rate of the third hydraulic pump 74 according to work.

The third hydraulic pump 74 is a variable displacement pump which can change the delivery flow rate. The third hydraulic pump 74 includes an input shaft. The input shaft of the third hydraulic pump 74 is connected to the output shaft of the prime mover 10.

In the present example embodiment, the input shaft of the third hydraulic pump 74 is coaxially connected to the input shaft of the first hydraulic pump 63 and the input shafts of the second hydraulic pumps 66 of the travel-related hydraulic circuit 6A in a line (in series) (see FIGS. 9 and 10). That is, in the hydraulic circuit 6 of the present example embodiment, the hydraulic pumps (first hydraulic pump 63, second hydraulic pump 66, third hydraulic pump 74) are driven by a single prime mover 10. With this, the third hydraulic pump 74 rotates in synchronization with the rotation output from the prime mover 10. The third hydraulic pump, upon driven by the prime mover 10, sucks hydraulic fluid form the hydraulic fluid tank 65 and delivers it to the downstream portion.

As illustrated in FIG. 10, the working machine 1 includes fluid passages (hereinafter referred to as "first supply/discharge passages") R6*a* and Rob connected to the first hydraulic cylinders 61 and allow hydraulic fluid to be supplied and discharged from the first hydraulic cylinders 61, and a control valve (control valve) 76 including a spool movable in a direction perpendicular to the first supply/discharge passages R6*a* and R6*b* and operable to increase the flow rate of hydraulic fluid in the first supply/discharge passages R6*a* and R6*b* as the spool moves to a greater extent. The working machine 1 also includes fluid passages (hereinafter referred to as "second supply/discharge passages") R7*a* and R7*b* connected to the second hydraulic cylinders 62 and allow hydraulic fluid to be supplied and discharged from the second hydraulic cylinders 62, and a control valve (control valve) 77 including a spool movable in a direction perpendicular to the second supply/discharge passages R7*a* and R7*b* and operable to increase the flow rate of hydraulic fluid in the second supply/discharge passages R7*a* and R7*b* as the spool moves to a greater extent.

Furthermore, the working machine 1 includes AUX ports 75*a*, 75*b*, and 75*c* which are fluidly connectable to the fluid passages 90 of the work attachment 9 (9B) and which allow hydraulic fluid to flow therethrough when in connection with the fluid passages 90 of the work attachment 9. That is, the working machine 1 includes a plurality of AUX ports 75*a*, 75*b*, and 75*c* to attach and detach thereto and therefrom pipes connected to the hydraulic actuators 95 and/or 96 of the work attachment 9 (9B).

More specifically, the work-related hydraulic circuit 6B includes a control valve (hereinafter referred to as "first control valve") 76 to control the flow of hydraulic fluid supplied to the first hydraulic cylinders 61, a control valve (hereinafter referred to as "second control valve") 77 to control the flow of hydraulic fluid to the second hydraulic cylinders 62, and a control valve (hereinafter referred to as "third control valve") 78 to control the flow of hydraulic fluid supplied to and discharged from the hydraulic actuator(s) of the work attachment 9 (7B) via two of the AUX ports 75*a*, 75*b*, and 75*c*. The work-related hydraulic circuit 6B includes pressure detectors 79*a*1, 79*a*2, 79*b*1, 79*b*2, 79*c*1, and 79*c*2 electrically connected to the controller 5 to detect the pressure of hydraulic fluid in the hydraulic actuators 61 and 62 (first hydraulic cylinders 61, second hydraulic cylinders 62) of the working machine 1 and the hydraulic actuator(s) 95 and/or 96 of the work attachment 9 (7B).

The work-related hydraulic circuit 6B includes a fluid passage (hereinafter referred to as "fluid discharge passage") R2 connected to the delivery port of the third hydraulic pump 74, and fluid supply passages (hereinafter referred to as "fluid supply passages") R3*a*, R3*b*, and R3*c* branching from the fluid discharge passage R2 in parallel to each other and connected to the pump ports of the first control valve 76, the second control valve 77, and the third control valve 78, respectively. The work-related hydraulic circuit 6B includes a pipe (hereinafter referred to as "bleed-off fluid passage") R4 branching from the portion of the fluid discharge passage R2 that is located upstream of the junctions of the fluid supply passages R3*a*, R3*b*, and R3*c* to reach the hydraulic fluid tank 65 and provided with a flow rate adjusting valve 80 at an intermediate portion thereof, and pipes (hereinafter referred to as "drain fluid passages") R5*a*, R5*b*, and R5*c* connected to the tank ports of the first control valve 76, the second control valve 77, and the third control valve 78, respectively, and connected to the portion of the bleed-off fluid passage R4 that is located downstream of the flow rate adjusting valve 80. With this, the flow rate of hydraulic fluid in the fluid discharge passage R2 is adjusted by the flow rate adjusting valve 80 in the bleed-off fluid passage R4.

In the present example embodiment, the hydraulic actuators 61 and 62 include the first hydraulic cylinders 61 and the second hydraulic cylinders 62. The working machine 1 is operable to, when a work attachment 9 (9B) including hydraulic actuator(s) 95, 96 is attached thereto, supply hydraulic fluid not only to the first hydraulic cylinders 61 and the second hydraulic cylinders 62 but also to the hydraulic actuator(s) 95, 96 of the work attachment 9 (9B).

Accordingly, the pressure detectors 79*a*1, 79*a*2, 79*b*1, 79*b*2, 79*c*1, and 79*c*2 of the work-related hydraulic circuit 6B include first pressure detectors 79*al* and 79*a*2 electrically connected to the controller 5 to detect the pressure of hydraulic fluid in the first hydraulic cylinders 61, second pressure detectors 79*b*1 and 79*b*2 electrically connected to the controller 5 to detect the pressure of hydraulic fluid in the second hydraulic cylinders 62, and third pressure detectors 79*c*1 and 79*c*2 electrically connected to the controller 5 to detect the pressure of hydraulic fluid in the hydraulic actuator(s) of the work attachment 9 (7B).

As described earlier, the first hydraulic cylinders 61 and the second hydraulic cylinders 62 are double-acting hydraulic cylinders, and each include a first port Pa1, Pb1 and a second port Pa2, Pb2 to allow hydraulic fluid to enter and exit the hydraulic cylinder. Accordingly, the first pressure detectors 79*a*1 and 79*a*2 are connected to a pair of supply/discharge passages (hereinafter referred to as "first supply/discharge passages") R6*a* and R6*b* connected to the first ports Pa1 and the second ports Pa2 of the first hydraulic cylinders 61, and the second pressure detectors 79*b*1 and 79*b*2 are connected to a pair of supply/discharge passages (hereinafter referred to as "second supply/discharge passages") R7*a* and R7*b* connected to the first ports Pb1 and the second ports Pb2 of the second hydraulic cylinders 62. The third pressure detectors 79*c*1 and 79*c*2 are connected to a pair of supply/discharge passages (hereinafter referred to as "third supply/discharge passages") R8*a* and R8*b* connecting the third control valve 78 and two of the AUX ports 75*a*, 75*b*, and 75*c* (hydraulic fluid ports).

In the present example embodiment, the pair of first pressure detectors 79*al* and 79*a*2 are located in the pair of first supply/discharge passages R6*a* and R6*b* in the vicinities of the first ports Pa1 and the second ports Pa2 of the first hydraulic cylinders 61. The pair of second pressure detectors 79*b*1 and 79*b*2 are located in the pair of second supply/discharge passages R7*a* and R7*b* in the vicinities of the first ports Pb1 and the second ports Pb2 of the second hydraulic cylinders 62. The pair of third pressure detectors 79*c*1 and 79*c*2 are located in the pair of third supply/discharge passages R8*a* and R8*b* in the vicinities of the AUX ports 75*a*, 75*b*, and 75*c*.

With this, the pair of first pressure detectors 79*a*1 and 79*a*2 detect the pressure of hydraulic fluid at the first ports Pa1 of the first hydraulic cylinders 61 and the pressure of hydraulic fluid at the second ports Pa2 of the first hydraulic cylinders 61, and the pair of second pressure detectors 79*b*1 and 79*b*2 detect the pressure of hydraulic fluid at the first ports Pb1 of the second hydraulic cylinders 62 and the pressure of hydraulic fluid at the second ports Pb2 of the second hydraulic cylinders 62. In contrast, the pair of third pressure detectors 79*c*1 and 79*c*2 detect the pressure of hydraulic fluid supplied to and discharged from the hydraulic actuator(s) 95 and/or 96 of the work attachment 9 (9B) via the pair of AUX ports 75*a* and 75*b*.

The pressure detectors 79*a*1, 79*a*2, 79*b*1, 79*b*2, 79*c*1, and 79*c*2 (first pressure detectors 79*a*1 and 79*a*2, second pressure detectors 79*b*1 and 79*b*2, and third pressure detectors 79*c*1 and 79*c*2), upon detection of the pressure of hydraulic fluid, output the result of detection as a signal to the controller 5.

Figure 21:
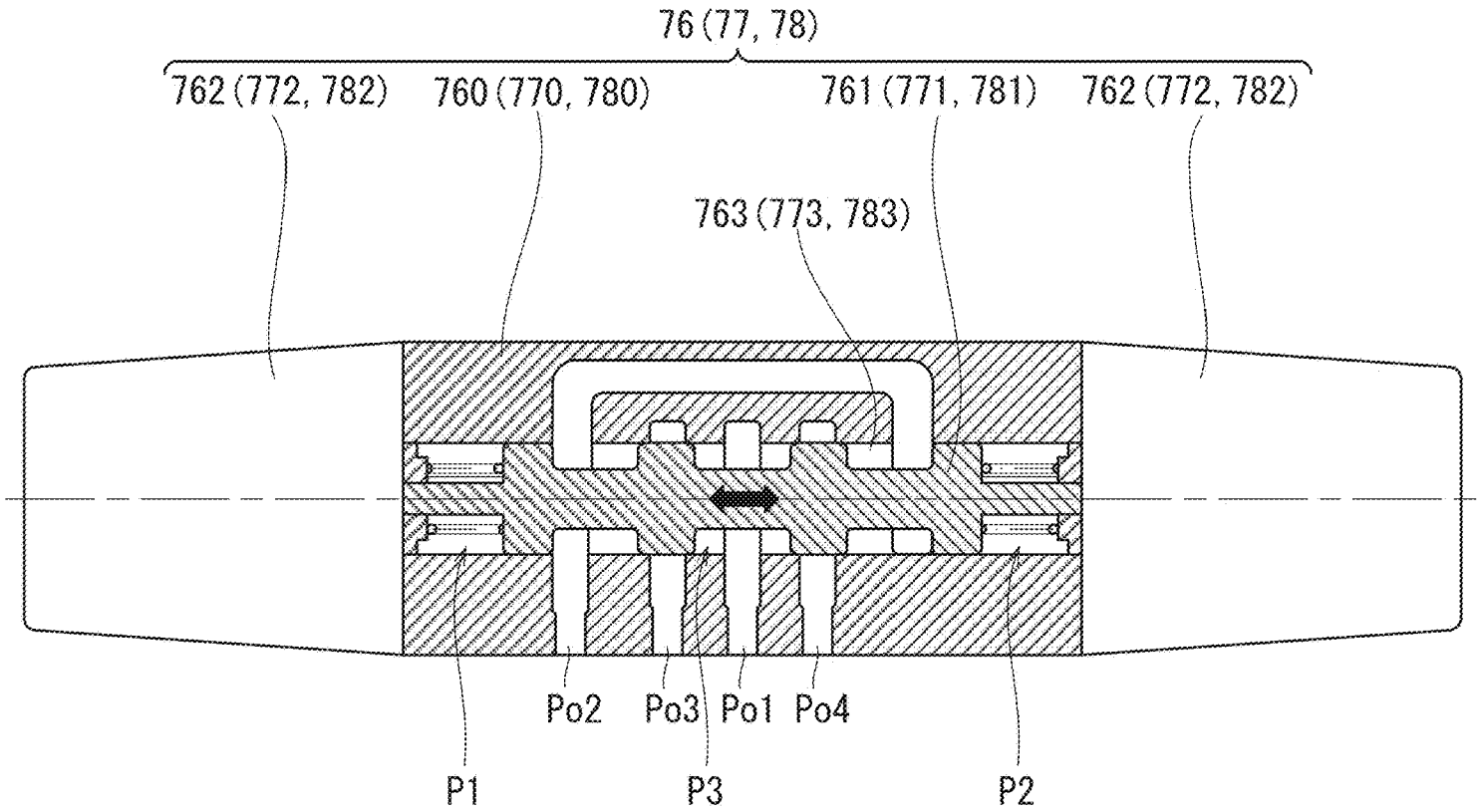
FIG. 21 is a schematic cross-sectional view of a control valve of a work-related hydraulic circuit included in a hydraulic circuit of a working machine according to the same example embodiment of the present invention.

The control valves 76, 77, and 78 (first control valve 76, second control valve 77, and third control valve 78) are each a pilot-operated direction switching valve including a spool 761 (771, 781) including, at opposite ends thereof, pressure receivers 762 (772, 773) to receive plot pressure (see FIG. 21).

Specifically, the control valves 76, 77, and 78 (first control valve 76, second control valve 77, and third control valve 78) in the present example embodiment each include a valve body 760 (770, 780), a spool 761 (771, 781) movable in a predetermined axial direction within the valve body 760 (770, 780) to change the path of flow of hydraulic fluid (direction of flow of hydraulic fluid) by moving along the axial direction, and pressure receivers 762 (772, 782) to receive pilot hydraulic fluid (receive the pressure of pilot hydraulic fluid) and to move the spool 761 (771, 781) along the axial direction upon receipt of the pressure of hydraulic fluid.

Note that, since the hydraulic actuators 61, 62 and so on operate in different manners, the manner in which hydraulic fluid is caused to flow, etc. differs between the control valves 76, 77, and 78. Therefore, the control valves 76, 77, and 78 differ from each other in terms of the configuration of the spool 761 (771, 781) and the locations and the number of hydraulic fluid ports of the valve body 760 (770, 780). It is noted, however, that typical control valves 76, 77, and 78 are described here. Specifically, examples of the control valves 76, 77, and 78 include three-port control valves 76, 77, and 78 with three hydraulic fluid ports, four-port control valves 76, 77, and 78 with four hydraulic fluid ports, five-port control valves 76, 77, and 78 with five hydraulic fluid ports, and six-port control valves 76, 77, and 78 with six hydraulic fluid ports, but each control valve is configured such that the movement (positioning) of the spool 761 (771, 781) switches passages, blocks the passage, etc.

Although six-port control valves 76, 77, and 78 are illustrated in FIG. 10, FIG. 21 illustrates only the relationship between main four ports (the ports through which hydraulic fluid is supplied to and discharged from the first port Pa1, Pb1 and the second port Pa2, Pb2 of the first or second hydraulic cylinder 61, 62) and the spool 761 (771, 781). Based on this, the following schematically discusses the structure of each control valve 76, 77, 78 that relates to supplying and stopping supplying hydraulic fluid to the first port Pa1, Pb1 and the second port Pa2, Pb2 of the first or second hydraulic cylinder 61, 62.

The valve body 760 (770, 780) of the control valve 76, 77, 78 includes a first connecting port Po1, a second connecting port Po2, a third connecting port Po3, and a fourth connecting port Po4. The valve body 760 (770, 780) includes a spool storage space 763 (773, 783) to house the spool 761 (771, 781) movably in the axial direction, and the first connecting port Po1, the second connecting port Po2, the third connecting port Po3, and the fourth connecting port Po4 are connected to the spool storage space 763 (773, 783).

The spool 761 (771, 781) is movable in the axial direction, and is operable to be placed in a first connecting position P1 (which is offset to one of opposite ends in the axial direction), a second connecting position P2 (which is offset to the other of the opposite ends in the axial direction), and an intermediate position P3 (between the first connecting position P1 and the second connecting position P2). The spool 761 (771, 781) is movable in a direction perpendicular to the connected fluid passage (direction of flow of hydraulic fluid), and is switchable between three positions: the first connecting position P1, the intermediate position P3, and the second connecting position P2.

The control valve 76, 77, 78 is configured such that, when the spool 761 (771, 781) is in the first connecting position P1, the connecting port Po1 and the third connecting port Po3 are in communication with each other and the second connecting port Po2 and the fourth connecting port Po4 are in communication with each other, and that, when the spool 761 (771, 781) is in the second connecting position P2, the first connecting port Po1 and the fourth connecting port Po4 are in communication with each other and the second connecting port Po2 and the third connecting port Po3 are in communication with each other. The control valve 76, 77, 78 is configured such that, when the spool 761 (771, 781) is in the intermediate position P3, the first connecting port Po1 and the second connecting port Po2 are isolated from the third connecting port Po3 and the fourth connecting port Po4, respectively.

In the present example embodiment, since the control valve 76, 77, 78 is a solenoid proportional direction/flow-rate control valve 76, 77, 78, the first connecting position P1 and the second connecting position P2 each have a width (range) in the direction of movement of the spool 761 (771, 781), and the degree of opening of the passage changes steplessly as the spool 761 (771, 781) moves. That is, the spool 761 (771, 778), when moved from one position to another, increases or reduces the flow rate of hydraulic fluid. Specifically, when the spool 761 (771, 778) moves from the intermediate position P3 to the first connecting position P1, the degree of opening of the passage through which the first connecting port Po1 and the third connecting port Po3 are in communication with each other changes, the flow rate of hydraulic fluid increases as the spool 761 (771, 778) moves, and the flow rate of hydraulic fluid reaches maximum when the spool 761 (771, 778) is in the first connecting position P1. On the other hand, when the spool 761 (771, 778) moves from the intermediate position P3 to the second connecting position P2, the opening of the passage through which the first connecting port Po1 and the fourth connecting port Po4 are in communication with each other changes, the flow rate of hydraulic fluid increases as the spool 761 (771, 778) moves, and the flow rate of hydraulic fluid reaches maximum also when the spool 761 (771, 778) is in the second connecting position P2. That is, the flow rate of hydraulic fluid increases as the spool 761 (771, 781) moves to a greater extent.

In contrast, when the spool 761 (771, 778) moves from the first connecting position P1 to the intermediate position P3 or when the spool 761 (771, 778) moves from the second connecting position P2 to the intermediate position P3, on the contrary, the flow rate of hydraulic fluid decreases as the spool 761 (771, 778) moves, and the flow rate of hydraulic fluid reaches zero when the spool 761 (771, 778) is in the intermediate position P3. Thus, the control valve 76, 77, 78 is such that the degree of opening of the passage is also changed as the passage of hydraulic fluid is changed, and therefore the control valve 76, 77, 78 is capable of also adjusting the flow rate of hydraulic fluid.

Note that, in the present example embodiment, the spool 761 (771, 781) is moved by the pressure of pilot hydraulic fluid, and therefore the control valve 76, 77, 78 (first control valve 76, second control valve 77, third control valve 78) includes the pressure receivers 762 (772, 782). Note, however, that the control valve 76, 77, 78 may include a solenoid to be actuated by a signal from the controller 5, instead of the pressure receivers 762 (772, 782). In such a case, the spool 761 (771, 781) is moved by energizing the solenoid. That is, the electric current value (the force to energize the spool 761 (771, 781)) inputted into the solenoid 732, 732 is changed, so that the spool 761 (771, 781) changes in position (moves) according to the electric current value (the force to energize the spool 761 (771, 781)) inputted into the solenoid 732, 732. With this, hydraulic fluid at a flow rate corresponding to the signal (electric current value) inputted into the solenoid is supplied to the actuators (hydraulic cylinder, hydraulic motor) 61, 62. It is noted here that the inputted signal (electric current value) is an electric current value corresponding to the operation amount of the work manual operator 12 (e.g., work operating lever 120).

The first hydraulic pump 63 of the travel-related hydraulic circuit 6A is operable to supply hydraulic fluid for control (pilot hydraulic fluid) also to the control valves (first control valve 76, second control valve 77, and third control valve 78) of the work-related hydraulic circuit 6B. That is, the first hydraulic pump 63 is used in both the travel-related hydraulic circuit 6A and the work-related hydraulic circuit 6B to supply hydraulic fluid for control (pilot hydraulic fluid) to subject elements in the entire hydraulic circuit 6.

In the present example embodiment, the work-related hydraulic circuit 6B includes operating valves 81*a*, 81*b*, 81*c*, and 81*d* to actuate the first hydraulic cylinders 61 and the second hydraulic cylinders 62 based on the operation of the work operating lever 120. In the present example embodiment, the work operating lever 120 is pivotable about a lower end thereof. Assuming the above configuration, the operating valves 81*a*, 81*b*, 81*c*, and 81*d* are located around the lower portion of the work operating lever 120. Specifically, the work operating lever 120 is pivotable forward, rearward, leftward, and rightward about the lower end thereof. Accordingly, the operating valves 81*a*, 81*b*, 81*c*, and 81*d* are arranged such that a pair of them are arranged in the front-rear direction with the work operating lever 120 therebetween, and the other pair of them are arranged in the lateral direction with the work operating lever 120 therebetween. One of more of the four operating valves 81*a*, 81*b*, 81*c*, and 81*d* that are located at a position corresponding to the direction of pivoting of the work operating lever 120 are actuated. That is, when the work operating lever 120 is pivoted forward, rearward, leftward, or rightward, one of the operating valves 81*a*, 81*b*, 81*c*, and 81*d* that is located in the direction of pivoting of the work operating lever 120 is actuated, and hydraulic fluid from the first hydraulic pump 63 is discharged from the one of the operating valves 81*a*, 81*b*, 81*c*, and 81*d* that corresponds to the pivoting of the work operating lever 120 to the control valve(s) (first control valve 76, second control valve 77), as pilot hydraulic fluid.

Specifically, the work operating lever 120 has a neutral position N which is an intermediate position in the front-rear direction and an intermediate position in the lateral direction, similar to the travel operating lever 110. When the work operating lever 120 is pivoted from the neutral position N in the forward direction F, the corresponding operating valve 81*a* allows pilot hydraulic fluid (hydraulic fluid) in an amount corresponding to the angle of pivoting (operation amount) of the work operating lever 120 to flow. Accordingly, the pilot hydraulic fluid (hydraulic fluid) is supplied via pilot fluid passage(s) to one of the pressure receivers 76*a* of the first control valve 76, so that the spool of the first control valve 76 moves in one direction. With this, the hydraulic fluid is supplied from the first control valve 76 via the first supply/discharge passage R6*a* to the second ports Pa2 of the hydraulic cylinders 61, and hydraulic fluid is discharged form the first ports Pa1 of the first hydraulic cylinders 61 via the supply/discharge passage R6*b* to the first control valve 76. With this, the first hydraulic cylinders 61 retract, and the arms 43 lower.

On the contrary, when the work operating lever 120 is pivoted from the neutral position N in the rearward direction B, the corresponding operating valve 81*b* allows pilot hydraulic fluid (hydraulic fluid) in an amount corresponding to the angle of pivoting (operation amount) of the work operating lever 120 to flow. Accordingly, the pilot hydraulic fluid (hydraulic fluid) is supplied via pilot fluid passage(s) to the other of the pressure receivers 76*a* of the first control valve 76, so that the spool of the first control valve 76 moves in the opposite direction. With this, the hydraulic fluid is supplied from the first control valve 76 via the first supply/discharge passage R6*b* to the first ports Pa1 of the hydraulic cylinders 61, and hydraulic fluid is discharged form the second ports Pa2 of the first hydraulic cylinders 61 via the first supply/discharge passage R6*a* to the first control valve 76. With this, the first hydraulic cylinders 61 extend, and the arms 43 are raised.

When the work operating lever 120 is pivoted from the neutral position N in the rightward direction R, the corresponding operating valve 81*c* allows pilot hydraulic fluid (hydraulic fluid) in an amount corresponding to the angle of pivoting (operation amount) of the work operating lever 120 to flow. Accordingly, the pilot hydraulic fluid (hydraulic fluid) is supplied via a pilot fluid passage R9*d* to one (pressure receiver 77*a*) of the pressure receivers of the second control valve 77, so that the spool of the second control valve 77 moves in one direction. With this, the hydraulic fluid is supplied from the second control valve 77 via the second supply/discharge passage R7*b* to the first ports Pb1 of the second hydraulic cylinders 62, and hydraulic fluid is discharged form the second ports Pa2 of the second hydraulic cylinders 62 via the second supply/discharge passage R7*a* to the second control valve 77. With this, the second hydraulic cylinders 62 extend, and the work attachment 9 swings downward relative to the arms 43 (counterclockwise in the drawings). That is, in the case where the work attachment 9 is a bucket A1, the work attachment 9 is brought into the dumping position to discharge earth, etc.

On the contrary, when the work operating lever 120 is pivoted from the neutral position N in the leftward direction L, the corresponding operating valve 81*d* allows pilot hydraulic fluid (hydraulic fluid) in an amount corresponding to the angle of pivoting (operation amount) of the work operating lever 120 to flow. Accordingly, the pilot hydraulic fluid (hydraulic fluid) is supplied via a pilot fluid passage R9*c* to the other of the pressure receivers 77*b* of the second control valve 77, so that the spool of the second control valve 77 moves in the opposite direction. With this, the hydraulic fluid is supplied from the second control valve 77 via the second supply/discharge passage R7*a* to the second ports Pa2 of the second hydraulic cylinders 62, and hydraulic fluid is discharged form the first ports Pb1 of the second hydraulic cylinders 62 via the second supply/discharge passage R7*b* to the second control valve 77. With this, the second hydraulic cylinders 62 retract, and the work attachment 9 swings upward relative to the arms 43 (clockwise in the drawings). That is, in the case where the work attachment 9 (A1) is a bucket, the work attachment 9 is brought into the shoveling position to scoop earth, etc.

In the present example embodiment, the work-related hydraulic circuit 6B includes pilot pressure detectors 83*a*, 83*b*, 83*c*, and 83*d* to detect the hydraulic pressures in the respective pilot fluid passages R9*a*, R9*b*, R9*c*, ad R9*d* connected to the operating valves 81*a*, 81*b*, 81*c*, and 81*d* and electrically connected to the controller 5. The pilot pressure detectors 83*a*, 83*b*, 83*c*, and 83*d* each input a signal indicating the result of detection (the value of hydraulic pressure in the pilot fluid passage R9*a*, R9*b*, R9*c*, R9*d*) into the controller 5.

Accordingly, the controller 5 determines whether or not the first control valve 76 and/or the second control valve 77 is in operation (the first hydraulic cylinders 61 and/or the second hydraulic cylinders 62 are extending or retracting), based on the signals inputted from the pilot pressure detectors 83*a*, 83*b*, 83*c*, and 83*d*. That is, the controller 5 determines whether or not the work operating lever 120 is operated to actuate the arms 43 and/or the second hydraulic cylinders 62 (whether or not the work operating lever 120 is pivoted from the neutral position N). The controller 5 recognizes the status (position) of the first control valve 76 and/or the second control valve 77, i.e., the operating direction and operation amount (the direction and angle of pivoting from the neutral position) of the work operating lever 120, based on the signals from the pilot pressure detectors 83*a*, 83*b*, 83*c*, and 83*d*.

The work-related hydraulic circuit 6B includes a pair of solenoid valves (hereinafter referred to as "first solenoid valves") 84*a* and 84*b* to control the third control valve 78. Accordingly, the working machine 1 includes an AUX switch 85 electrically connected to the controller 5 to switch the states of the first solenoid valve 84*a* and 84*b*.

The first solenoid valves 84*a* and 84*b* are supplied with, for example, hydraulic fluid from the third hydraulic pump 74 via fluid discharge passage(s), as pilot hydraulic fluid for the third control valve 78. Note that, in FIG. 10, the source of the pilot hydraulic fluid (hydraulic fluid) for the first solenoid valves 84*a* and 84*b* is not illustrated.

The AUX switch 85 may be, for example, any type of switch such as a seesaw switch, a slide switch, or a push switch. The AUX switch 85, when operated by a user, inputs an electric signal corresponding to the operation as a signal into the controller 5. Upon receipt of the signal based on the operation of the AUX switch 85, the controller 5 outputs, to one of the pair of solenoid valves (solenoids) 84*a* and 84*b*, an electric current corresponding to the received signal, as a control signal. That is, the AUX switch 85, when operated by the user, determines which of the first solenoid valves 84*a* and 84*b* to actuate.

When the AUX switch 85 is operated to actuate one first solenoid valve 84*a*, the solenoid of the one first solenoid valve 84*a* is energized upon receipt of the control signal from the controller 5. Accordingly, pilot hydraulic fluid (hydraulic fluid) is supplied from the one first solenoid valve 84*a* to one pressure receiver 78*a* of the third control valve 78. With this, the status of the third control valve 78 is changed, so that hydraulic fluid is supplied to the hydraulic actuator(s) of the work attachment 9 (9B) from the third control valve 78 via one AUX port 75*a* of the two AUX ports 75*a* and 75*b*, and hydraulic fluid is returned from the hydraulic actuator(s) of the work attachment 9 (9B) to the third control valve 78 via the other AUX port 75*b*.

On the contrary, when the AUX switch 85 is operated to actuate the other first solenoid valve 84*b*, the solenoid of the other first solenoid valve 84*b* is energized upon receipt of the control signal from the controller 5. Accordingly, pilot hydraulic fluid (hydraulic fluid) is supplied from the other first solenoid valve 84*b* to the other pressure receiver 78*b* of the third control valve 78. With this, the status of the third control valve 78 is changed, hydraulic fluid is supplied to the hydraulic actuator(s) of the work attachment 9 (7B) via the other AUX port 75*b* of the two AUX ports 75*a* and 75*b* from the third control valve 78, and hydraulic fluid is returned from the hydraulic actuator(s) of the work attachment 9 (7B) to the third control valve 78 via the one AUX port 75*a*. With this, the direction of supply (flow) of hydraulic fluid to the hydraulic actuator(s) of the work attachment 9 (7B) is changed, and the operation of the work attachment 9 (9B (9Ba, 9Bc)) is changed.

The work-related hydraulic circuit 6B includes a pair of solenoid valves (hereinafter referred to as "second solenoid valves") 88*a* and 88*b* to control the first control valve 76. The second solenoid valves 88*a* and 88*b* are supplied with, for example, hydraulic fluid from the third hydraulic pump 74 via fluid discharge passage(s), as pilot hydraulic fluid for the first control valve 76. Note that, in FIG. 10, the source of pilot hydraulic fluid (hydraulic fluid) for the second solenoid valves 88*a* and 88*b* is not illustrated, as with the case of the first solenoid valves 84*a* and 84*b*.

The pair of second solenoid valves 88*a* and 88*b* are actuated based on an electric signal from the controller 5. That is, the second solenoid valves 88*a* and 88*b* are controlled by the controller 5 based on a predetermined reference (reference stored in the storing unit 50). Specifically, the controller 5 controls each of the pair of second solenoid valves 88*a* and 88*b* when the work operating lever 120 is not being operated and the working machine 1 is traveling (during "pressure absorbing process" described later).

In the present example embodiment, the discharge-side fluid passages connected to the pair of second solenoid valves 88*a* and 88*b* merge with pilot fluid passages connecting the work manual operator 12 and the first control valve 76. That is, the discharge-side fluid passage connected to the second solenoid valve 88*a* merges with the pilot fluid passage connecting the work manual operator 12 and the pressure receiver 76*a* of the first control valve 76, whereas the discharge-side fluid passage connected to the second solenoid valve 88*b* merges with the pilot fluid passage connecting the work manual operator 12 and the pressure receiver 76*b* of the first control valve 76. Accordingly, the discharge-side fluid passages connected to the second solenoid valves 88*a* and 88*b* are provided with respective first on-off valves V1 and V2 to open or block the discharge-side passages, and second on-off valves V3 and V4 to open and close the pilot fluid passages are provided in the portions of the pilot fluid passages connecting the work manual operator 12 and the first control valve 76 that are located upstream of the junctions with the discharge-side passages connected to the second solenoid valves 88*a* and 88*b* (located at the same side of the junctions as the work manual operator 12). The first on-off valves V1 and V2 and the second on-off valves V3 and V4 are each electrically connected to the controller 5. That is, the first on-off valves V1 and V2 and the second on-off valves V3 and V4 are each operable to open and block a fluid passage (discharge-side fluid passage, pilot fluid passage) in accordance with an instruction from the controller 5.

Specifically, the controller 5 performs control such that the second on-off valves V3 and V4 are in the closed state when the first on-off valves V1 and V2 are in the open state and that the second on-off valves V3 and V4 are in the open state when the first on-off valves V1 and V2 are in the closed state. This makes it possible to eliminate or reduce the likelihood that pilot hydraulic fluid will flow toward the second solenoid valves 88*a* and 88*b* while the work manual operator 12 (work operating lever 120) is being operated and the operation responsiveness will decrease, and to eliminate or reduce the likelihood that pilot hydraulic fluid will flow through the pilot fluid passages back toward the work manual operator 12 and the operation responsiveness will decrease while the controller 5 is performing control (while pilot hydraulic fluid is being supplied from the second solenoid valves 88*a* and 88*b*).

The specific configuration of the working machine 1 of the present example embodiment has been discussed. The following description discusses processes performed by the controller 5 when a work attachment 9 is attached. The working machine 1 of the present example embodiment is such that the controller 5 recognizes the work attachment 9 attached to the attachment mount 40 in either of the following manners: (i) manual recognition in which the work attachment 9 is selected via the attachment list on the monitor M (attachment selector 55), and (ii) automatic recognition in which the work attachment 9 is automatically recognized by the identification information reader 15 reading the identification information. That is, the working machine 1 of the present example embodiment has a manual recognition mode in which the work attachment 9 is recognized based on the selection made by the user, and an automatic recognition mode in which the work attachment 9 is automatically recognized in a series of steps by which the work attachment 9 is attached. The working machine 1 of the present example embodiment is configured such that the manual recognition mode and the automatic recognition mode are switchable by operation on the monitor M, and the automatic recognition mode is selected under normal conditions.

In the working machine 1 of the present example embodiment, the controller 5 is configured or programmed to recognize the work attachment 9 attached to the attachment mount 40 in either the manual recognition mode or the automatic recognition mode, but the following description is based on the automatic recognition mode.

The controller 5, upon recognition of the work attachment 9 attached to the attachment mount 40, defines, depending on the work attachment 9 attached to the attachment mount 40, a movement condition according to which the attachment mount 40 moves along a path, and associates the defined movement condition with the operation state of the manual operator. In the present example embodiment, the controller 5 defines an ascending/descending condition as the movement condition in which the attachment mount 40 moves along a path depending on the work attachment 9 attached to the attachment mount 40, and associates the ascending/descending condition, as the defined movement condition, with the operation state of the manual operator. Furthermore, the controller 5 defines a tilting condition as the movement condition in which the attachment mount 40 moves along a path depending on the work attachment 9 attached to the attachment mount 40, and associates the tilting condition, as the defined movement condition, with the operation state of the manual operator. The meaning of the phrase "associates a movement condition with the operation state of the manual operator" not only includes associating a movement condition when defining the movement condition but also includes associating a movement condition in advance before defining (extracting) the movement condition.

In the present example embodiment, movement conditions (ascending/descending conditions, tilting conditions) are stored in the storing unit 50 in advance such that the movement conditions (ascending/descending conditions, tilting conditions) are associated with the operation state of the manual operator (work manual operator 12). Therefore, the controller 5 defines the extracted movement condition as a movement condition according to which the attachment mount 40 moves along a path that corresponds to the work attachment 9, and defines, as the manner in which the work manual operator 12 is operated (operation state of the work manual operator 12), the operation state of the work manual operator 12 that is associated in advance with the defined movement condition. The controller 5, upon recognition of the work attachment 9, extracts the movement condition corresponding to the recognized work attachment 9 from the storing unit 50, and defines the movement condition as a condition for use when the work manual operator 12 is operated.

Figure 22:
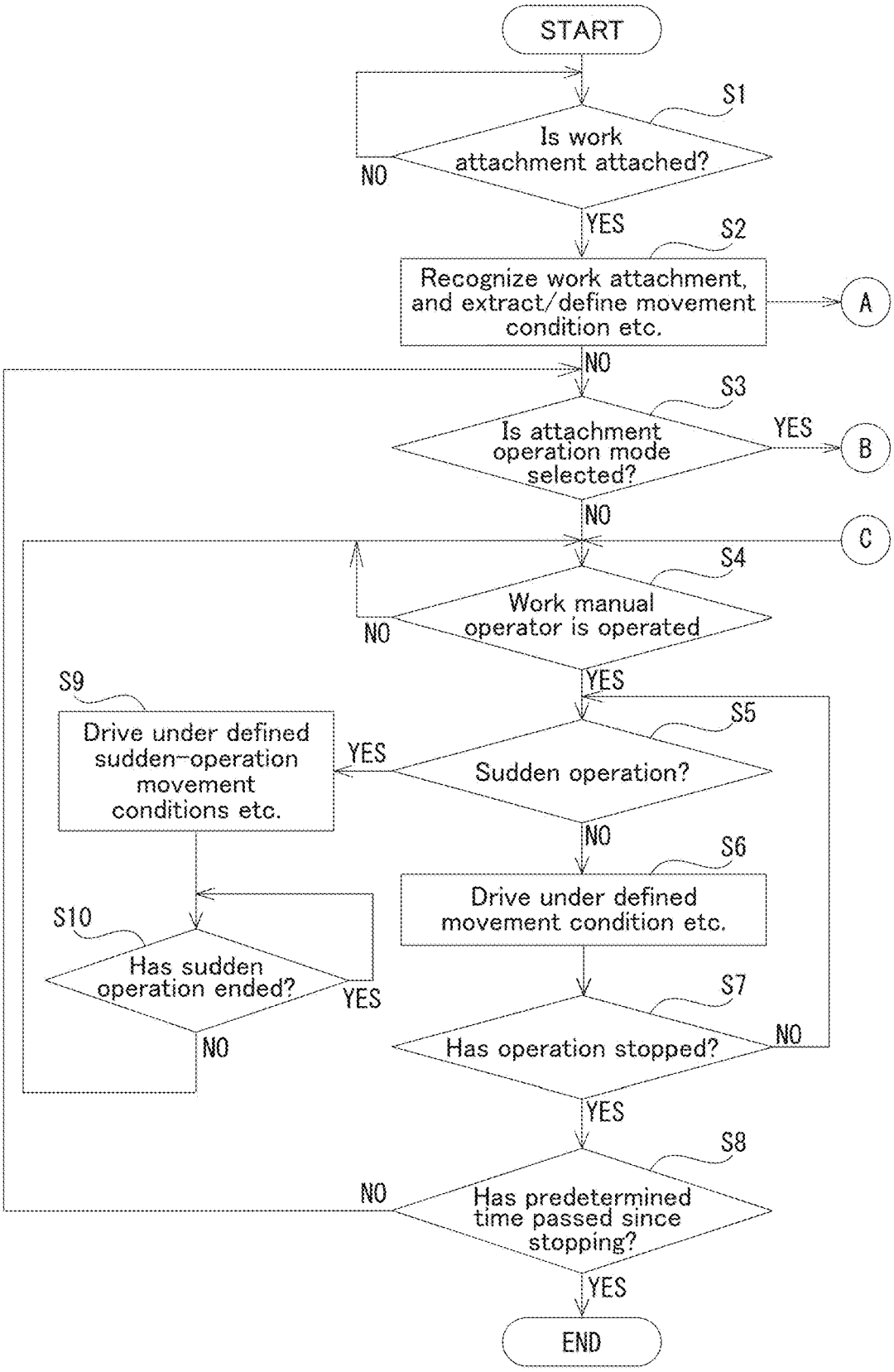
FIG. 22 is a control flowchart for a working machine according to the same example embodiment of the present invention.

Specifically, as shown in FIG. 22, the controller 5 monitors whether or not a work attachment is attached to the attachment mount 40 (S1). In the present example embodiment, the controller 5 monitors whether or not a work attachment is attached to the attachment mount 40 based on the state of the linkage 41. Note that the state of the linkage 41 includes the positions of the latch pins 412, and extended/retracted states of the latch cylinder 411 to change the state of the latch pins 412. In the present example embodiment, a sensor detects the extended or retracted state of the latch cylinder 411 and, if the sensor detects that the latch cylinder 411 is in the extended state, the controller 5 determines that a work attachment 9 is attached to the attachment mount 40 (YES at S1). That is, the controller 5 determines that no work attachments 9 are attached to the attachment mount 40 when the latch pins (engaging portions) 412 are in their disengaging position PE2 (NO at S1).

The controller 5 then, if determining that a work attachment 9 is attached to the attachment mount 40 (YES at S1), recognizes the attached work attachment 9 based on the identification information read by the identification information reader 15 from the tag T (S2). The controller 5 also extracts, from a database stored in the storing unit 50, a movement condition (ascending/descending condition, tilting condition), a travel condition, a sudden-operation movement condition, a sudden-operation travel condition, etc. corresponding to the recognized work attachment 9 (S2).

For example, in the case of a bucket A1, the ascending/descending speed Va1 and the tilting speed Vb1 corresponding to the operation amount of the work manual operator 12 (work operating lever 120) (i.e., the amount or angle of pivoting of the work operating lever 120) are set to maximum. Specifically, in the case of a bucket A1, when the operation amount of the work manual operator 12 (work operating lever 120) (i.e., the amount or angle of pivoting of the work operating lever 120) is 100% (maximum), the corresponding ascending/descending speed Va1 and the tilting speed Vb1 are each set to maximum (100%) which corresponds to the maximum output of the actuator, and, when the operation amount of the work manual operator 12 (work operating lever 120) (i.e., the amount or angle of pivoting of the work operating lever 120) is 50%, the corresponding ascending/descending speed Va1 and the tilting speed Vb1 are each set to a value corresponding to 50% of the maximum output of the actuator, for example.

In contrast, in the case of a pallet fork A2, when the operation amount of the work manual operator 12 (work operating lever 120) (i.e., the amount or angle of pivoting of the work operating lever 120) is 100% (maximum), the corresponding ascending/descending speed Va2 and the tilting speed Vb2 are each set to a value lower than the maximum output of the actuator (set to, for example, 80% of the maximum output). Accordingly, when the operation amount of the work manual operator 12 (work operating lever 120) (i.e., the amount or angle of pivoting of the work operating lever 120) is 50%, the corresponding ascending/descending speed Va2 and the tilting speed Vb2 are each set to a value corresponding to 40% of the maximum output of the actuator, for example.

With this, in a case that the work attachment 9 recognized by the controller 5 has a total length longer than other work attachments 9, the ascending/descending speed and the tilting speed per unit operation amount of the work manual operator 12 (work operating lever 120) are set to be lower than in cases of other work attachments 9. That is, since the pallet fork A2 is the largest in total length in the front-rear direction among the work attachments 9, if the recognized work attachment 9 is a pallet fork A2, the controller 5 defines, as the movement condition for the pallet fork A2, the ascending/descending speed Va2 and the tilting speed Vb2 lower than in cases of other work attachments 9.

Upon recognition of the work attachment 9 attached to the attachment mount 40 as described above, the controller 5 recognizes the work attachment 9 also as a load and associates a travel condition corresponding to the recognized load with the operation state of the travel manual operator 11. In the present example embodiment, the storing unit 50 stores work attachments 9 (loads) and travel conditions for the travel manual operator 11 which are associated with each other, and therefore the controller 5 extracts the operation state that corresponds to the load (work attachment 9).

In the present example embodiment, the during-speed-change travel conditions Vf1 to Vf20 are each defined such that, if the load on the attachment mount 40 is below a predetermined amount, a speed change is smaller than a speed change defined as the during-speed-change travel conditions Vf1 to Vf20 for when the load is above a predetermined amount. Therefore, for example, if the controller 5 recognizes that a relatively light-weight work attachment 9 such as a pallet fork A2 is attached to the attachment mount 40, the controller 5 defines a travel condition Ve1 to Ve20 such that a speed change is smaller than a speed change for other work attachments 9.

The working machine 1 of the present example embodiment is switchable between a first speed stage and a second speed stage. Therefore, the controller 5 also extracts a travel condition for the first speed stage and a travel condition for use during speed change. That is, for example, if the controller 5 recognizes that a relatively light-weight work attachment 9 such as a pallet fork A2 is attached to the attachment mount 40, the controller 5 defines a travel condition Ve1 to Ve20 for use during speed change such that a speed change is smaller than that for other work attachments 9.

Next, when the user operates the work manual operator 12 in performing work with the working machine 1, the controller 5 causes the attachment mount 40 (work attachment 9) to move along a first path and a second path according to the defined ascending/descending condition Va1 to Va20 and tilting condition Vb1 to Vb20. That is, the controller 5 causes the attachment mount 40 (work attachment 9) to move along the first path and the second path according to the ascending/descending condition Va1 to Va20 and the tilting condition Vb1 to Vb20 corresponding to the work attachment 9.

This allows the user, irrespective of the type, size, weight, etc., of the work attachment 9, to operate the work manual operator 12 at the same speed (operation speed) in any case, and to cause the attachment mount 40 (work attachment 9) to move under the ascending/descending condition Va1 to Va20 and the tilting condition Vb1 to Vb20 suitable for the work attachment 9. That is, since the ascending/descending conditions Va1 to Va20 and the tilting conditions Vb1 to Vb20 corresponding to the maximum operation amount of the work manual operator 12 are defined for respective work attachments 9, even if the work manual operator 12 (work operating lever 120) is operated in the same manner as usual (at the same speed), the acceleration acting on the work attachment 9 (attachment mount 40) may differ because the maximum speeds to be reached are different. Thus, in the case where, for example, the controller 5 recognizes a pallet fork A2, the controller 5 causes the pallet fork A2 to move along predetermined paths (first path and second path) more slowly than other work attachments 9 or the like such as a bucket A1. It is also apparent from this that the working machine 1 of the present example embodiment makes it possible to easily perform control relating to the work attachment 9 that requires precise operation.

On the other hand, with regard to travel, when no work attachments 9 are attached to the attachment mount 40 or a lightweight work attachment 9 such as a pallet fork A2 is attached to the attachment mount 40, the speed change during travel is small (acceleration is small) as compared to other cases, thus eliminating or reducing the likelihood that, for example, the traveling devices 3 will idle (excessive torque will be transmitted) and making it possible to achieve stable travel.

The pallet fork A2 has a state in which a cargo B is placed thereon and a state in which no cargos B are placed thereon. The load acting on the attachment mount 40 will vary depending on whether a cargo B is placed or not.

When a cargo B is placed on a fork F, if the travel speed is too fast, the cargo B thus placed may fall out of the fork F, and therefore the speed is controlled such that the speed change is small. The same applies to when speed stages are changed. However, with regard to work attachments 9 which are subjected to changes in load during travel and which do not entail problems of a cargo B or the like falling off the work attachment 9 unlike the pallet fork A2, the travel condition may be, when the load changes, changed to a condition corresponding to the changed load.

The controller 5 then determines whether or not the controller 5 is in the attachment operation mode (S3). In the present example embodiment, the controller 5 performs (enters) the attachment operation mode if the recognized work attachment 9 is a drive work attachment 9B. That is, the controller 5 is configured or programmed to, if the recognized work attachment 9 is a non-drive work attachment 9A, determine that the controller 5 is not in the attachment operation mode (NO at S3).

If the controller 5 determines that the controller 5 is not in the attachment operation mode (NO at S3), the controller 5 monitors whether or not the work manual operator 12 is operated (S4). If the controller 5 determines that the work manual operator 12 is operated based on, for example, the detection result from the Hall sensor(s) 121 (YES at S4), the controller 5 determines whether or not the speed of the operation of the work manual operator 12 (in the present example embodiment, the speed of pivoting of the work operating lever 120) is faster than a predetermined speed (reference speed) (whether or not the operation of the work manual operator 12 is a sudden operation) (S5). Note that, in the present example embodiment, the speed of operation of the work manual operator 12 is derived based on the detection result from the Hall sensor(s) 121. That is, the controller 5 recognizes the speed of operation of the work manual operator 12 based on the detection result from the Hall sensor(s) 121.

The controller 5 determines whether or not the speed of operation of the work manual operator 12 is faster than the reference speed based on the detection result from the Hall sensor(s) 121, and determines whether or not the operation of the manual operator 12 is a sudden operation (S5). In so doing, the controller 5 determines that there is a sudden operation if determining that the speed of operation of the work manual operator 12 is faster than the reference speed (YES at S5), and determines that an operation other than the sudden operation is performed if determining that the speed of operation of the work manual operator 12 is equal to or less than the reference speed (NO at S5).

In the present example embodiment, if the controller 5 determines that the operation of the work manual operator 12 is not the sudden operation (NO at S5), the controller 5 raises/lowers and/or tilts the attachment mount 40 based on the movement condition (ascending/descending condition, tilting conditions extracted from the storing unit 50 (S6). Specifically, if the controller 5 determines that the operation of the work manual operator 12 is not the sudden operation (NO at S5), the controller 5 causes, according to the operation state of the work manual operator 12, at least one of the first hydraulic cylinders 61 or the second hydraulic cylinders 62 to extend or retract to satisfy the movement condition (ascending/descending condition, tilting condition) extracted from the storing unit 50.

In so doing, the controller 5 monitors whether or not a load is acting on the work attachment 9 (load has increased or not) based on whether or not the pressure of hydraulic fluid in the first hydraulic cylinders 61 has changed. If the controller 5 determines that a load is acting on the work attachment 9 (load has increased), the controller 5 changes the defined movement condition (ascending/descending condition, tilting condition) to the corresponding with-load movement condition, and, if determining that the load on the work attachment 9 is removed (the load has changed back to its original state), changes the with-load movement condition back to the original movement condition.

Accordingly, the controller 5 causes at least one of the first hydraulic cylinders 61 or the second hydraulic cylinders 62 to extend or retract according to the movement condition or the with-load movement condition defined based on the load acting on the work attachment 9 according to the operation state of the work manual operator 12. Specifically, if the work attachment 9 attached to the attachment mount 40 is a heavy work attachment 9, the controller 5 causes the attachment mount 40 (work attachment) 9 to move (ascend/descend and/or tilt) at a lower speed than the cases of lightweight work attachments 9, and, if the work attachment 9 attached to the attachment mount 40 is a work attachment 9 large in total length, causes the attachment mount 40 (work attachment) 9 to move (ascend/descend and/or tilt) at a lower speed than the cases of work attachments 9 short in total length. If the movement condition based on weight and the movement condition based on length do not match, the controller 5 uses the movement condition for a lower speed (movement condition to achieve higher stability) than the other, and causes at least one of the first hydraulic cylinders 61 or the second hydraulic cylinders 62 to extract or retract according to this movement condition.

In the databased shown in FIG. 19, with-load movement conditions Vd1 to Vd20 are defined for the work attachments 9 (A1 to A20). Note, however, that in the present example embodiment, the with-load movement conditions Vd1 to Vd20 are used only in cases of specific work attachments subjected to increases in load because of a cargo B or the like placed thereon (e.g., bucket A1, pallet fork A2).

Specifically, the controller 5 is configured or programmed to, only in cases where the recognized work attachment 9 is a specific work attachment subjected to increases in load because of a cargo B or the like placed thereon (e.g., bucket A1, pallet fork A2), monitor whether or not a load is acting on the work attachment 9 (whether load has increased or not) based on whether the pressure of hydraulic fluid in the first hydraulic cylinders 61 has changed, and if determining that a load is acting on the work attachment 9 (load has increased), change the defined movement condition (ascending/descending condition, tilting condition) to the corresponding with-load movement condition, and, if determining that the load has been removed from the work attachment 9 (load has changed back to its original state), change the with-load movement condition back to the original movement condition.

During the above process, the controller 5 monitors whether or not the work manual operator 12 is operated (detection using the Hall sensor(s) 121) (S7). If the controller 5 determines that the operation of the work manual operator 12 is stopped based on whether or not a signal is inputted from the Hall sensor(s) 121 (YES at S7), and if a predetermined period of time has passed since the stoppage of the operation (YES at S7), the controller determines that the operation has ended (END). On the contrary, during the predetermined period of time from when the operation of the work manual operator 12 is stopped (NO at S7), the controller 5 repeats the above process (steps S3 to S7). If the controller 5 determines that the operation of the work manual operator 12 is a sudden operation (YES at S5), the controller 5 raises/lowers the attachment mount 40 and/or tilts the attachment mount 40 according to the sudden-operation movement condition extracted from the storing unit 50 (S10). That is, the controller 5, if determining that the operation of the work manual operator 12 is the sudden operation, actuates at least one of the first actuators 61 or the second actuators 62 according to the sudden-operation condition corresponding to the operation state of the work manual operator 12.

The controller 5 then determines whether or not the sudden operation has been terminated based on whether or not the work manual operator 12 is being operated (whether or not a detection result is obtained by the Hall sensor(s) 121 (S10). The controller 5, if determining that the sudden operation has been terminated, again monitors whether or not the work manual operator 12 is operated (S4) and repeats the above process (steps S4 to S10).

When the controller 5 recognizes the work attachment 9 at S2 of the above process (steps S1 to S10), also performs a process A relating to travel concurrently with the above process (steps S1 to S10).

Figure 23:
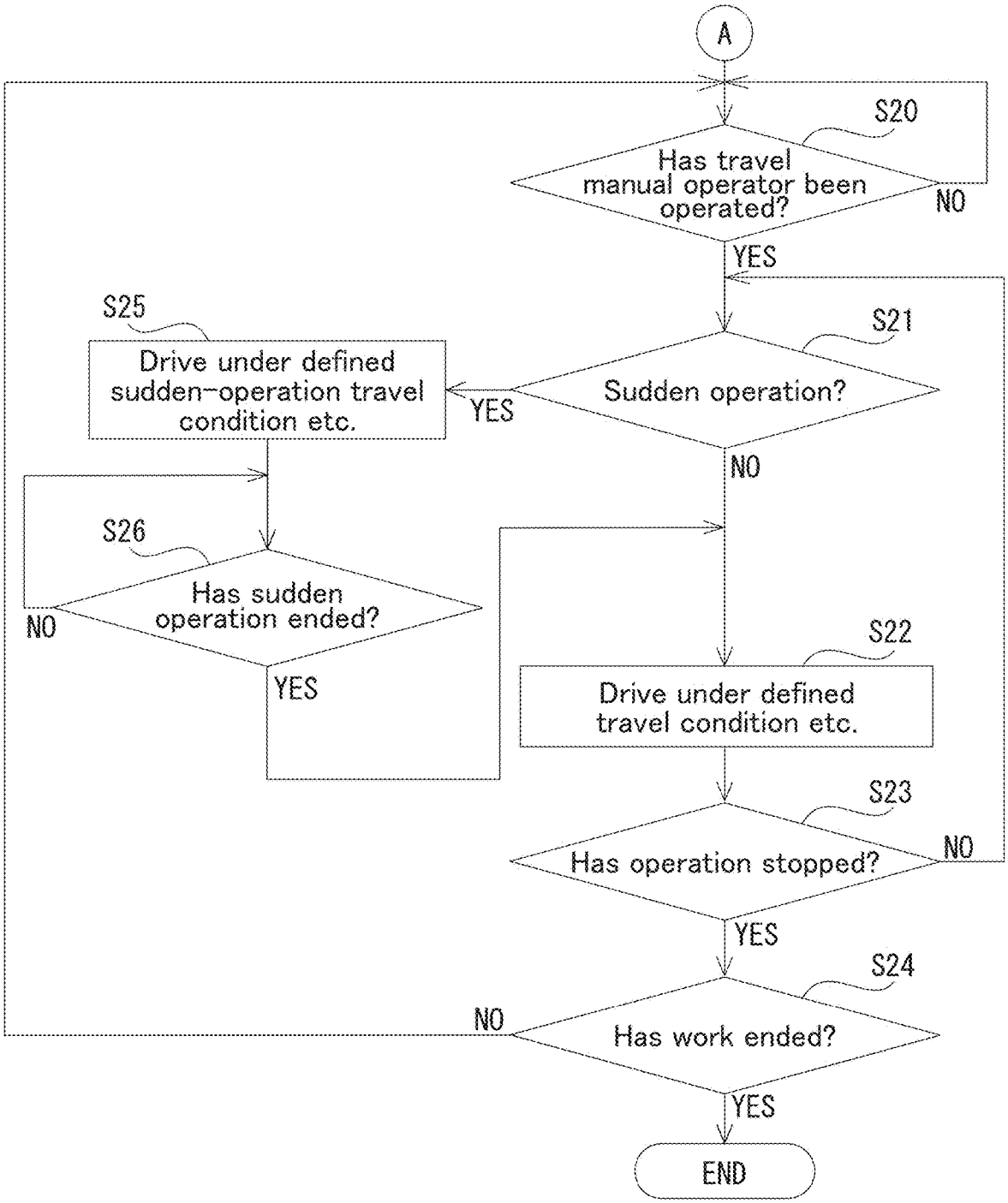
FIG. 23 is a control flowchart for a working machine according to the same example embodiment that relates to travel.

Specifically, as shown in FIG. 23, the controller 5 monitors whether or not the travel manual operator 11 (travel operating lever 110) is operated (S20). If the controller 5 determines that the travel manual operator 11 (travel operating lever 110) is operated (YES at S20), the controller 5 determines whether or not the speed of operation of the travel manual operator 11 (in the present example embodiment, the speed of pivoting of the travel operating lever 110) is faster than a predetermined speed (reference speed) (whether or not the operation of the travel manual operator 11 is a sudden operation) (S21). Note that, in the present example embodiment, the speed of operation of the travel manual operator 11 is derived based on a detection result from the Hall sensor(s) 111. That is, the controller 5 recognizes the speed of operation of the travel manual operator 11 based on the detection result from the Hall sensor(s) 111.

In so doing, the controller 5 determines that there is a sudden operation if determining that the speed of operation of the travel manual operator 11 is faster than the reference speed (YES at S21), and determines that an operation other than the sudden operation is performed if determining that the speed of operation of the travel manual operator 11 is equal to or less than the reference speed (NO at S21).

In the present example embodiment, if the controller 5 determines that the operation of the travel manual operator 11 is the sudden operation (YES at S21), the controller 5 drives the traveling devices 3 according to the sudden-operation travel condition extracted from the storing unit 50, according to the operation state of the travel manual operator 11 (S25). Specifically, if the controller 5 determines that the operation of the travel manual operator 11 is the sudden operation (YES at S21), the controller 5 drives the travel motors 60 according to the sudden-operation travel condition extracted from the storing unit 50 (S25), and determines whether or not the sudden operation has been terminated (S26). If the controller 5 determines that the sudden operation has been terminated (YES at S26), the controller 5 drives the traveling devices 3 according to the travel condition extracted from the storing unit 50 (S22).

In contrast, if the controller 5 determines that the operation of the travel manual operator 11 is not the sudden operation (NO at S21), the controller 5 drives the traveling devices 3 according to the travel condition extracted from the storing unit 50, according to the operation state of the travel manual operator 11 (S22). Specifically, if the controller 5 determines that the operation of the travel manual operator 11 is not the sudden operation (NO at S21), the controller 5 drives the travel motors 60 according to the travel condition extracted from the storing unit 50 (S22). Note that, in the present example embodiment, the travel condition includes a first travel condition for straight travel and a second travel condition for pivot turn travel. Therefore, the controller 5 determines the operation state of the travel manual operator 11 based on the detection by the Hall sensor(s) 111 and, if the controller 5 determines that the travel manual operator 11 is operated to achieve straight travel, the controller 5 drives the traveling devices 3 according to the first travel condition, and if the controller 5 determines that the travel manual operator 11 is operated to achieve pivot turn travel, the controller drives the traveling devices 3 according to the second travel condition.

As described above, the travel conditions stored in the storing unit 50 are defined based on the machine weights of work attachments 9 (load acting on the attachment mount 40), thus making it possible to achieve comfortable travel by driving the travel motors 60 according to the travel condition extracted from the storing unit 50. Furthermore, since the during-speed-change travel conditions Vf1 to Vf20 for use when the speed stage is changed from the first speed stage to the second speed stage are also defined based on the machine weights of work attachments 9 (load acting on the attachment mount 40), even when the speed stage is changed from the first speed stage to the second speed stage, it is possible to achieve travel while preventing or reducing the shocks that may be caused by the work attachment 9 (load acting on the attachment mount 40) while changing speed stages (transmission shocks).

As described above, the sudden-operation travel conditions Vg1 to Vg20 stored in the storing unit 50 are defined for respective work attachments 9 (a respective plurality of types of work attachments 9), and are each defined such that a speed change is smaller than that defined as the travel conditions for normal operations other than the sudden operation. Therefore, even if the travel manual operator 11 (travel operating lever 110) is suddenly operated, the speed is not increased suddenly but is increased at a rate suitable for the attached work attachment 9.

The controller 5 of the working machine 1 of the present example embodiment is configured or programmed to, when the work manual operator 12 is not being operated and the traveling devices 3 are traveling, if a change (one of increase and decrease) occurs in the pressure of hydraulic fluid in the first hydraulic cylinder(s) 61, the controller 5 performs a pressure absorbing process including a first process to cause the other of the increase or the decrease in the pressure of hydraulic fluid in the first hydraulic cylinder(s) 61. The pressure absorbing process includes a second process to, after the first process, cause the one of increase or the decrease in the pressure of hydraulic fluid in the first hydraulic cylinder 61. That is, the controller 5 performs the second process to cause the one of increase or the decrease in the pressure of hydraulic fluid in the first hydraulic cylinder(s) 61 after the first process.

In the present example embodiment, the controller 5 includes thresholds which are for use when the other of the increase or the decrease is caused in the pressure of hydraulic fluid in the hydraulic cylinder 61 in the first process and which are defined for a respective plurality of types of work attachments 9 attachable to the attachment mount 40. The thresholds for the respective plurality of types of work attachments 9 are defined based on the weights of the work attachments 9. The thresholds for heavier work attachments 9 are greater than the thresholds for lighter work attachments 9.

Accordingly, the controller 5 recognizes the work attachment 9 attached to or to be attached to the attachment mount 40, and, in the first process, increases or reduces the pressure of hydraulic fluid in the hydraulic cylinders 61 to the threshold corresponding to the recognized work attachments 9.

Specifically, while the traveling devices 3 are being driven (the travel manual operator 11 is being operated) while the work manual operator 12 is not being operated, the working machine 1 detects, via the pressure detector(s) 79*a*1, 79*a*2, the state of pressure of hydraulic fluid in the fluid passage(s) connected to the first hydraulic cylinders 61. The controller 5 monitors impacts acting on the arms 43 having attached to their distal portions a work attachment 9 which is a heavy object (and, in turn, the impacts on the working machine 1), based on a detection result from the pressure detector(s) 79*a*1, 79*a*2.

Of the pressures in hydraulic fluid in the pair of first supply/discharge passages R6*a* and R6*b* connecting the first hydraulic cylinders 61 and the first control valve 76, if the pressure of hydraulic fluid in the first supply/discharge passage R6*b* connected to the first ports Pa1 (the ports of the tubular cylinders 610 that are located at the bottom of the tubular cylinders 610 in the up-down direction) of the first hydraulic cylinders 61 increases, the controller 5 actuates the first control valve 76 to withdraw hydraulic fluid through the first ports Pa1 to reduce pressure. Specifically, if the pressure of hydraulic fluid in the first supply/discharge passage R6*b* connected to the first ports Pa1 of the first hydraulic cylinders 61 increases due to an impact acting in the top-to-bottom direction, the controller 5 allows the hydraulic fluid in the first hydraulic cylinders 61 and the first supply/discharge passage R6*b* to be released at the maximum flow rate in the direction in which the first hydraulic cylinders 61 retract (the first hydraulic cylinders 61 here do not actually retract). Furthermore, in the present example embodiment, the controller 5 supplies hydraulic fluid to the first hydraulic cylinders 61 and the first supply/discharge passage R6*b* in the direction in which the first hydraulic cylinders 61 extend (the first hydraulic cylinders 61 here doe not actually extend). That is, the controller 5 controls the first control valve 76 such that the arms 43 are lowered (lowering operation) and then raised (raising operation).

In so doing, the controller 5 quickly reduces pressure while gradually stopping reducing the pressure. Specifically, the controller 5 quickly increases the degree of opening of the flow passage of the first control valve 76 that is connected to the first supply/discharge passage R6*b* (the pressure of hydraulic fluid therein is higher than the other of the pair of first supply/discharge passages) in order to withdraw hydraulic fluid in the first supply/discharge passage R6*b* from the first hydraulic cylinders 61, and then gradually reduces the degree of opening. The controller 5 increases the degree of opening of the flow passage of the first control valve 76 that is connected to the first supply/discharge passage R6*a* (the pressure of hydraulic fluid therein is higher than the other of the pair of first supply/discharge passages) to supply hydraulic fluid in the first supply/discharge passage R6*a* to the first hydraulic cylinders 61, and then gradually reduces the degree of opening. Note that the controller 5 may be configured or programmed to, in the first process of the pressure absorbing process, increase the amount of movement of (distance to be moved by) the spool 761 and increase the time taken for the spool 761 to move as compared to when the pressure absorbing process is not performed.

In the present example embodiment, the first control valve 76 is configured such that the degree of opening of the passage changes as the amount of movement of (the distance moved by) the spool 761 changes. When the spool 761 is fully moved in one direction along the axial direction from the state in which the passage is blocked (where the degree of opening is 0%), the degree of opening of the passage reaches maximum and the flow rate of hydraulic fluid reaches maximum. On the contrary, when the spool 761 is fully moved in the other direction along the axial direction from the state in which the degree of opening is 100%, the flow rate of hydraulic fluid reaches minimum (zero).

In the present example embodiment, when increasing the degree of opening of the passage, the controller 5 controls the first control valve 76 such that the acceleration (speed change per unit time) is greater in half or more of the range of movement of the spool 761 in the axial direction than in the rest of the range of movement of the spool 761.

The working machine 1 of the present example embodiment performs the above-described control when the arms 43 are in a predetermined posture (an angle of rotation about a first shaft) which is within a predetermined range. Specifically, when the arms 43 are present within the range in which the downward component of the load on the distal portions of the arms 43 is large (in the present example embodiment, when the arm extension direction is within an angle of 45 degrees from a horizontal direction), the above process is performed. This makes it possible for the working machine 1 of the present example embodiment to absorb impacts (shocks) in the up-down direction during travel and to travel with a good weight balance based on the weight of the work attachment 9.

Figure 24:
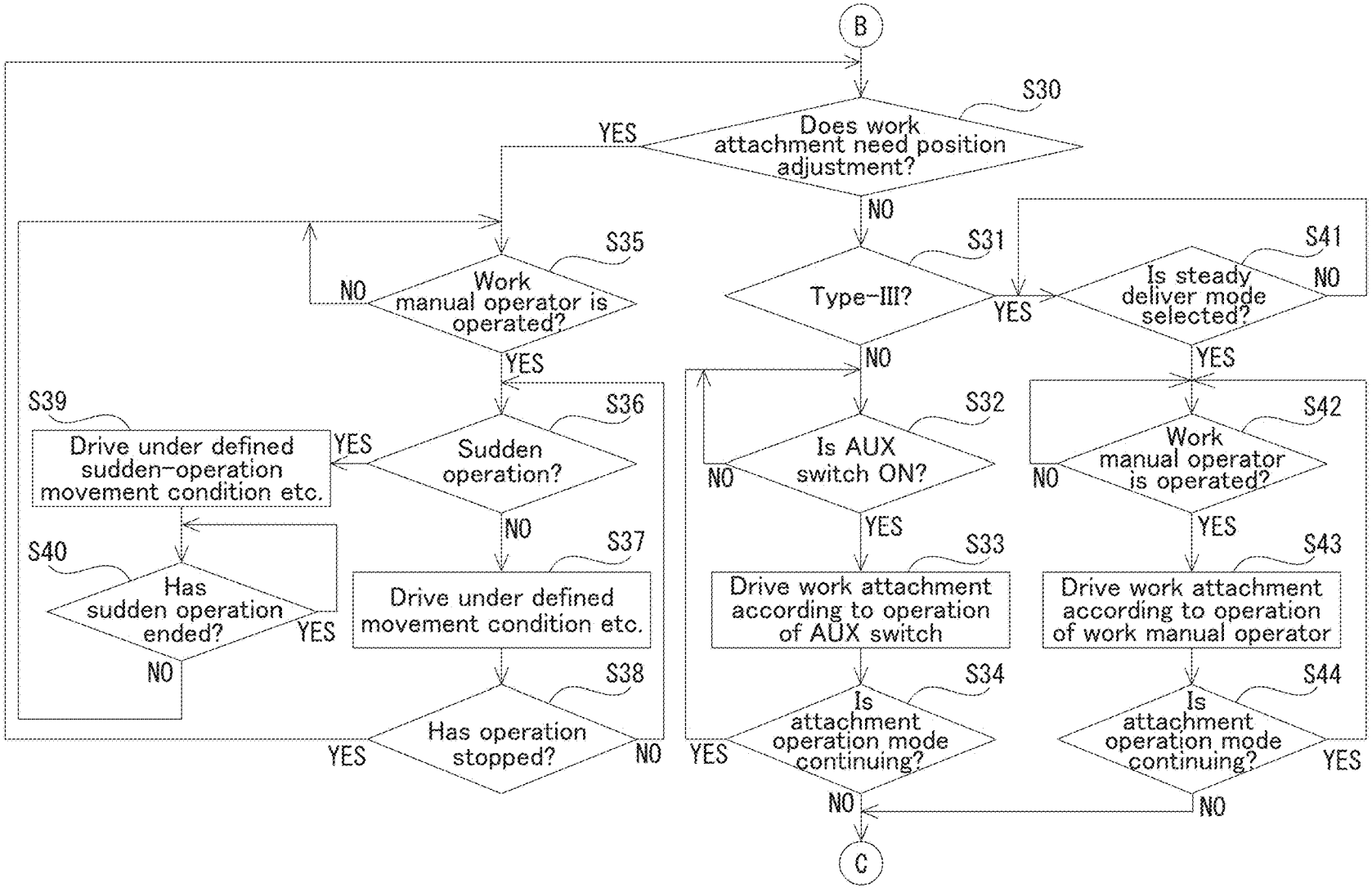
FIG. 24 is a control flowchart for a working machine according to the same example embodiment that is to actuate a work attachment (drive work attachment).

In the process (steps S1 to S10) in FIG. 22, if the controller 5 determines that the attachment operation mode is selected (YES at S3), as shown in FIG. 24, the controller 5 determines whether or not the current position of the attachment mount 40 is a reference position corresponding to the appropriate position of the work attachment 9 appropriate for work (S30). Specifically, the working machine 1 has appropriate positions of the respective plurality of types of work attachments 9 for work and their corresponding reference positions for the attachment mount 40 defined therein, and the controller 5 determines that the recognized work attachment 9 is a drive work attachment 9B and determines whether or not the attachment mount 40 is in the reference position corresponding to the appropriate position of the drive work attachment 9B. The working machine 1 of the present example embodiment includes a first angle sensor to detect the angle of rotation of the arms 43 about the first shafts S1 and a second angle sensor to detect the angle of rotation of the attachment mount 40 about the second shaft S2 (which are not illustrated), and the controller 5 recognizes the actual position and/or posture of the attachment mount 40 based on detection results from the first angle sensor and the second angle sensor.

The database stored in the storing unit 50 stores (i) appropriate positions and appropriate postures of the respective plurality of types of work attachments A1 to A20, and (ii) their corresponding first reference angles of rotation of the arms 43 about the first shafts S1 and their corresponding second reference angles of rotation of the attachment mount about the second shaft S2.

Accordingly, the controller 5 determines whether or not the drive work attachment 9B (attachment mount 40) is in the appropriate position (reference position) and in the appropriate posture by comparing the detection result from the first angle sensor with the first reference angle and comparing the detection result from the second angle sensor with the second reference angle (S30). That is, the controller 5 determines whether or not the position of the work attachment 9 should be adjusted (S30). If the controller 5 determines that the position of the work attachment 9 should be adjusted (YES at S30), the controller 5 causes the monitor M to display such.

If the controller 5 determines that the drive work attachment 9B (attachment mount 40) is in the appropriate position (reference position) and in the appropriate posture (YES at S30), the controller 5 performs the attachment operation mode (permits or allows the attachment operation mode to be performed). After the controller 5 starts performing the attachment operation mode (permits the attachment operation mode to be performed), the controller 5 monitors whether or not the work manual operator 12 is operated until the user operates the work manual operator 12 (S35). The controller 5, if determining that the work manual operator 12 is operated based on, for example, the detection result from the Hall sensor(s) 121 (YES at S35), the controller 5 next determines whether or not the operation is a sudden operation (S36).

If the operation state of the work manual operator 12 differs from the reference (for example, if the speed of operation of the work operating lever 120 per unit time is faster than the reference speed), the controller 5 determines that there is a sudden operation (YES at S36). On the contrary, if the operation state of the work manual operator 12 is the same as the reference or within the reference range, the controller 5 determines that an operation other than the sudden operation is performed (NO at S36).

If the controller 5 determines that an operation other than the sudden operation was performed (NO at S36), the controller 5 causes the attachment mount 40 to be raised/lowered and/or tilted according to the movement condition (ascending/descending condition, tilting condition) extracted from the storing unit 50 (S37). Specifically, if the controller 5 determines that an operation other than the sudden operation was performed (NO at S36), causes at least one of the first hydraulic cylinders 61 or the second hydraulic cylinders 62 to extend or retract to satisfy the movement condition (ascending/descending condition, tilting condition) extracted from the storing unit 50. Note that the first hydraulic cylinders 61 and the second hydraulic cylinders 62 each extend or retract based on the operation state of the work manual operator 12 (the manner in which the work operating lever 120 is pivoted). The controller 5 determines whether or not the work manual operator 12 is operated based on the detection result from the Hall sensor(s) 121 (S38).

The controller 5 then, if determining that the operation of the work manual operator 12 is stopped based on whether or not a signal is inputted from the Hall sensor(s) 121 (YES at S38), the controller 5 determines whether or not the drive work attachment 9B is in a position and posture that are appropriate for work (S30). Specifically, the controller 5 determines, although the attachment operation mode is selected, whether or not the drive work attachment 9B in a position that allows the attachment operation mode to be performed. The controller 5, if determining that the sudden operation was performed (YES at S36), causes the attachment mount 40 to be raised/lowered and/or tilted according to the sudden-operation movement condition extracted from the storing unit 50 (S39). The controller 5 then determines whether or not the sudden operation has been terminated based on whether or not the work manual operator 12 is operated (based on the presence or absence of the detection result from the Hall sensor(s) 121) (S40). If the controller 5 determines that the sudden operation has been terminated (NO at S40), the controller 5 again monitors whether or not the work manual operator 12 is operated (S45) and repeats the above process (steps S35 to S40).

The controller 5, as described earlier, determines whether or not the drive work attachment 9B is in a position and posture that are appropriate for work (S30), and, if determining that the drive work attachment 9B is in a position and posture that are appropriate for work (determining that no adjustment is necessary, NO at S30), determines whether the work attachment 9B attached to the attachment mount 40 is a type-I drive work attachment 9Ba, a type-II drive work attachment 9Bb, or a type-III drive work attachment 9Bc (S31). Note that, although it is apparent from the above description, the attachment operation mode is selected only for drive work attachments 9B, and that the steps (S4 to S10) performed after the controller 5 determines that the attachment operation mode is not selected (NO at S3 in FIG. 22) are steps (operations) performed for non-drive work attachments 9A.

Referring back to FIG. 24, if the controller 5 determines that it is not necessary to adjust the position of the drive work attachment 9B (S30), the controller 5 determines whether the drive work attachment 9B attached to the attachment mount 40 is a type-I drive work attachment 9Ba, a type-II drive work attachment 9Bb, or a type-III drive work attachment 9Bc (S31).

The controller 5 then, if determining that the drive work attachment 9B attached to the attachment mount 40 is not a type-III drive work attachment 9Bc (determines that the drive work attachment 9B attached to the attachment mount 40 is a type-I drive work attachment 9Ba or a type-II drive work attachment 9Bb) (NO at S31), the controller 5 monitors whether or not the AUX switch 85 is operated (S32), and, if the AUX switch 85 is operated (YES at S32), drives the type-I drive work attachment 9Ba or the type-II drive work attachment 9Bb based on the operation of the AUX switch 85. Specifically, the controller 5 causes hydraulic fluid to be supplied or stopped being supplied to the hydraulic cylinder 95 of the type-I drive work attachment 9Ba or the hydraulic motor 96 of the type-II drive work attachment 9Bb according to the operation (turning ON or turning OFF) of the AUX switch 85.

The controller 5 then determines whether or not the attachment operation mode continues (S34), and, as long as the attachment operation mode continues (YES at S34), the controller 5 accepts the operation of the AUX switch 85 and causes hydraulic fluid to be supplied or stopped being supplied to the hydraulic cylinder 95 of the type-I drive work attachment 9Ba or the hydraulic motor 96 of the type-II drive work attachment 9Bb according to the operation (turning ON or turning OFF) of the AUX switch 85.

Note that, with regard to ending the attachment operation mode, for example, the attachment operation mode may be ended by operating the travel manual operator 11 or the work manual operator 12 in a specific manner (in a manner not relating to driving the type-I drive work attachment 9Ba or the type-II drive work attachment 9Bb (or work)), and may be ended by entering input into the monitor M. In the present example embodiment, the attachment operation mode is to be ended by operating the travel manual operator 11 or the work manual operator 12 in a specific manner (in a manner not relating to driving the type-I drive work attachment 9Ba or the type-II drive work attachment 9Bb (or work)), and the controller 5 determines that the attachment operation mode has ended (NO at S34).

On the other hand, the controller 5, if determining that the drive work attachment 9B attached to the attachment mount 40 is a type-III drive work attachment 9Bc (YES at S31), determines whether or not the steady deliver mode is selected. Specifically, if the controller 5 determines that the drive work attachment 9B attached to the attachment mount 40 is a type-III drive work attachment 9Bc (YES at S31), the controller 5 causes the monitor M to display a notification requesting to change the mode to the steady deliver mode (requesting to operate the AUX switch 85 in a specific manner).

Note that, for the type-III drive work attachment 9Bc, the fluid passages 90 (couplers 94) of the work attachment 9 should be connected to the AUX ports 75*a*, 75*b*, and/or 75*c*, and the solenoids 97*c* of the control valve 97 should be connected to the controller 5 via the control lines CL1 and CL2. Therefore, in the present example embodiment, if the above connections have not been made, the controller 5 causes the monitor M to display a notification requesting to make such connections, and if the connections have been made, the controller 5 causes the monitor M to display a notification requesting to change the mode to the steady deliver mode (requesting to operate the AUX switch 85 in a specific manner).

Accordingly, the controller 5, provided that the fluid passages 90 (couplers 94) of the work attachment 9 are already connected to the AUX ports 75*a*, 75*b*, and/or 75*c* and the solenoids 97*c* of the control valve 97 are already connected to the controller 5 via the control lines CL1 and CL2, monitors whether the steady deliver mode is entered, and if determining that the steady deliver mode is entered (YES at S41), the controller 5 next monitors whether or not the work manual operator 12 (work operating lever 120) is operated (S32), and, if the work manual operator 12 (work operating lever 120) is operated (YES at S42), drives the type-III drive work attachment 9Bc based on the operation of the work manual operator 12 (work operating lever 120) (S43). That is, the controller 5 causes hydraulic fluid to be supplied or stopped being supplied to the hydraulic cylinder 95 of the type-III drive work attachment 9Bc according to the operation of the work manual operator 12 (work operating lever 120). Note that, since the hydraulic motor 96 of the type-III drive work attachment 9Bc is supplied constantly with hydraulic fluid during the steady deliver mode, the type-III drive work attachment 9Bc is driven constantly irrespective of the operation of the work manual operator 12 (work operating lever 120).

Specifically, if the work attachment 9 recognized by the controller 5 is an angle broom A15 which is a type-III drive work attachment 9Bc, during travel achieved by the traveling devices 3, hydraulic fluid is constantly supplied from the AUX ports 75*a*, 75*b*, and/or 75*c* to the hydraulic motor 96, so that the rotary brush 901 is driven to rotate and brush the litter and dust away from the road. When the direction in which the rotary brush 901 brushes the litter and dust is to be changed, the user operates the work manual operator 12 (work operating lever 120) to cause the controller 5 to output an output signal corresponding to the operation state of the work manual operator 12 (work operating lever 120) toward the control valve 97 (solenoid 97*c*) of the angle broom A15 which is a type-III drive work attachment 9Bc. Accordingly, the control valve 97 of the angle broom A15 moves the spool 97*a* to a position corresponding to the operation state of a work manual operator (work operating lever 120). With this, the hydraulic cylinder 95 of the angle broom A15 extends or retracts, and the posture (orientation) of the rotary brush 901 is changed as the work manual operator 12 (work operating lever 120) is operated.

If the work attachment 9 recognized by the controller 5 is a snow blower A18 which is a type-III drive work attachment 9Bc, during travel achieved by the traveling devices 3, hydraulic fluid is constantly supplied from the AUX ports 75*a*, 75*b*, and/or 75*c* to the hydraulic motors 96 (96*a*, 96*b*), so that an auger 923 and a feed impeller 927 are driven to rotate and snow on the road is released through the discharge port of a discharge passage 926. When the orientation of the discharge port of the discharge passage 926 is to be changed, the user operates the work manual operator 12 (work operating lever 120) to cause the controller 5 to output an output signal corresponding to the operation state of the work manual operator 12 (work operating lever 120) toward the solenoid(s) 97*c* of the type-III drive work attachment 9Bc. Accordingly, the spool 97*a* of the control valve 97 of the type-III drive work attachment 9Bc moves to a position corresponding to the operation state of the work manual operator 12 (work operating lever 120). With this, the hydraulic cylinder 95 of the snow blower A18 extends or retracts, and the orientation (height) of the discharge passage 926 is changed as the work manual operator 12 (work operating lever 120) is operated.

The controller 5 then determines whether or not the attachment operation mode continues (S44), and, as long as the attachment operation mode continues (YES at S44), accepts the operation (turning ON or OFF) of the work manual operator 12 (work operating lever 120), and causes hydraulic fluid to be supplied or stopped being supplied to the hydraulic cylinder 95 of the type-I drive work attachment 9Ba according to the operation of the work manual operator 12 (work operating lever 120). Note that, with regard to ending the attachment operation mode, for example, similar to the cases described earlier, the attachment operation mode may be ended by operating the travel manual operator 11 or the work manual operator 12 in a specific manner (in a manner not relating to driving the type-I drive work attachment 9Ba or the type-II drive work attachment 9Bb (or work)), and may be ended by entering input into the monitor M. In the present example embodiment, the attachment operation mode is to be ended and also the steady deliver mode is to be ended by operating the AUX switch 85 in a specific manner.

Specifically, the controller 5 determines that the attachment operation mode has ended upon receipt of an input signal based on the specific operation of the AUX switch 85 (NO at S34). The controller 5 then, if determining that the attachment operation mode has ended (NO at S34), returns to "C" in FIG. 22 and performs the subsequent steps (S4 to S9). That is, the controller 5 monitors whether the operation of the work manual operator 12 is resumed and performs steps (S4 to S9, END).

Note that it is to be understood that the present invention is not limited to example embodiments described above, and may be modified within the gist of the present invention.

For example, in the foregoing example embodiments, the travel motors 60 (drive sources) to drive a pair of traveling devices 3 independently of each other are hydraulic motors, but this does not imply any limitation. For example, in another example embodiment of the present invention, electric motor(s) may be used as the drive sources to drive a pair of traveling devices 3. Also in such a case, the controller 5 may control the output of the electric motors which are travel motors 60 (drive sources), making it possible to achieve the same effects as the foregoing example embodiments.

In the foregoing example embodiments, a compact track loader including crawler traveling devices 3 is discussed as an example of the working machine 1, but the working machine 1 is not limited to such. For example, in another example embodiment of the present invention, the working machine 1 may include tire (wheel) traveling devices 3.

In such a case, the traveling devices 3 may include a pair of left and right front wheels and a pair of left and right rear wheels, one of which is driving wheels 31 to be driven by hydraulic motor(s) and the other of which is steering wheels. The tire (wheel) traveling devices 3 may include a pair of left and right front wheels and a pair of left and right rear wheels each of which are driving wheels 31 to be driven by drive motor(s) (travel motors 60), and the direction of travel may be changed by generating a difference in rotation speed between the wheels (so-called skid-steer loader). Also in such a case, drive motors (travel motors 60) are provided for the respective driving wheels 31 so that the pair of left and right driving wheels 31 are driven independently of each other. The working machine 1 need only include a work attachment 9 including a functioning portion 92, and may be some other construction machine, agricultural machine, utility vehicle (UV), or the like.

In the foregoing example embodiments, the seat protection structure 22 of the working machine 1 is a cabin 22 defining an operation cab OR (space having specified dimensions in the lateral direction, front-rear direction, and height direction) including a seat 21 therein. Note, however, that this does not imply any limitation. For example, in another example embodiment of the present invention, the seat protection structure 22 may be a so-called canopy or rollover protection structure (ROPS) including pillars provided upright on the frame chassis 20 and a roof supported above the seat 21 by the pillars.

In the foregoing example embodiments, a diesel engine is used as the prime mover 10 to drive hydraulic pumps, but this does not imply any limitation. In another example embodiment of the present invention, the prime mover 10 may be some other internal combustion engine such as a gasoline engine or hydrogen engine. The prime mover 10 may be an electric motor instead of the internal combustion engine. That is, the first hydraulic pump 63, the second hydraulic pump 66, and the third hydraulic pump 74 may be electric hydraulic pumps.

In the foregoing example embodiments, the work operating lever 120 is pivotable forward, rearward, leftward, and rightward from the neutral position, but this does not imply any limitation. For example, in another example embodiment of the present invention, the work operating lever 120 may be pivotable in four diagonal directions from the neutral position, and may be operable to, when pivoted in such a diagonal direction, actuate the hydraulic actuator 95 based on the direction in which the work operating lever 120 is pivoted. The work operating lever 120 may be pivotable forward, rearward, leftward, and rightward, and in four diagonal directions from the neutral position, and may be operable to actuate the hydraulic actuator 95 based on the direction in which the work operating lever 120 is pivoted. In cases where the travel operating lever 110 is pivotable forward, rearward, leftward, and rightward, and in four diagonal directions as such, the number of manners in which the hydraulic actuator 95 is actuated can be increased.

In the foregoing example embodiments, whether or not the arms 43 have moved up or down (vibrated) is determined based on a change in pressure (detection result from pressure detector(s) 79*a*1, 79*b*2) of hydraulic fluid in the first supply/discharge passage(s) R6*a* and/or R6*b* connected to the first hydraulic cylinders 61, but this does not imply any limitation. For example, in another example embodiment of the present invention, the working machine 1 may include an acceleration sensor to detect the acceleration of the arms 43 along the up-down direction, and the controller 5 may determine whether or not the arms 43 have moved up or down (vibrated) based on the acceleration along the up-down direction detected by the acceleration sensor. In such a case, the controller 5 may be configured or programmed to calculate (estimate) the amount of movement of the arm s43 along the up-down direction in addition to determining whether or not the arms 43 have moved up or down, based on the acceleration detected by the acceleration sensor. In such a case, the controller 5 may be configured or programmed to perform the pressure absorbing process if determining that the acceleration in the upward direction along the up-down direction detected by the acceleration sensor is equal to or greater than a prescribed value, and, in the first process, increase the amount of movement of (the distance to be moved by) the spool 761 and increase the time taken for the spool 761 to move as compared to cases where the pressure absorbing process is not performed, similar to the foregoing example embodiments.

In the foregoing example embodiments, whether or not the arms 43 have moved up or down (vibrated) is determined constantly while the work manual operator 12 is not operated and the travel manual operator 11 is being operated (while the traveling devices 3 are traveling), and the pressure absorbing process is performed. Note, however, that this does not imply any limitation. For example, in another example embodiment of the present invention, the working machine 1 may include a switch to be operated to switch between performing or not performing the pressure absorbing process, and the controller 5 may be configured or programmed to perform the pressure absorbing process based on the operation of the switch.

Accordingly, the controller 5 may be configured or programmed to, under the condition in which the controller 5 has recognized that a work attachment 9 including a fork F for placement of a cargo B is attached to the attachment mount 40 and the switch has been operated to select performing the pressure absorbing process, determine whether or not the cargo B is placed on the fork F based on the pressure of hydraulic fluid in the hydraulic cylinders 61, and, if the controller 5 determines that the cargo B is placed on the fork F, perform the pressure absorbing process.

In the foregoing example embodiments, a mechanical (analog) operator including a travel operating lever 110 is used as the travel manual operator 11 to be operated in relation to travel (traveling devices 3) of the machine body 2, and accordingly the travel-related hydraulic circuit 6A includes the pump control valves 67 which are operably connected to the travel operating lever 110 and which are operable to control the flow of pilot hydraulic fluid to adjust the flow rate (delivery flow rate) of the second hydraulic pump 66. Note, however, that this does not imply any limitation. For example, in another example embodiment of the present invention, an electronic (digital) operator may be used as the travel manual operator 11, and the controller 5 may be configured or programmed to adjust the delivery flow rate of the second hydraulic pump 66 (variable displacement hydraulic pump) based on the operation of the electronic (digital) operator.

Figure 25:
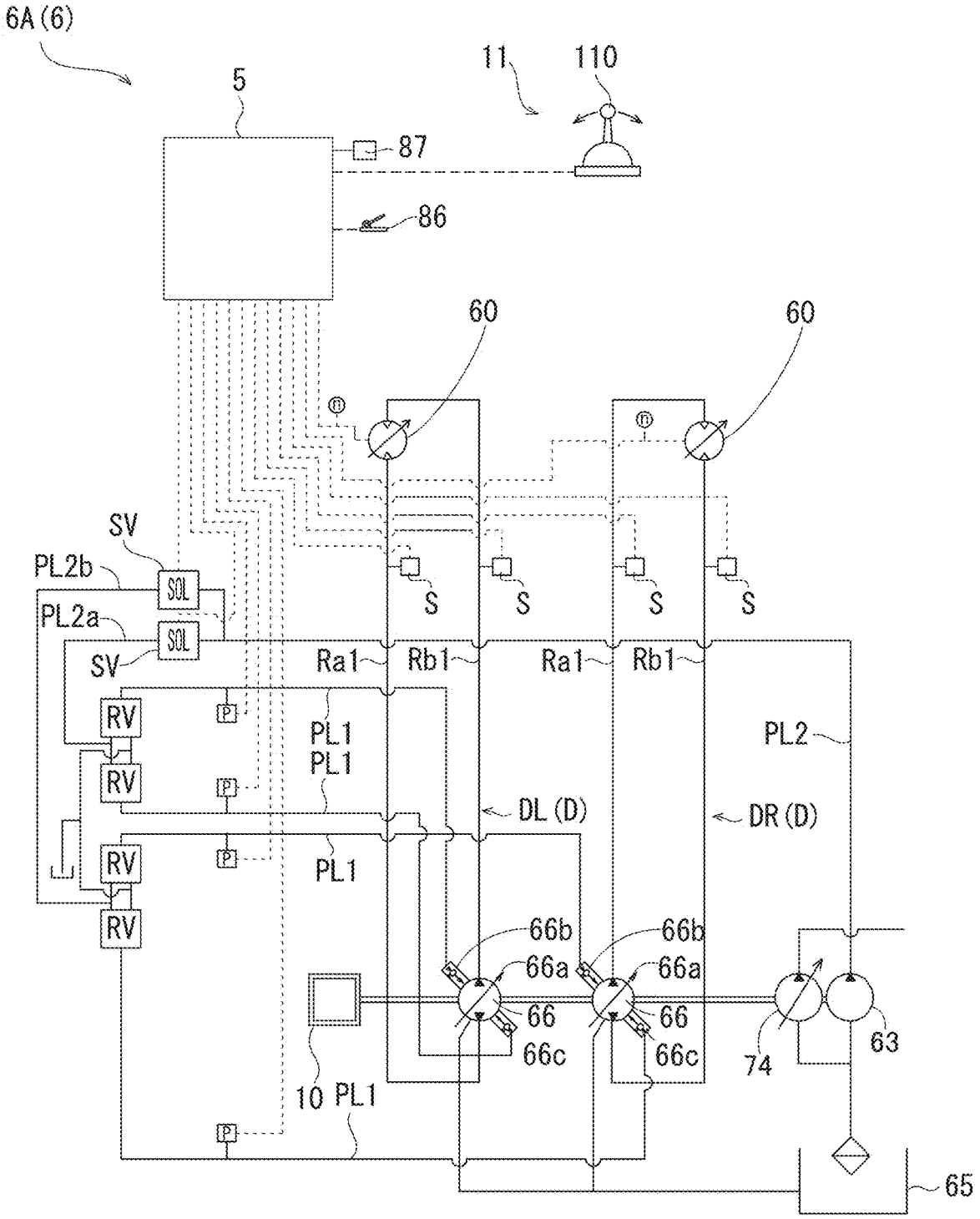
FIG. 25 schematically illustrates a travel-related hydraulic circuit of a hydraulic circuit of a working machine according to another example embodiment of the present invention.

The following details the configuration of the travel manual operator 11 and the travel-related hydraulic circuit 6A in such a case. As illustrated in FIG. 25, the travel manual operator 11 is an electronic (digital) operator (such as a joystick) electrically connected to the controller 5 in a wired or wireless manner. That is, when the travel manual operator 11 is wirelessly communicable with the controller 5, the travel manual operator 11 can be located at a position within the cabin 22 of the working machine 1, outside the cabin 22, or a position remote from the working machine 1 and can be used to remotely control the controller 5. The travel motors 60 and the second hydraulic pumps 66 of the travel-related hydraulic circuit 6A are the same as those of the foregoing example embodiments. That is, the travel motors 60 are variable displacement hydraulic motors, and the second hydraulic pumps 66 to supply hydraulic fluid to the travel motors 60 are variable displacement pumps each of which includes a movable swash plate 66*a* and a pair of pressure receivers 66*b* and 66*c* to change the angle and direction of tilting of the movable swash plate 66*a* and which are driven by (upon receipt of output from) the prime mover 10. Accordingly, the pair of first supply/discharge passages R6*a* and R6*b* connecting the second hydraulic pumps 66 and the travel motors 60 are provided with respective pressure sensors S to detect (measure) the pressure of hydraulic fluid supplied from the second hydraulic pumps 66 to the travel motors 60. The pressure sensors S are electrically connected to the controller 5, and output the value of the detected pressure of hydraulic fluid as an electric signal to the controller 5 upon each detection. That is, the pressure sensors S detect the pressure of hydraulic fluid as a travel load on the travel motors 60, and output it to the controller 5.

Furthermore, the travel-related hydraulic circuit 6A includes a first hydraulic pump 63 to deliver pilot hydraulic fluid, a plurality of (four) pilot lines PL1 (pilot fluid passages) which are respectively connected to pairs of pressure receivers 66*b* and 66*c* of a pair of second hydraulic pumps 66 (a second hydraulic pump 66 for the first drive DR and a second hydraulic pump 66 for the second drive DL) and which supply pilot hydraulic fluid from the first hydraulic pump 63 to the pressure receivers 66*b* and 66*c* of the second hydraulic pumps 66, and a plurality of (four) remote control valves RV which are provided for the respective plurality of (four) pilot lines PL1 and which are electrically connected to the controller 5 to adjust the pressure of pilot hydraulic fluid flowing through the plurality of pilot lines PL1 based on an instruction from the controller 5. Since the plurality of remote control valves RV adjust the pressure of pilot hydraulic fluid in the respective pilot lines PL1 based on an instruction from the controller 5 as such, the pair of second hydraulic pumps 66 supply hydraulic fluid at a delivery flow rate corresponding to the instruction from the controller 5 to the travel motors 60. Therefore, the pair of travel motors 60 are in the drive state corresponding to the operation of the travel manual operator 11, and/or in the drive state corresponding to an instruction from the controller 5 irrespective of the operation of the travel manual operator 11. This makes it possible to achieve control similar to the foregoing example embodiments.

The travel-related hydraulic circuit 6A may be configured such that the pilot line PL2 connected to the first hydraulic pump 63 is divided, at an intermediate portion thereof, into pilot lines PL2*a* and PL2*b* (into two routes), one of which (pilot line PL2*a*) is connected to two remote control valves RV corresponding to two pilot lines PL1 which are connected to one second hydraulic pump 66 (second hydraulic pump 66 for the first drive DR) and the other of which (pilot line PL2*b*) is connected to two remote control valves RV corresponding to two pilot lines PL1 which are connected to the other second hydraulic pump 66 (second hydraulic pump 66 for the second drive DL).

In such a case, the pilot lines PL2*a* and PL2*b* (the two routes) may be provided with pressure regulating solenoid valves SV to regulate (adjust) the pressure of pilot hydraulic fluid flowing through the pilot lines PL2*a* and PL2*b* to a preset pressure in accordance with an instruction from the controller 5. With this, the pressure of pilot hydraulic fluid in the grouped pilot lines PL2*a* and PL2*b* (two routes) can have a pressure value set between the maximum delivery pressure and the minimum delivery pressure of the first hydraulic pump 63 in accordance with an instruction from the controller 5, making it possible to change the range within which the pressure is adjustable by the downstream remote control valves RV. This makes it possible to drive the pair of second hydraulic pumps 66 independently of each other, and possible to change the delivery flow rate of hydraulic fluid in each second hydraulic pump 66 based on the travel status of the working machine 1 (traveling devices 3).

The work manual operator 12 and the travel manual operator 11 include mechanical operating levers 110 and 120 (a work operating lever 120 and a travel operating lever 110), respectively, but this does not imply any limitation. For example, in another example embodiment of the present invention, at least one of the work manual operator 12 or the travel manual operator 11 may be a joystick including an operating lever 110, 120. In such a case, the work manual operator 12 and/or the travel manual operator 11 (joystick(s)) is/are electrically connected to the controller 5, and transmit(s), to the controller 5, a signal corresponding to the direction and amount (angle) of pivoting of the operating lever 110, 120.

Figure 26:
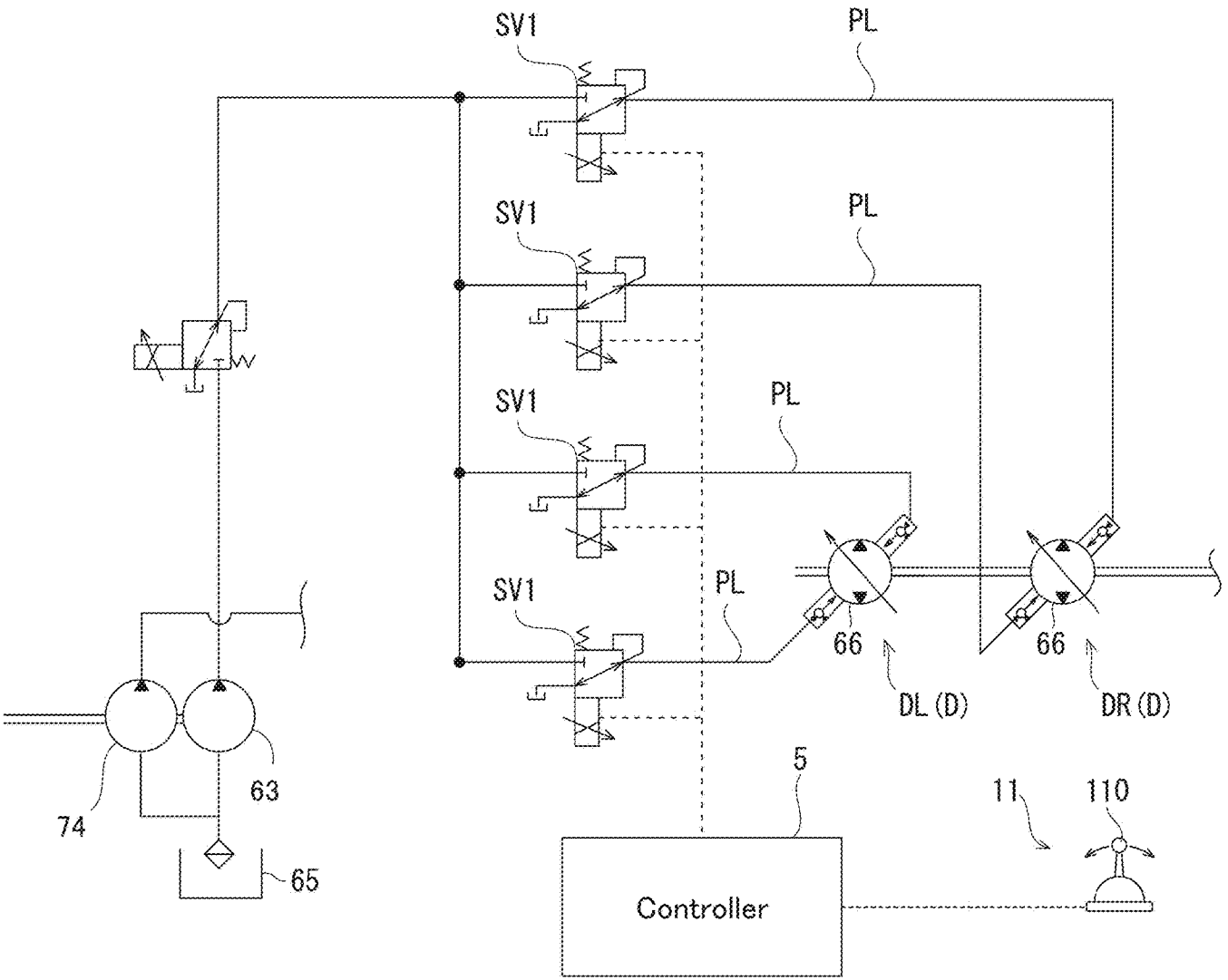
FIG. 26 schematically illustrates a travel-related hydraulic circuit of a hydraulic circuit of a working machine according to a further example embodiment of the present invention.

Instead of the travel-related hydraulic circuit 6A in FIG. 25, a travel-related hydraulic circuit 6A including a circuit structure illustrated in FIG. 26 may be used. Note that the travel motors 60 and the second hydraulic pumps 66 in FIG. 26 are connected in the same manner as in the travel-related hydraulic circuit 6A in FIG. 25, although the travel motors 60 in FIG. 26 are not illustrated. Thus, also in the travel-related hydraulic circuit 6A including the circuit structure illustrated in FIG. 26, the pair of fluid passages Ra1 and Rb1 connecting the second hydraulic pumps 66 and the travel motors 60 are provided with respective pressure sensors S to detect (measure) the pressure of hydraulic fluid supplied from the second hydraulic pumps 66 to the travel motors 60, and rotation sensors to measure the rotation speed of the travel motors 60 are provided. With this, it is possible to determine the status of the machine body 2 similar to the foregoing example embodiments.

Specifically, the travel-related hydraulic circuit 6A includes a first hydraulic pump 63 to deliver pilot hydraulic fluid, a plurality of (four) pilot lines PL (pilot fluid passages) which are respectively connected to pairs of pressure receivers 66*b* and 66*c* of a pair of second hydraulic pumps 66 (a second hydraulic pump 66 for the first drive DR and a second hydraulic pump 66 for the second drive DL) and which supply pilot hydraulic fluid from the first hydraulic pump 63 to the pressure receivers 66*b* and 66*c* of the second hydraulic pumps 66, and a plurality of (four) solenoid proportional valves SV1 which are provided for the respective plurality of (four) pilot lines PL and which are electrically connected to the controller 5 to adjust the pressure of pilot hydraulic fluid flowing through the plurality of pilot lines PL based on an instruction from the controller 5. With this, since the solenoid proportional valves SV1 are electrically controlled by the controller 5 to accurately control the flow of hydraulic fluid (pilot fluid) in the pilot lines PL, the pair of second hydraulic pumps 66 (the second hydraulic pump 66 for the first drive DR and the second hydraulic pump 66 for the second drive DL) are driven appropriately depending on the conditions. Also in such a case, the travel manual operator 11 may include an electronic (digital) operator (such as a joystick) electrically connected to the controller 5 in a wired or wireless manner. That is, when the travel manual operator 11 is wirelessly communicable with the controller 5, the travel manual operator 11 can be located at a position within the cabin 22 of the working machine 1, outside the cabin 22, or a position remote from the working machine 1 and can be used to remotely control the controller 5.

Figure 27:
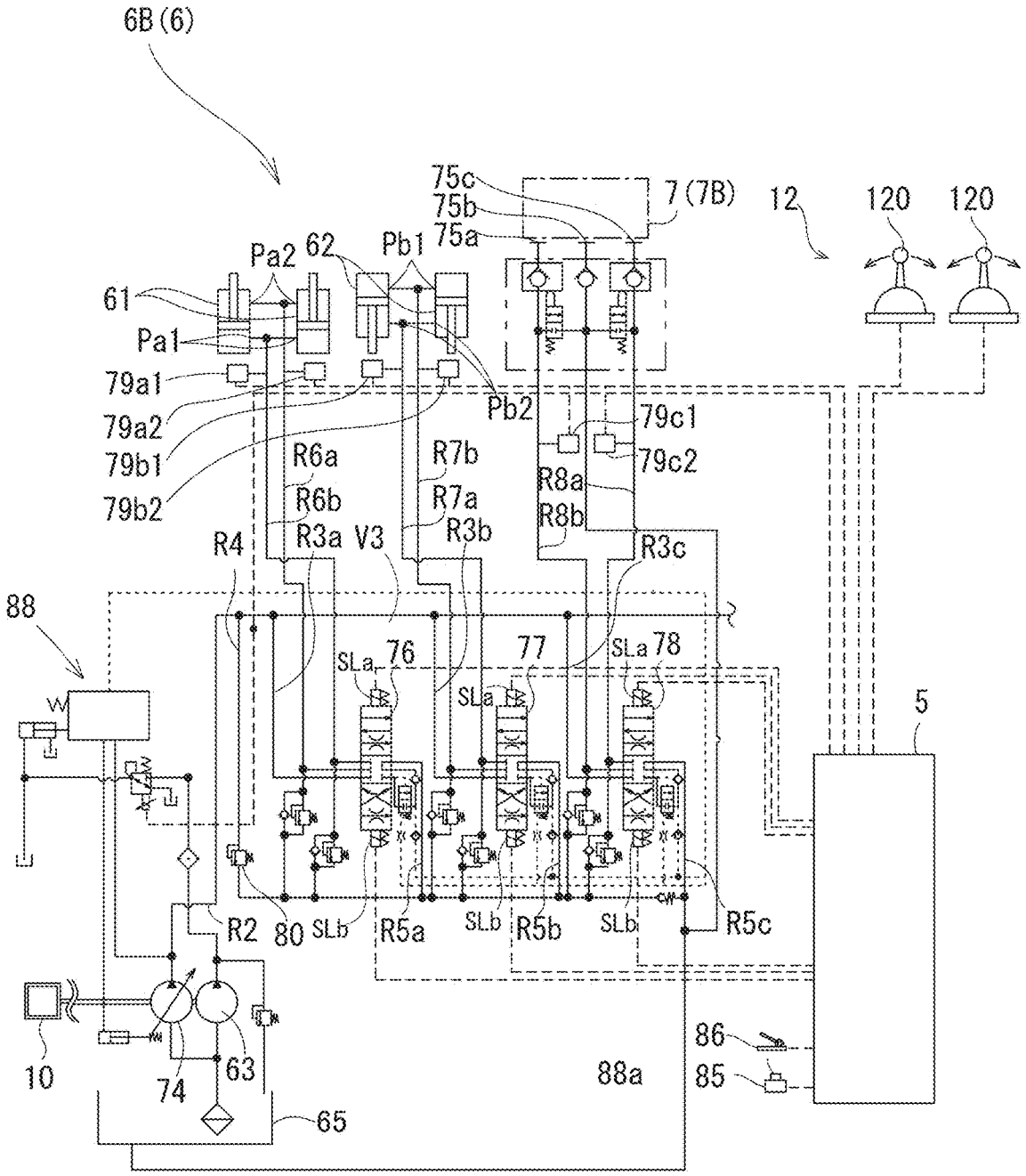
FIG. 27 schematically illustrates a work-related hydraulic circuit of a hydraulic circuit of a working machine according to a further example embodiment of the present invention.

In the work-related hydraulic circuit 6B in the foregoing example embodiments, the control valves to control hydraulic actuators 95 (the first hydraulic cylinders 61, the second hydraulic cylinders 62, and the hydraulic cylinders of the work attachment 9) are pilot-operated control valves to be actuated by the pressure of pilot hydraulic fluid (hydraulic fluid). Note, however, that this does not imply any limitation. For example, in another example embodiment of the present invention, as illustrated in FIG. 27, the control valves 76, 77, 78 to control hydraulic actuators 95 (the first hydraulic cylinders 61, the second hydraulic cylinders 62, and the work attachment 9) may be solenoid valves (solenoid control valves) to be actuated upon receipt of an electric signal (electric current).

Specifically, the control valve 76 may include electromagnetic solenoids SLa, SLb electrically connected to the controller 5 instead of the pressure receivers 76*a*, 76*b*, 77*a*, 77*b*, 78*a*, 78*b* to receive the pressure of pilot hydraulic fluid. In such a case, the work manual operator 12 may include a joystick which includes a work operating lever 120, which is electrically connected to the controller 5, and which transmits an electric signal corresponding to the operation (pivot) of the work operating lever 120. Also in such a case, the controller 5 controls the control valves 76, 77, 78 to cause the hydraulic cylinders (first hydraulic cylinders 61, second hydraulic cylinders 62) to extend or retract based on the manner in which the work operating lever 120 is operated, similar to the foregoing example embodiments. In the case where the pressure absorbing process is performed, the controller 5 controls the control valves 76, 77 and performs steps (processes) similar to the foregoing example embodiments, irrespective of the operation of the work operating lever 120.

In the working machine 1 according to the foregoing example embodiments, the controller 5 performs the pressure absorbing process when the work manual operator 12 is not being operated and the traveling devices 3 are traveling, irrespective of the posture of the arms 43 (position of the work attachment 9), but this does not imply any limitation. For example, in another example embodiment of the present invention, the posture of the arms 43 appropriate for travel by the traveling devices 3 may be defined for each of the plurality of types of work attachments 9 attachable to the attachment mount 40, and the controller 5 may be configured or programmed to recognize the work attachment 9 attached to the attachment mount 40, and perform the pressure absorbing process when the arms 43 are in the posture appropriate for the recognized work attachment 9, i.e., perform the pressure absorbing process only when the work attachment 9 is in the conditions in which the work attachment 9 can maximize or substantially maximize its performance and function.

In the foregoing example embodiments, the controller 5 is configured or programmed to indirectly recognize at least one of (i) a load acting on the attachment mount 40 or (ii) the presence or absence of the load, associate a travel condition corresponding to the recognized load with the operation state of the manual operator 11, and actuate the traveling devices 3 according to the travel condition associated with the operation state as the manual operator 11 is operated. Note, however, that this does not imply any limitation. For example, the controller 5 may be configured or programmed to directly recognize at least one of a load acting on the attachment mount 40 or the presence or absence of the load using a sensor such as a load cell, associate a travel condition corresponding to the recognized load with the operation state of the manual operator 11, and, actuate the traveling devices 3 according to the travel condition associated with the operation state as the manual operator 11 is operated.

In another example embodiment, the controller 5 may be configured or programmed to directly or indirectly recognize the moment about the pivot of the attachment mount 40 (more specifically, the moment about a joint (second shaft S2) at which the attachment mount 40 is connected to the arms 43), associate a travel condition corresponding to the recognized moment with the operation state of the manual operator 11, and actuate the traveling devices 3 according to the travel condition associated with the operation state as the manual operator 11 is operated.

It is noted here that the moment about the pivot of the attachment mount 40 is, when no work attachments 9 are attached to the attachment mount 40, the product of the distance from the pivot (second shaft S2) of the attachment mount 40 to the center of gravity of the attachment mount 40 and the weight of the attachment mount 40 acting at the center of gravity, and is, when a work attachment 9 is attached to the attachment mount 40, the product of the distance from the pivot (second shaft S2) of the attachment mount 40 to the center of gravity of the combination of the attachment mount 40 and the work attachment 9 and the total weight of the attachment mount 40 and the work attachment 9 acting at the center of gravity. Note that, in cases where the work attachment 9 is operable to have a cargo B placed thereon like a pallet fork A2, the moment is preferably the product of the distance from the pivot (second shaft S2) of the attachment mount 40 to the center of gravity of the combination of the attachment mount 40, the work attachment 9, and the cargo B and the total weight of the attachment mount 40, the work attachment 9, and cargo B acting at the center of gravity.

Also in such a case, the weight (load) and the center of gravity of the work attachment 9 and the attachment mount 40, and the distance from the pivot (second shaft S2) of the attachment mount 40 to the center of gravity, can be calculated theoretically (can be obtained in the design phase). Therefore, similar to using the load as described in the foregoing example embodiments, recognizing the presence/absence and/or the type of work attachment 9 can be regarded as recognizing moment (it is possible to indirectly recognize the moment). That is, also with regard to moment, it is not always necessary to recognize the moment numerically (directly). Thus, similar to the foregoing example embodiments, provided that a plurality of types of work attachments 9 (A1 to A20) are recorded in the storing unit 50, it is only necessary that the plurality of types of work attachments 9 (A1 to A20) be regarded as respective moments about the pivot (second shaft S2) of the attachment mount 40 and that the travel conditions Ve1 to Ve20 be stored in the storing unit 50 such that they correspond to the respective plurality of types of work attachments 9. Note, however, that the travel conditions Ve1 to Ve20 stored in the storing unit 50 are defined based on the moments (in consideration of the moments).

Since a moment not only involves a load but also a distance (the distance from the pivot (second shaft S2) to the center of gravity), the travel conditions Ve1 to Ve20 defined based on a moment are more accurate than travel conditions defined based only on a load, making it possible to achieve optimum or substantially optimum travel in consideration of how the moment (load) acts on the traveling devices 3 supporting the machine body 2. Note that, although the pivot of the attachment mount 40 in the above description is the second shaft S2, when considering the entire working machine 1, the pivot of the attachment mount 40 may be the front end of the traveling devices (in the cases of a crawler device, the foremost idlers) which is the point of rotation of the working machine 1.

Thus, the controller 5 is not limited to the foregoing example embodiments, provided that the controller 5 be configured or programmed to directly or indirectly recognize at least one of a load acting on the attachment mount 40 or the presence or absence of the load, or directly or indirectly recognize a moment about the pivot of the attachment mount 40, associate a travel condition corresponding to the recognized load or moment with the operation state of the manual operator 11, and actuate the traveling devices 3 according to the travel condition associated with the operation state as the manual operator 11 is operated.

Figure 28:
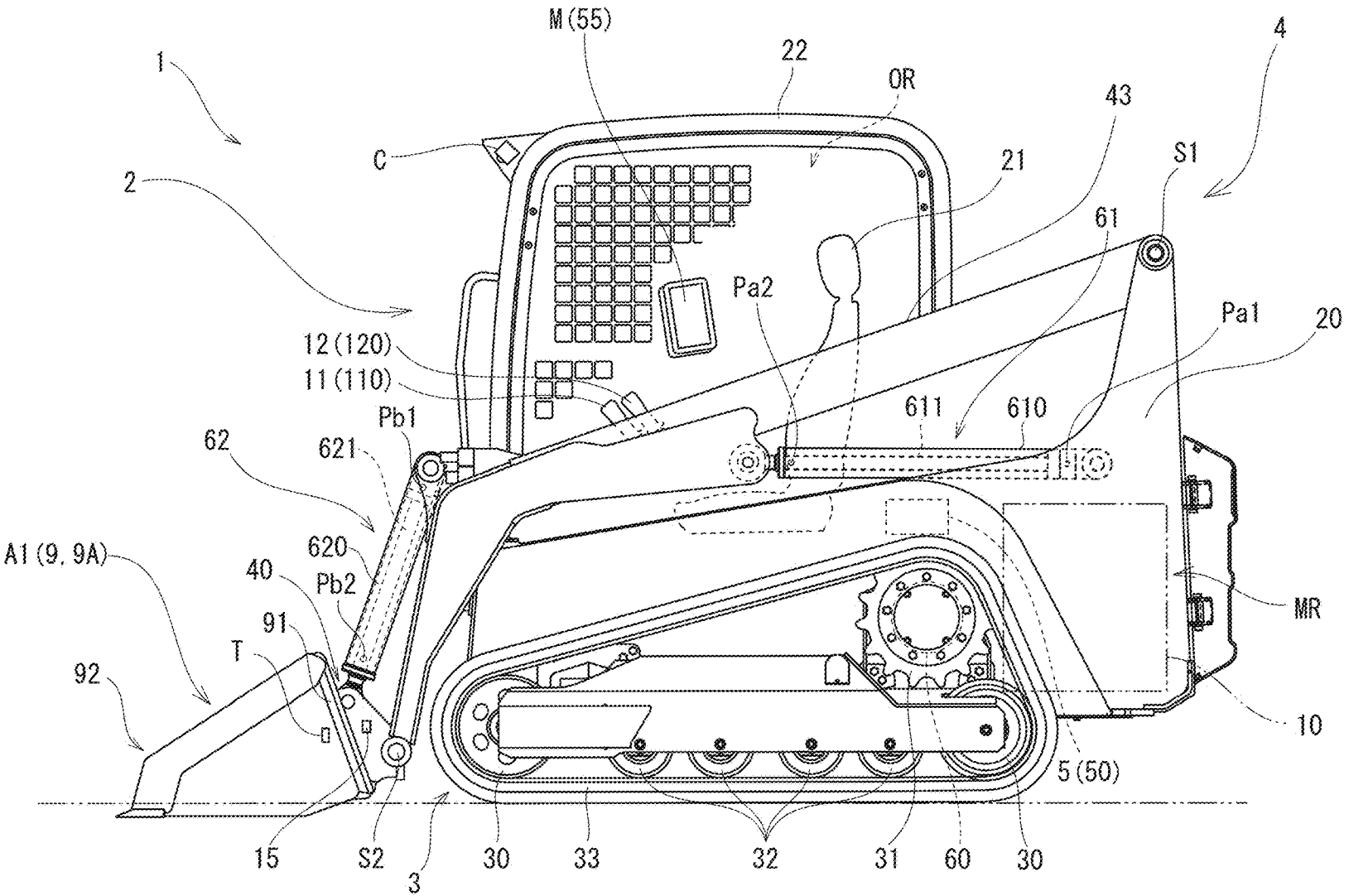
FIG. 28 is a schematic side view of a working machine according to still a further example embodiment of the present invention.

In the foregoing example embodiments, the arms 43 of the attachment support structure 4 are connected to the machine body 2 (frame chassis 20) via the linkers 44, but this does not imply any limitation. For example, as illustrated in FIG. 28, the arms 43 of the attachment support structure 4 may be directly connected to the frame chassis 20 of the machine body 2 without the linkers 44 between them. That is, the first shafts S1, about which the arms 43 rotate, may be provided on the frame chassis 20 of the machine body 2. In cases where the arms 43 and the machine body 2 are connected in a different manner as such, the positions and the manner in which first actuators 61 are attached are appropriately selected, depending on the manner in which the arms 43 and the machine body 2 are connected, for the arms 43 to rotate about the first shafts S1.

One or more example embodiments of the present invention have been discussed. Example embodiments of the present invention provide working machines 1 described in the following items.

(Item 1-1) A working machine 1 including a machine body 2, an attachment mount 40 to attach a work attachment 9 thereto such that the work attachment 9 is replaceable, the work attachment 9 being operable to perform a function corresponding to work, an attachment support structure 4 supported on the machine body 2 to support the attachment mount 40 such that the attachment mount 40 is movable along a predetermined path, an actuator 61, 62 to cause the attachment mount 40 to move along the path, a manual operator 12 to be operated by a user, and a controller 5 configured or programmed to actuate the actuator 61, 62 based on an operation state of the manual operator 12, wherein the controller 5 is configured or programmed to define, depending on the work attachment 9 attached to the attachment mount 40, a movement condition according to which the attachment mount 40 moves along the path, associate the defined movement condition with the operation state of the manual operator 12, and actuate the actuator 61, 62 according to the defined movement condition associated with the operation state as the manual operator 12 is operated.

With the working machine 1 according to item 1-1, the attachment mount 40 (work attachment 9) moves along the predetermined path according to the movement condition corresponding to the work attachment 9 attached to the attachment mount 40. This makes it possible to cause each of a plurality of types of work attachments 9 (A1 to A20), which differ in terms of machine weight, content of their work, and/or characteristics, to move (operate) under an appropriate state (according to the movement condition), instead of causing the plurality of types of work attachments 9 (A1 to A20) to move along a predetermined path under the same condition. Furthermore, since the movement condition is associated with the operation state of the manual operator 12 (work manual operator 12), even in cases where the user operates the manual operator 12 (work manual operator 12) in the same manner as usual, it is possible to cause the work attachment 9 (A1 to A20) to operate under the movement condition corresponding to (suitable for) the work attachment 9 (A1 to A20). Thus, with the working machine 1 of item 1-1, it is possible to cause the work attachment 9 (A1 to A20) in use to operate under the condition appropriate for the work attachment 9 (A1 to A20), merely by performing normal operations without having to perform troublesome or complex operations. That is, with the working machine 1 of item 1-1, it is possible to perform an appropriate operation depending on the work attachment 9 (A1 to A20) attached to the attachment mount 40.

(Item 1-2) The working machine 1 according to item 1-1, wherein the attachment support structure 4 includes an arm 43 connected to the attachment mount 40 and supported on the machine body 2 such that the arm 43 is rotatable about a first shaft S1 extending in a lateral direction perpendicular to an up-down direction, the actuator includes a first actuator 61 to cause the arm 43 to rotate about the first shaft S1 to cause the attachment mount 40 to ascend or descend along the up-down direction, and the controller 5 is configured or programmed to define, depending on the work attachment 9 attached to the attachment mount 40, an ascending/descending condition which is the movement condition for the attachment mount 40, associate the defined ascending/descending condition with the operation state of the manual operator 12, and when the manual operator (work manual operator) 12 is operated, actuate the first actuator 61 according to the defined ascending/descending condition associated with the operation state as the manual operator 12 is operated.

With the working machine 1 according to item 1-2, the arm(s) 43 is actuated by the first actuator(s) 61 to rotate about the first shaft S1 to raise or lower the attachment mount 40 (work attachment 9 (A1 to A20)) along the up-down direction. The ascending/descending condition relating to such raising/lowering is defined as the movement condition corresponding to the work attachment 9 (A1 to A20), and the controller 5 actuates the first actuator 61 according to the ascending/descending condition associated with the operation state as the manual operator 12 (work manual operator 12) is operated. This makes it possible to raise or lower each of the plurality of types of work attachments 9 (A1 to A20) (cause each of the plurality of types of work attachments 9 (A1 to A20) to operate) under an appropriate state (movement condition), instead of raising or lowering each of the plurality of types of work attachments 9 (A1 to A20) (causing each of the plurality of types of work attachments 9 (A1 to A20) to move) along the predetermined path under the same condition. Furthermore, even in cases where the user operates the manual operator 12 (work manual operator 12) in the same manner as usual, it is possible to raise or lower the work attachment 9 (A1 to A20) under the movement condition (ascending/descending condition) suitable for the work attachment 9 (A1 to A20).

(Item 1-3) The working machine according to item 1-2, wherein the attachment mount 40 is connected to the arm 43 such that the attachment mount 40 is rotatable about a second shaft S2 extending in the lateral direction, the actuator includes a second actuator 62 to cause the attachment mount 40 to rotate about the second shaft S42 to tilt, and the controller 5 is configured or programmed to define, depending on the work attachment 9 attached to the attachment mount 40, a tilting condition which is the movement condition for the attachment mount 40, associate the defined tilting condition with the operation state of the manual operator 12, and actuate the second actuator 62 according to the defined tilting condition associated with the operation state as the manual operator 12 is operated.

With the working machine 1 according to item 1-3, the attachment mount 40 is actuated by the second actuator(s) 62 to rotate about the second shaft S2, so that the attachment mount 40 (work attachment 9 (A1 to A20)) tilts (changes in posture). Furthermore, the tilting condition relating to such tilting (change in posture) is defined as the movement condition corresponding to the work attachment 9 (A1 to A20), and the controller 5 actuates the second actuator 62 according to the tilting condition associated with the operation state as the manual operator (work manual operator) 12 is operated. This makes it possible to cause each of the plurality of work attachments 9 (A1 to A20) to tilt (operate) under an appropriate state (movement condition), instead of causing the plurality of work attachments 9 (A1 to A20) to tilt (move) along the predetermined path under the same condition. Furthermore, even in cases where the user operates the manual operator 12 (work manual operator 12) in the same manner as usual, it is possible to cause the work attachment 9 (A1 to A20) to tilt under the movement condition (tilting condition) corresponding to (suitable for) the work attachment 9 (A1 to A20).

(Item 1-4) The working machine 1 according to any one of items 1-1 to 1-3, wherein the attachment mount 40 is operable to replaceably attach thereto each of a plurality of the work attachments 9 of different types, the working machine 1 further includes an identification information reader 15 to read identification information, the work attachments 9 have attached thereto respective tags T with respective pieces of identification information unique thereto, the identification information reader 15 is configured or programmed to read, from a tag T of one of the work attachments 9 that is attached to the attachment mount 40, a corresponding piece of identification information that is unique to the one of the work attachments 9, and the controller 5 is configured or programmed to recognize the one of the work attachments 9 that is attached to the attachment mount 40 based on the corresponding piece of identification information read by the identification information reader 15.

With the working machine 1 of item 1-4, the controller 5 recognizes the work attachment 9 (A1 to A20) attached to the attachment mount 40 based on the identification information read from the tag T by the identification information reader 15. Such a recognition of the work attachment 9 makes it possible to automatically extract and/or define a movement condition corresponding to (suitable for) the work attachment 9 attached to the attachment mount 40.

(Item 1-5) The working machine 1 according to any one of items 1-1 to 1-4, wherein the attachment mount 40 is operable to replaceably attach thereto each of a plurality of the work attachments 9 of different types, the working machine 1 further includes a storage and/or a memory 50 to record the work attachments 9, and an attachment selector 55 to select one of the work attachments 9 recorded in the storage and/or the memory 50 that is to be used for work, and the controller 5 is configured or programmed to recognize the one of the work attachments 9 selected via the attachment selector 55 as the work attachment 9 attached to the attachment mount 40.

With the working machine 1 of item 1-5, the controller 5 recognizes, as the work attachment 9 (A1 to A20) attached to the attachment mount 40, the work attachment 9 (A1 to A20) selected by the user via the attachment selector 55. Such a recognition of the work attachment 9 makes it possible to automatically extract and/or define a movement condition corresponding to (suitable for) the work attachment 9 attached to the attachment mount 40.

(Item 1-6) The working machine 1 according to item 1-2 or according to any one of items 1-3 to 1-5 depending directly or indirectly from item 1-2, wherein the first actuator 61 is a hydraulic cylinder 61, 62 which is extendable and retractable, an extending/retracting speed of the first actuator 61 that corresponds to the ascending/descending condition for the attachment mount 40 is defined as the ascending/descending condition for the attachment mount 40.

With the working machine 1 according to item 1-6, the extending/retracting speed of the first actuator 61 that corresponds to the ascending/descending condition is defined as the ascending/descending condition. Thus, the controller 5 does not need to convert the ascending/descending condition into the extending/retracting speed of the first actuators 61, making it possible to reduce the time taken for the data conversion. This makes it possible to perform controls relating to the extension and retraction of the first actuators 61 while eliminating or reducing the loss of time for control, and the attachment mount 40 (work attachment 9 (A1 to A20)) is raised or lowered according to the ascending/descending condition.

(Item 1-7) The working machine 1 according to item 1-2 or according to any one of items 1-3 to 1-6 depending directly or indirectly from item 1-2, wherein the first actuator 61 is a hydraulic cylinder 61, 62 which is extendable and retractable, and a change in extending/retracting speed of the first actuator 61 per unit time or per unit distance is defined as the ascending/descending condition for the attachment mount 40.

With the working machine 1 of item 1-7, a change in extending/retracting speed of the first actuator 61 per unit time or per unit distance is defined as the ascending/descending condition for the attachment mount 40. Thus, the acceleration of the first actuator 61 when extending or retracting is defined as the ascending/descending condition, making it possible to achieve controls with high accuracy.

(Item 1-8) The working machine 1 according to item 1-2 or according to any one of items 1-3 to 1-7 depending directly or indirectly from item 1-2, wherein the ascending/descending condition for the attachment mount 40 includes a maximum extending/retracting speed of the first actuator 61.

With the working machine of item 1-8, the ascending/descending condition for the attachment mount 40 includes the maximum extending/retracting speed of the first actuator 61. This makes it possible to eliminate or reduce the likelihood that the attachment mount 40 (work attachment 9 (A1 to A20)) will ascend or descend at too high a speed (acceleration).

(Item 1-9) The working machine 1 according to item 1-3 or according to any one of items 1-4 to 1-8 depending directly or indirectly from item 1-3, wherein the second actuator 62 is a hydraulic cylinder 62 which is extendable and retractable, and an extending/retracting speed of the second actuator 62 that corresponds to the tilting condition for the attachment mount 40 is defined as the tilting condition for the attachment mount 40.

With the working machine 1 according to item 1-9, the extending/retracting speed of the second actuator 62 that corresponds to the tilting condition is defined as the tilting condition. Thus, the controller 5 does not need to convert the tilting condition into the extending/retracting speed of the second actuator 62, making it possible to reduce the time taken for the data conversion. This makes it possible to perform controls relating to the extension and retraction of the second actuator 62 while eliminating or reducing the loss of time for control, and the attachment mount 40 (work attachment 9 (A1 to A20)) tilts under the tilting condition.

(Item 1-10) The working machine 1 according to item 1-3 or according to any one of items 1-4 to 1-9 depending directly or indirectly from item 1-3, wherein the second actuator 62 is a hydraulic cylinder 61, 62 which is extendable and retractable, and a change in extending/retracting speed of the second actuator 62 per unit time or per unit distance is defined as the tilting condition for the attachment mount 40.

With the working machine 1 of item 1-10, a change in extending/retracting speed of the second actuator 62 per unit time or per unit distance is defined as the tilting condition for the attachment mount 40. Thus, the acceleration of the second actuator 62 when extending or retracting is defined as the tilting condition, making it possible to achieve controls with high accuracy.

(Item 1-11) The working machine 1 according to item 1-9 or 1-10, wherein the tilting condition for the attachment mount 40 includes a maximum extending/retracting speed of the second actuator 62.

With the working machine of item 1-11, the tilting condition for the attachment mount 40 includes the maximum extending/retracting speed of the second actuator 62. This makes it possible to eliminate or reduce the likelihood that the attachment mount 40 (work attachment 9 (A1 to A20)) will tilt at too high a speed (acceleration).

(Item 1-12) The working machine 1 according to any one of items 1-1 to 1-11, wherein the manual operator 12 includes an operating lever 120 which is pivotable, and the operation state of the manual operator 12 includes the amount or an angle of pivoting of the operating lever 120.

With the working machine 1 according to item 1-12, the operation state of the manual operator 12 associated with the movement condition includes the amount or the angle of pivoting of the operating lever 120 of the manual operator 12. This makes it possible to actuate the actuator(s) 61 and/or 62 under the movement condition by using the working machine 1 as usual.

(Item 1-13) The working machine 1 according to item 1-12, wherein the operation state of the manual operator 12 includes a direction of pivoting of the operating lever 120.

With the working machine 1 according to item 1-13, the operation state of the manual operator (work manual operator) 12 associated with the movement condition includes the direction of pivoting of the operating lever (work operating lever) 120 of the manual operator (work manual operator) 12. This makes it possible to actuate the actuator(s) 61 and/or 62 under the movement condition only when the operating lever (work operating lever) 120 is pivoted in a specific direction.

(Item 1-14) The working machine 1 according to item 1-2 or according to any one of items 1-3 to 1-13 depending directly or indirectly from item 1-2, wherein the ascending/descending condition for the attachment mount 40 is defined for each of a plurality of the work attachments 9 of different types attachable to the attachment mount 40 and differs depending on a total length of the work attachment 9 in a front-rear direction perpendicular to the up-down direction and the lateral direction, and ascending/descending speeds included in ascending/descending conditions are defined to be lower for work attachments 9 with longer total lengths in the front-rear direction.

With the working machine 1 according to item 1-14, the ascending/descending speed differs depending on the total length of the work attachment 9 (A1 to A20) in a front-rear direction perpendicular to the up-down direction and the lateral direction, and ascending/descending speeds are defined to be lower for work attachments 9 (A1 to A20) with longer total lengths in the front-rear direction. Therefore, the work attachments 9 (A1 to A20) with longer total lengths in the front-rear direction are raised or lowered more slowly. Specifically, work attachments 9 with longer total lengths in front-rear direction would cause a larger overturning moment than work attachments 9 with shorter total lengths in the front-rear direction, and therefore, if the work attachment 9 is to be raised or lowered at a normal speed, a large inertial force (impact force) will act along the up-down direction when the work attachment 9 starts and stops being raised or lowered. In this regard, when ascending/descending speeds are defined to be lower for work attachments 9 (A1 to A20) with longer total lengths in the front-rear direction, it is possible to reduce the shock (impact) that would occur when the work attachment 9 (A1 to A20) having a long total length is raised or lowered.

(Item 1-15) The working machine 1 according to item 1-2 or according to any one of items 1-3 to 1-14 depending directly or indirectly from item 1-2, wherein the ascending/descending condition for the attachment mount 40 is defined for each of a plurality of the work attachments 9 of different types attachable to the attachment mount 40 and differs depending on a total length of the work attachment 9 in a front-rear direction perpendicular to the up-down direction and the lateral direction, and maximum ascending/descending speeds included in ascending/descending conditions are defined to be lower for work attachments 9 with longer total lengths in the front-rear direction.

With the working machine 1 according to item 1-15, the ascending/descending condition differs depending on the total length of the work attachment 9 (A1 to A20) in a front-rear direction perpendicular to the up-down direction and the lateral direction, and maximum ascending/descending speed included in ascending/descending conditions are defined to be lower for work attachments 9 (A1 to A20) with longer total lengths in the front-rear direction. Therefore, the work attachments 9 (A1 to A20) with longer total lengths in the front-rear direction are subjected to smaller impact when starting/stopping being raised or lowered. Specifically, work attachments 9 with longer total lengths in front-rear direction would cause a larger overturning moment than work attachments 9 with shorter total lengths in the front-rear direction, and therefore, if the work attachment 9 is to be raised or lowered at a normal speed, a large inertial force (impact force) will act along the up-down direction when the work attachment 9 starts and stops being raised or lowered. In this regard, when maximum values of ascending/descending speeds are defined to be lower for work attachments 9 (A1 to A20) with longer total lengths in the front-rear direction, the speed at which the work attachment 9 (A1 to A20) having a long total length is raised or lowered does not increase to too high a speed, making it possible to reduce the inertial force (impact force) that would act in the up-down direction when the work attachment 9 (A1 to A20) starts an stops being raised or lowered. This makes it possible to reduce the shock (impact) that would occur when the work attachment 9 (A1 to A20) is raised or lowered.

(Item 1-16) The working machine 1 according to item 1-2 or according to any one of items 1-3 to 1-15 depending directly or indirectly from item 1-2, wherein the ascending/descending condition for the attachment mount 40 is defined for each of a plurality of the work attachments 9 of different types attachable to the attachment mount 40 and differs depending on a weight of the work attachment 9, and ascending/descending speeds included in ascending/descending conditions are defined to be lower for heavier work attachments 9.

With the working machine 1 according to item 1-16, the ascending/descending condition differs depending on the weight of the work attachment 9 (A1 to A20), and ascending/descending speeds ascending/descending conditions are defined to be lower for heavier work attachments 9 (A1 to A20). Therefore, heavier work attachments 9 (A1 to A20) are raised or lowered more slowly. Specifically, heavier work attachments 9 would be subjected to a larger load acting in the downward direction, and cause a larger overturning moment, than lighter work attachments 9. Therefore, if the work attachment 9 is to be raised or lowered at a normal speed, a large inertial force (impact force) will act along the up-down direction when the work attachment 9 starts and stops being raised or lowered. In this regard, when ascending/descending speeds are defined to be lower for heavier work attachments 9 (A1 to A20), it is possible to reduce the shock (impact) that would occur when the heavy work attachment 9 (A1 to A20) is raised or lowered.

(Item 1-17) The working machine 1 according to item 1-3 or according to any one of items 1-4 to 1-16 depending directly or indirectly from item 1-3, wherein the tilting condition for the attachment mount 40 is defined for each of a plurality the work attachments 9 of different types attachable to the attachment mount 40 and differs depending on a total length of the work attachment 9 in a front-rear direction perpendicular to the up-down direction and the lateral direction, and tilting speeds included in tilting conditions are defined to be lower for work attachments 9 with longer total lengths in the front-rear direction.

With the working machine 1 according to item 1-17, the tilting condition differs depending on the total length of the work attachment 9 (A1 to A20) in a front-rear direction perpendicular to the up-down direction and the lateral direction, and tilting speed included in tilting conditions are defined to be lower for work attachments 9 (A1 to A20) with longer total lengths in the front-rear direction. Therefore, the work attachments 9 (A1 to A20) with longer total lengths in the front-rear direction tilt more slowly. Specifically, work attachments 9 with longer total lengths in the front-rear direction would cause a larger overturning moment than work attachments 9 with shorter total lengths in the front-rear direction, and therefore, if the work attachment 9 is to be tilted at a normal speed, a large inertial force (impact force) will act along the up-down direction when the work attachment 9 starts and stops being raised or lowered. In this regard, when tilting speeds are defined to be lower for work attachments 9 (A1 to A20) with longer total lengths in the front-rear direction, it is possible to reduce the shock (impact) that would occur when the work attachment 9 (A1 to A20) having a long total length is tilted.

(Item 1-18) The working machine 1 according to item 1-3 or according to any one of items 1-4 to 1-17 depending directly or indirectly from item 1-3, wherein the tilting condition for the attachment mount 40 is defined for each of a plurality of the work attachments 9 of different types attachable to the attachment mount 40 and differs depending on a total length of the work attachment 9 in a front-rear direction perpendicular to the up-down direction and the lateral direction, and maximum tilting speeds included in tilting conditions are defined to be lower for work attachments 9 with longer total lengths in the front-rear direction.

With the working machine 1 according to item 1-18, the tilting condition differs depending on the total length of the work attachment 9 (A1 to A20) in a front-rear direction perpendicular to the up-down direction and the lateral direction, and maximum tilting speeds included in tilting conditions are defined to be lower for work attachments 9 (A1 to A20) with longer total lengths in the front-rear direction. Therefore, the work attachments 9 (A1 to A20) with longer total lengths in the front-rear direction are subjected to less impact when starting/stopping being tilted. Specifically, work attachments 9 with longer total lengths in the front-rear direction would cause a larger overturning moment than work attachments 9 with shorter total lengths in the front-rear direction, and therefore, if the work attachment 9 is to be tilted at a normal speed, a large inertial force (impact force) will act along the up-down direction when the work attachment 9 starts and stops being tilted. In this regard, when maximum tilting speeds are defined to be lower for work attachments 9 (A1 to A20) with longer total lengths in the front-rear direction, the speed at which the work attachment 9 (A1 to A20) having a long total length is tilted does not increase to too high a speed, making it possible to reduce the inertial force (impact force) that would act in the up-down direction when the work attachment 9 (A1 to A20) starts an stops being tilted. This makes it possible to reduce the shock (impact) that would occur when the work attachment 9 (A1 to A20) is tilted.

(Item 1-19) The working machine 1 according to item 1-3 or according to any one of items 1-4 to 1-18 depending directly or indirectly from item 1-3, wherein the movement condition for the attachment mount 40 is defined for each of a plurality of the work attachments 9 of different types attachable to the attachment mount 40 and differs depending on a weight of the work attachment 9, and tilting speeds included in movement conditions are defined to be lower for heavier work attachments 9.

With the working machine 1 according to item 1-19, the tilting condition differs depending on the weight of the work attachment 9 (A1 to A20), and tilting speeds included in tilting conditions are defined to be lower for heavier work attachments 9 (A1 to A20). Therefore, heavier work attachments 9 (A1 to A20) are tilted more slowly. Specifically, heavier work attachments 9 would be subjected to a larger load acting in the downward direction, and cause a larger overturning moment, than lighter work attachments 9. Therefore, if the work attachment 9 is to be tilted at a normal speed, a large inertial force (impact force) will act along the up-down direction when the work attachment 9 starts and stops being tilted. In this regard, when tilting speeds are defined to be lower for heavier work attachments 9 (A1 to A20), it is possible to reduce the shock (impact) that would occur when the heavy work attachment 9 (A1 to A20) is tilted.

(Item 1-20) The working machine 1 according to item 1-2 or according to any one of items 1-3 to 1-19 depending directly or indirectly from item 1-2, wherein the controller 5 is configured or programmed to recognize an operation speed which is a speed at which the manual operator 12 is operated by the user, and the controller 5 is configured or programmed to define, depending on the work attachment 9 attached to the attachment mount 40, a sudden-operation condition which is the movement condition for sudden operation in which the operation speed is higher than a predetermined speed, associate the defined sudden-operation condition with the sudden operation of the manual operator 12, and when the controller 5 determines that the operation speed of the manual operator 12 is higher than the predetermined speed, actuate the first actuator 61 according to the defined sudden-operation condition associated with the sudden operation as the manual operator 12 is operated.

With the working machine 1 according to item 1-20, when the controller 5 determines that the operation speed of the manual operator 12 by the user is higher than the predetermined speed (the operation is sudden operation), the controller 5 actuates the first actuators 61 according to the sudden-operation condition associated with the sudden operation as the manual operator 12 is operated. Therefore, even when the user suddenly operates the manual operator 12, the first actuators 61 are actuated according to the sudden-operation condition, and therefore the attachment mount 40 (work attachment 9) is also actuated (moves) under the condition corresponding to the sudden-operation condition.

(Item 1-21) The working machine 1 according to item 1-20, wherein an ascending/descending speed included in the sudden-operation condition is lower than an ascending/descending speed included in the movement condition.

With the working machine 1 according to item 1-21, an ascending/descending speed defines as the sudden-operation condition is lower than an ascending/descending speed defined as the movement condition. Therefore, even if the user suddenly operates the manual operator 12, the first actuators 61 are actuated slowly instead of being actuated according to the sudden operation.

(Item 1-22) The working machine 1 according to item 1-3 or according to any one of items 1-4 to 1-22 depending directly or indirectly from item 1-3, wherein the controller 5 is configured or programmed to recognize an operation speed which is a speed at which the manual operator 12 is operated by the user, and the controller 5 is configured or programmed to define, depending on the work attachment 9 attached to the attachment mount 40, a sudden-operation condition for sudden operation in which the operation speed is higher than a predetermined speed, associate the defined sudden-operation condition with the sudden operation of the manual operator 12, and when the controller 5 determines that the operation speed of the manual operator is higher than the predetermined speed, actuate the second actuator 62 according to the defined sudden-operation condition associated with the sudden operation as the manual operator 12 is operated.

With the working machine 1 according to item 1-22, when the controller 5 determines the operation speed of the manual operator 12 is higher than the predetermined speed (the operation is the sudden operation), the controller 5 actuates the second actuators 62 according to the sudden-operation condition associated with the sudden operation as the manual operator 12 is operated. Therefore, even if the user suddenly operates the manual operator 12, the second actuator 62 is actuated under the sudden-operation condition, and therefore the attachment mount 40 (work attachment 9) is also actuated (moves) under the condition corresponding to the sudden-operation condition.

(Item 1-23) The working machine 1 according to item 1-22, wherein a tilting speed included in the sudden-operation condition lower than a tilting speed included in the movement condition.

With the working machine 1 according to item 1-23, a tilting speed defined as the sudden-operation condition is lower than that of the movement condition, and therefore, even if the user suddenly operates the manual operator 12, the second actuators 62 are actuated slowly instead of being actuated according to the sudden operation.

(Item 1-24) The working machine 1 according to item 1-2 or according to any one of items 1-3 to 1-23 depending directly or indirectly from item 1-2, wherein the controller 5 is configured or programmed to recognize an increase in load acting at least on the work attachment 9, and the controller 5 is configured or programmed to define a with-load movement condition for when a load acts on the work attachment 9 attached to the attachment mount 40, and when the controller 5 recognizes an increase in the load, actuate the first actuator 61 according to the defined with-load movement condition.

With the working machine 1 according to item 1-24, when the controller 5 recognizes an increase in load acting on the work attachment 9, the controller 5 actuates the first actuator 61 according to the with-load movement condition. Therefore, the attachment mount 40 (work attachment 9) is raised or lowered (moves) along the predetermine path under appropriate conditions in consideration of load variations during work.

(Item 1-25) The working machine 1 according to item 1-24, wherein the movement condition is an ascending/ descending speed of the attachment mount 40 along the up-down direction, and an ascending/descending speed included in the with-load movement condition is lower than an ascending/descending speed included in the movement condition.

With the working machine 1 according to item 1-25, the with-load movement condition for when a load acts on the work attachment 9 (attachment mount 40) is defined such that the ascending/descending speed thereof is lower than that of the movement condition, and therefore, when a load acts on the work attachment 9 (attachment mount 40) (when the load on the work attachment 9 (attachment mount 40) increases), the work attachment 9 (attachment mount 40) is raised or lowered more slowly than when no loads are acting. Specifically, since the load on the work attachment 9 (attachment mount 40) is a downward force, the force may be a cause of acceleration when the work attachment 9 (attachment mount 40) is lowered. In this regard, since a lower ascending/descending speed than that of the movement condition for normal times is defined, the work attachment 9 (attachment mount 40) is prevented from accelerating needlessly when lowered, improving safety during work. Furthermore, the load on the work attachment 9 (attachment mount 40), when the work attachment 9 (attachment mount 40) is raised, would affect the upward inertia force when the work attachment 9 (attachment mount 40) stops being raised. In this regard, since the work attachment 9 (attachment mount 40) is raised at a lower ascending/descending speed than that of the movement condition for normal times, the upward inertia force is prevented from increasing, improving safety during work.

(Item 1-26) The working machine 1 according to item 1-3 or according to any one of items 1-4 to 1-25 depending directly or indirectly from item 1-3, wherein the controller 5 is configured or programmed to recognize an increase in load acting at least on the work attachment 9, and the controller 5 is configured or programmed to define a with-load movement condition for when a load acts on the work attachment 9 attached to the attachment mount 40, and when the controller 5 recognizes an increase in the load, actuate the second actuator 62 according to the defined with-load movement condition.

With the working machine 1 according to item 1-26, when the controller 5 recognizes an increase load on the work attachment 9, the controller 5 actuates the second actuator 62 under the with-load movement condition. Therefore, the attachment mount 40 (work attachment 9) is tilted (moves) along the predetermined path under appropriate conditions in consideration of load variations during work.

(Item 1-27) The working machine 1 according to item 1-3 or according to any one of items 1-4 to 1-26 depending directly or indirectly from item 1-3, wherein the movement condition includes a tilting speed which is a speed at which the attachment mount 40 tilts about an axis extending in the lateral direction perpendicular to the up-down direction, and a tilting speed included in the with-load movement condition is lower than a tilting speed included in the movement condition.

With the working machine 1 according to item 1-27, the with-load movement condition for when a load acts on the work attachment 9 (attachment mount 40) is defined such that the tilting speed thereof is lower than that of the movement condition, and the second actuator 62 is actuated under the with-load movement condition. Therefore, when a load acts on the work attachment 9 (attachment mount 40) (when the load on the work attachment 9 (attachment mount 40) increases), the work attachment 9 (attachment mount 40) is tilted more slowly than when no loads are acting. Furthermore, the load on the work attachment 9 (attachment mount 40) would affect the upward inertia force when the work attachment 9 (attachment mount 40) is titled. In this regard, since the work attachment 9 (attachment mount 40) is titled at a lower tilting speed than that of the tilting condition for normal times, the upward inertia force is prevented from increasing, improving safety during work.

(Item 2-1) A working machine 1 including a machine body 2, a traveling device 3 to support the machine body 2 such that the machine body 2 is allowed to travel, an attachment mount 40 directly or indirectly supported on the machine body 2 to detachably attach a work attachment 9 thereto, the work attachment 9 being operable to perform a function corresponding to work, a manual operator 11 to be operated by a user, and a controller 5 configured or programmed to actuate the traveling device 3 based on an operation state of the manual operator 11, wherein the controller 5 is configured or programmed to directly or indirectly recognize at least one of a load acting on the attachment mount 40 or a presence or an absence of the load or directly or indirectly recognize a moment about a pivot of the attachment mount 40, associate a travel condition corresponding to the recognized load or moment with an operation state of the manual operator 11, and actuate the traveling device 3 according to the travel condition associated with the operation state as the manual operator 11 is operated.

With the working machine 1 according to item 2-1, the controller 5 actuates the traveling device(s) 3 under the travel condition corresponding to the load on the attachment mount 40 or the moment about the pivot of the attachment mount, making it possible to achieve travel under appropriate conditions corresponding to the presence/absence of the work attachment 9 and the state of the load on the work attachment 9. That is, it is possible to achieve appropriate travel in consideration of the state of the load on the traveling device 3 supporting the machine body 2. Thus, with the working machine according to item 2-1, it is possible to achieve stable travel even if the work attachment 9 (A1 to A20) attached to the attachment mount 40 is replaced with another one.

(Item 2-2) The working machine 1 according to item 2-1, wherein the controller 5 is configured or programmed to directly or indirectly recognize at least one of a load acting on the attachment mount 40 or presence or absence of the load, associate a travel condition corresponding to the recognized load with an operation state of the manual operator 11, and actuate the traveling device 3 according to the travel condition associated with the operation state as the manual operator 11 is operated.

With the working machine 1 according to item 2-2, the controller 5 actuates the traveling device(s) 3 under the travel condition corresponding to the load on the attachment mount 40, making it possible to achieve travel under appropriate conditions corresponding to the presence/absence of the work attachment 9 and the state of the load on the work attachment 9.

(Item 2-3) The working machine 1 according to item 2-2, wherein the controller 5 is configured or programmed to recognize the presence or absence of the load acting on the attachment mount 40 based on whether or not the work attachment 9 (A1 to A20) is attached to the attachment mount 40.

With the working machine 1 according to item 2-3, the controller 5 recognizes the presence of absence of the load on the attachment mount 40 based on whether or not the work attachment 9 (A1 to A20) is attached to the attachment mount 40, making it possible to recognize the presence or absence of the load without having to use a sensor such as a load cell.

(Item 2-4) The working machine 1 according to item 2-1, wherein the attachment mount 40 is operable to replaceably attach thereto each of a plurality of types of the work attachments 9 (A1 to A20) of different types, the work attachments 9 (A1 to A20) each being operable to perform a function corresponding to work, and the controller 5 is configured or programmed to recognize the load acting on the attachment mount 40 or the moment based on a type of the work attachment 9 (A1 to A20) attached to the attachment mount 40.

With the working machine 1 according to item 2-4, the controller 5 recognizes the load on the attachment mount 40 based on the type of the work attachment 9 (A1 to A20) attached to the attachment mount 40, and therefore recognizes the state of the load on the attachment mount 40 without using a sensor such as a load cell. That is, the machine weights of a plurality of types of work attachments 9 (A1 to A20), which are loads to act on the attachment mount 40, can be known in advance by, for example, estimation or actual measurement in the design stage. Therefore, recognizing the type of the work attachment 9 makes it possible to know the state of the load. Note that recognizing a load here refers to not only actually recognizing the load as a number as-is, but also recognizing a work attachment 9 (A1 to A20) that corresponds to a specific load (merely achieving a state in which the load can be indirectly known) as described above.

(Item 2-5) The working machine 1 according to item 2-2 or 2-3, wherein the travel condition includes a speed change per unit time, and the controller 5 is configured or programmed to, if the controller 5 determines that there is no load or the load is below a predetermined amount, define a smaller speed change as the travel condition than when a larger load is present, and actuate the traveling device 3 according to the defined travel condition as the manual operator is operated.

With the working machine 1 according to item 2-5, when the controller 5 determines that there is no load on the attachment mount 40 or the load on the attachment mount 40 is below a predetermined amount, the controller 5 defines a smaller speed change as the travel condition than when a larger load is present, and, when the manual operator 11 is operated, actuates the traveling device 3 under the defined travel condition. Therefore, when the controller 5 determines that there is no load on the attachment mount 40 or the load on the attachment mount 40 is below a predetermined amount, unstable travel conditions are prevented or reduced. That is, if the controller 5 determines that there is no load on the attachment mount 40 or the load on the attachment mount 40 is below a predetermined amount, the load on the traveling device(s) (travel load) is also small, and therefore, if the speed change increases, the traveling device may idle or may suddenly start (suddenly increase in speed) due to grounding resistance. In this regard, if the controller 5 determines that there is no load on the attachment mount 40 or the load on the attachment mount 40 is below a predetermined amount, when the working machine is caused to travel with a smaller speed change (under the travel condition) than that of the travel condition for when a larger load is present, the working machine can be caused to travel stably.

(Item 2-6) The working machine 1 according to item 2-5, wherein the traveling device 3 is operable to change a speed thereof between a first speed stage and a second speed stage which is a higher speed stage than the first speed stage, and the controller 5 is configured or programmed to, if the controller 5 determines that there is no load or the load is below a predetermined amount, define a smaller speed change as the travel condition for when the first speed stage is changed to the second speed stage than when the controller 5 determines that the load is above a predetermined amount.

With the working machine 1 according to item 2-6, when the controller 5 determines that there is no load on the attachment mount 40 or the load on the attachment mount 40 is below a predetermined amount, the controller 5 defines a smaller speed change as the travel condition for when the first speed stage is changed to the second speed stage than when the controller 5 determines that the load is above a predetermined amount, making it possible to prevent or reduce the likelihood that a large shock will occur when speed stages are changed or that the working machine will idle, for example. That is, if the controller 5 determines that there is no load on the attachment mount 40 or the load on the attachment mount 40 is below a predetermined amount, the load on the traveling device(s) (travel load) is also small, and therefore, if the speed change increases, the traveling device may idle or may suddenly increase in speed due to grounding resistance. In this regard, if the controller 5 determines that there is no load on the attachment mount 40 or the load on the attachment mount 40 is below a predetermined amount, when the working machine is caused to, when speed stages are changed, travel with a smaller speed change (under the travel condition) than that of the travel condition for when a larger load is present, the working machine can be caused to travel stably.

(Item 2-7) The working machine 1 according to any one of items 2-2, 2-3, 2-5, and 2-6, wherein the attachment mount 40 is operable to replaceably attach thereto each of a plurality of the work attachments 9 of different types, the work attachments each being operable to perform a function corresponding to work, and the controller 5 is configured or programmed to recognize the work attachment 9 (A1 to A20) attached to the attachment mount 40, define the travel condition depending on a weight of the recognized work attachment 9 (A1 to A20), and actuate the traveling device 3 according to the defined travel condition as the manual operator 11 is operated.

With the working machine 1 according to item 2-7, the controller 5 is configured or programmed to recognize the work attachment 9 attached to the attachment mount 40 and define a travel condition corresponding to the weight of the recognized work attachment 9, making it possible to automatically or semi-automatically define a condition to achieve stable travel (define a travel condition).

(Item 2-8) The working machine 1 according to item 2-7, further including an identification information reader 15 to read identification information, the work attachments 9 (A1 to A20) of different types have attached thereto respective tags T with respective pieces of identification information unique thereto, the identification information reader 15 is configured or programmed to read, from a tag T of one of the work attachments 9 (A1 to A20) that is attached to the attachment mount 40, a corresponding piece of identification information that is unique to the one of the work attachments 9 (A1 to A20), and the controller 5 is configured or programmed to recognize the one of the work attachments 9 (A1 to A20) that is attached to the attachment mount 40 based on the corresponding piece of identification information read by the identification information reader 15.

With the working machine 1 according to item 2-8, the identification information reader 15 reads the unique identification information from the tag T of the work attachment 9 (A1 to A20) attached to the attachment mount 40, and the controller 5 recognizes the work attachment 9 (A1 to A20) attached to the attachment mount 40 based on the identification information read by the identification information reader 15. Thus, by defining a travel condition based on this, it is possible to automatically define a condition to achieve stable travel (define a travel condition).

(Item 2-9) The working machine 1 according to item 2-7 or 2-8, further including a storage and/or a memory 50 to record the work attachments 9 of different types (A1 to A20), and an attachment selector 55 to select one of the work attachments work attachments 9 (A1 to A20) recorded in the storage and/or the memory 50 that is to be used for work, wherein the controller 5 is configured or programmed to recognize the one of the work attachments 9 selected via the attachment selector 55 as the work attachment 9 attached to the attachment mount 40.

With the working machine 1 according to item 2-9, the controller 5 recognizes, as the work attachment 9 attached to the attachment mount 40, the work attachment 9 (A1 to A20) selected via the attachment selector 55. Thus, by defining a travel condition based on this, it is possible to define a condition to achieve stable travel (define a travel condition) corresponding to the work attachment 9 (A1 to A20) selected by the user.

(Item 2-10) The working machine 1 according to item 2-9, wherein the storage and/or the memory 50 is operable to store a plurality of the travel conditions corresponding to the work attachments 9 of different types and each associated with an operation state of the manual operator 11, the plurality of travel conditions each being defined depending on a weight of a corresponding one of the work attachments 9, and the controller 5 is configured or programmed to recognize the one of the work attachments 9 selected via the attachment selector 55 as the work attachment 9 attached to the attachment mount 40, extract a corresponding one of the plurality of travel conditions that corresponds to the selected work attachment 9 from the storage and/or the memory 50, and actuate the traveling device 3 according to the extracted travel condition.

With the working machine 1 according to item 2-10, the controller 5 recognizes, as the work attachment 9 attached to the attachment mount 40, the work attachment 9 selected via the attachment selector 55, extracts the travel condition corresponding to the selected work attachment 9 from the storage and/or the memory 50, and actuates the traveling device(s) 3 under the extracted travel condition. This makes it unnecessary to perform complex processes to extract or define the travel condition.

(Item 2-11) The working machine 1 according to item 2-5 or 2-6, wherein the controller 5 is configured or programmed to recognize an operation speed which is a speed at which the manual operator 11 is operated by the user, and the controller 5 is configured or programmed to define, depending on the work attachment 9 attached to the attachment mount 40, a sudden-operation travel condition which is the travel condition for sudden operation in which the operation speed is higher than a predetermined speed, associate the defined sudden-operation travel condition with a sudden operation of the manual operator 11, and, when the controller 5 determines that the operation speed of the manual operator 11 is higher than the predetermined speed and that there is the sudden operation, actuate the traveling device 3 according to the defined sudden-operation travel condition associated with the sudden operation as the manual operator 11 is operated.

With the working machine 1 according to item 2-11, when the manual operator 11 is suddenly operated at an operation speed higher than a predetermined speed, the controller 5 actuates the traveling device(s) 3 under the sudden-operation travel condition associated with the sudden operation of the manual operator 11, and therefore the traveling device 3 is actuated in a manner different from the cases of the normal sudden operation. This eliminates or reduce the likelihood that dangerous travel conditions (for example, sudden start, sudden increase in speed) will occur when the user suddenly operates the manual operator 11.

(Item 2-12) The working machine 1 according to item 2-11, wherein a speed change included in the sudden-operation travel condition is smaller than a speed change included in the travel condition for normal operation other than the sudden operation.

With the working machine 1 according to item 2-12, a speed change defined as the sudden-operation travel condition is smaller than that of the travel condition for normal operation other than the sudden operation. This eliminates or reduce the likelihood that sudden start or sudden increase in speed will occur when the user suddenly operates the manual operator 11.

(Item 2-13) The working machine 1 according to any one of items 2-1 to 2-12, wherein the traveling device 3 is operable to achieve straight travel in which the machine body 2 travels straight and pivot turn travel, the travel condition includes a first travel condition for the straight travel and a second travel condition for the pivot turn travel that differs from the first travel condition, and a speed change included in the second travel condition is smaller than a speed change included in the first travel condition.

With the working machine 1 according to item 2-13, the travel condition includes a first travel condition for the straight travel and a second travel condition for the pivot turn travel that differs from the first travel condition, and a speed change defined as the second travel condition is smaller than that of the first travel condition. This prevents or reduces the occurrence of spinning, etc., during pivot turn travel, achieving stable travel.

(Item 2-14) The working machine 1 according to any one of items 2-5, 2-6, 2-11, and 2-12, wherein a speed change defined as the travel condition is smaller when no work attachments 9 are attached to the attachment mount 40 than when the work attachment 9 is attached to the attachment mount 40.

With the working machine 1 according to item 2-14, a speed change included in the travel condition is smaller when no work attachments 9 are attached to the attachment mount 40 than when the work attachment 9 is attached to the attachment mount 40, and therefore stable travel is achieved when no work attachments 9 are attached to the attachment mount 40 (when no load is acting on the attachment mount 40).

(Item 2-15) The working machine 1 according to item 2-14, wherein the attachment mount 40 includes a linkage 41 to connect the work attachment 9, the linkage 41 includes an engaging portion 412 switchable between an engaging position PE1 in which the engaging portion 412 engages with the work attachment 9 to connect the work attachment 9 thereto and a disengaging position PE2 in which the engaging portion 412 disengages the work attachment 9 therefrom to disconnect the work attachment 9 therefrom, and the controller 5 is configured or programmed to determine that no work attachments 9 are attached to the attachment mount 40 when the engaging portion 412 is in the disengaging position PE2.

With the working machine 1 according to item 2-15, the controller 5 determines that no work attachments 9 are attached to the attachment mount 40 when the engaging portion(s) 412 is/are in the disengaging position PE2, making it possible to determine whether or not there is a work attachment 9 using basic component(s) of the working machine 1. Specifically, in the linkage 41, when the engaging portion (latch pin) 412 is in the engaging position PE1, the engaging portion (latch pin) 412 engages with the work attachment 9 to connect the work attachment 9, whereas, when the engaging portion (latch pin) 412 is in the disengaging position PE2, the engaging portion (latch pin) 412 disengages from the work attachment 9 to disconnect the work attachment 9. Therefore, the engaging portion (latch pin) 412 being in the disengaging position PE2 would indicate that there are no work attachments 9 (A1 to A20) (no work attachments 9 (A1 to A20) are connected).

(Item 2-16) The working machine 1 according to any one of items 2-1 to 2-15, further including an attachment support structure 4 supported on the machine body 2 to support the attachment mount 40 such that the attachment mount 40 is movable along a predetermined path, and an actuator to cause the attachment mount 40 to move along the path.

With the working machine 1 according to item 2-16, by attaching a work attachment 9 (A1 to A20) to the attachment mount 40, it is possible to cause the work attachment 9 (A1 to A20) to move along a predetermined path.

(Item 2-17) The working machine 1 according to item 2-16, wherein the attachment support structure 4 includes an arm 43 supported on the machine body 2 such that the arm 43 is rotatable about a first shaft S1 extending in a lateral direction perpendicular to an up-down direction, the arm 43 being connected to the attachment mount 40, and the arm 43 extends in a front-rear direction perpendicular to the up-down direction, and the attachment mount 40 is located forward of the machine body 2.

With the working machine 1 according to item 2/17, as the arm 43 rotates about the first shaft S1, the attachment mount 40 connected to the arm 43 also moves along an arc path. Thus, the work attachment 9 (A1 to A20) attached to the attachment mount 40 also moves along a similar path. Furthermore, since the attachment mount 40 is located forward of the machine body 2, the work attachment 9 (A1 to A20) is also located forward of the machine body 2. With this, the presence/absence of the work attachment 9 (A1 to A20) attached to the attachment mount 40 and the load that varies depending on the type would affect stable travel. In this regard, since a travel condition is defined in consideration of the presence/absence of any of a plurality of work attachments 9 (A1 to A20) (presence/absence of a load) and its machine weight and the traveling device(s) 3 is/are actuated under the travel condition as described above, stable travel can be achieved.

(Item 3-1) A working machine 1 including a machine body 2, an attachment mount 40 to attach a drive work attachment 9B thereto such that the drive work attachment 9B is replaceable with another work attachment 9, the drive work attachment 9B including a plurality of hydraulic actuators 95, 96 including at least one hydraulic motor 96 to drive a rotor to perform a function corresponding to work, a solenoid control valve 97 to control a flow rate of hydraulic fluid to one or more of the plurality of hydraulic actuators 95, 96 other than the at least one hydraulic motor 96, and a fluid passage 90 connected to the at least one hydraulic motor 96 and the control valve 97, a first hydraulic actuator 61 to cause the attachment mount 40 to move along a predetermined path, an auxiliary (AUX) port 75*a*, 75*b*, 75*c* fluidly connectable to the fluid passage 90 and operable to allow hydraulic fluid to flow therethrough when in connection with the fluid passage 90, a manual operator 12 to be operated by a user, a controller 5, and a control line CL1 connected to the controller 5 and connectable to the control valve 97, wherein the controller 5 is configured or programmed to include a normal operation mode in which the controller 5 actuates the first hydraulic actuator 61 based on an operation state of the manual operator 12, and an attachment operation mode to be performed under a condition in which the drive work attachment 9B is attached to the attachment mount 40, the control line CL1 is in electrical connection with the control valve 97, and the AUX port 75*a*, 75*b*, 75*c* allows hydraulic fluid to flow constantly therethrough, the attachment operation mode being a mode in which the controller 5 stops the normal operation mode and actuates the control valve 97 based on the operation state of the manual operator 12.

With the working machine 1 according to item 3-1, the controller 5 is configured or programmed to include a normal operation mode in which the controller 5 actuates the first hydraulic actuator 61 based on an operation state of the manual operator 12, and an attachment operation mode to be performed under a condition in which the drive work attachment 9B is attached to the attachment mount 40, the control line CL1 is in electrical connection with the control valve 97, and the AUX port(s) 75*a*, 75*b*, 75*c* allows hydraulic fluid to flow constantly therethrough, the attachment operation mode being a mode in which the controller 5 stops the normal operation mode and actuates the control valve 97 based on the operation state of the manual operator 12. This makes it possible, in the attachment operation mode, to actuate the drive work attachment 9B by operating the manual operator 12 in the same manner as the normal operation mode. That is, it is possible to precisely operate the manual operator 12 and to actuate the drive work attachment 9B accordingly. Thus, with the working machine 1 according to item 3-1, it is possible to easily control the drive work attachment 9B which requires precise operation.

(Item 3-2) The working machine 1 according to item 3-1, wherein the controller 5 is configured or programmed to recognize which work attachment 9 is attached to the attachment mount 40, and determine whether or not to allow the attachment operation mode to be performed based on a type of the recognized work attachment 9.

With the working machine 1 according to item 3-2, the controller 5 recognizes which work attachment 9 is attached to the attachment mount 40, and determines whether or not to allow the attachment operation mode to be performed based on a type of the recognized work attachment 9, making it possible to switch between the normal operation mode and the attachment operation mode depending on the work attachment 9 (9A, 9B) attached to the attachment mount 40.

(Item 3-3) The working machine 1 according to item 3-2, wherein the controller 5 is configured or programmed to perform the attachment operation mode if the controller 5 determines that the recognized work attachment 9 is the drive work attachment 9.

With the working machine 1 according to item 3-3, the controller 5 performs the attachment operation mode if the controller 5 recognizes that the attached work attachment 9 is a drive work attachment 9B. This makes it possible to allow the attachment operation mode to be entered only when the work attachment 9 (9A, 9B) attached to the attachment mount 40 is a drive work attachment 9B and perform the normal operation mode when some other work attachment (non-drive work attachment) 9A is attached.

(Item 3-4) The working machine 1 according to any one of items 3-1 to 3-3, further including a monitor M to display information, wherein the controller 5 is configured or programmed to cause, when in the attachment operation mode, the monitor M to display an indication that the attachment operation mode is being performed.

With the working machine 1 according to item 3-4, the controller 5, when in the attachment operation mode, causes the monitor M to display an indication that the attachment operation mode is being performed. This allows the user to, by looking at the indication on the monitor M, know whether the normal operation mode is performed or not and whether the attachment operation mode is performed or not.

(Item 3-5) The working machine 1 according to item 3-4, wherein the controller 5 is configured or programmed to cause the monitor M to display an image captured by a camera C, the image including at least a portion of the drive work attachment 9B, the camera C being operable to capture the image.

With the working machine 1 according to item 3-5, the controller 5 causes the monitor M to display an image including at least a portion of the drive work attachment 9B that is captured by a camera C. This allows the user to check the state of the drive work attachment 9B at least during work based on the indication on the monitor M.

(Item 3-6) The working machine 1 according to item 3-5, further including the camera C to capture the image including at least the portion of the drive work attachment 9B, wherein the controller 5 is configured or programmed to cause the monitor M to display the image captured by the camera C.

With the working machine 1 according to item 3-6, the working machine 1 includes the camera C, and the controller 5 causes the monitor M to display an image including at least a portion of the drive work attachment 9B that is captured by the camera C. This allows the user to check the state of the drive work attachment 9B at least during work based on the indication on the monitor M.

(Item 3-7) The working machine 1 according to item 3-3 or according to any one of items 3-4 to 3-6 depending directly or indirectly from item 3-3, wherein the controller 5 is configured or programmed to include a steady deliver mode in which the controller 5 causes hydraulic fluid to constantly flow through the AUX port 75*a*, 75*b*, 75*c*, and allow the steady deliver mode to be performed if the controller 5 recognizes that the work attachment attached to the attachment mount 40 is the drive work attachment 9B.

With the working machine 1 according to item 3-7, the controller 5 includes a steady deliver mode in which the controller 5 causes hydraulic fluid to constantly flow through the AUX port 75*a*, 75*b*, 75*c*, and allow the steady deliver mode to be performed together with the attachment operation mode if the controller 5 recognizes that the drive work attachment 9 attached to the attachment mount 40 is a drive work attachment 9B. In the steady deliver mode, the AUX port(s) 75*a*, 75*b*, 75*c* allow(s) hydraulic fluid to flow therethrough constantly, and therefore, in the attachment operation mode, the hydraulic motor 96 (which is one of the plurality of hydraulic actuators 95 and 96 of the drive work attachment 9B (9Bc)) is constantly supplied with hydraulic fluid, whereas the flow rate of hydraulic fluid supplied to the hydraulic actuator 95 other than the hydraulic motor 96 is controlled by the solenoid control valve 97. That is, in the attachment operation mode (steady deliver mode), the hydraulic motor 96 is constantly (always) driven, whereas the hydraulic actuator (hydraulic cylinder) 95 other than the hydraulic motor 96 is driven according to the manner in which the manual operator 12 is operated.

(Item 3-8) The working machine 1 according to item 3-7, further including an identification information reader 15 to read identification information, wherein the attachment mount 40 is operable to replaceably attach thereto each of work attachments 9 of different types, the work attachments 9 have attached thereto respective tags T with respective pieces of identification information unique thereto, the identification information reader 15 is configured or programmed to read, from a tag T of one of the work attachments 9 that is attached to the attachment mount 40, a corresponding piece of identification information that is unique to the one of the work attachments 9, and the controller 5 is configured or programmed to recognize the one of the work attachments 9 that is attached to the attachment mount 40 based on the corresponding piece of identification information read by the identification information reader 15.

With the working machine 1 according to item 3-8, the controller 5 recognizes the work attachment 9 attached to the attachment mount 40 based on the identification information read by the identification information reader 15, making it possible to automatically recognize the work attachment 9 and thus possible to allow the steady deliver mode to be performed together with the attachment operation mode.

(Item 3-9) The working machine 1 according to item 3-7, wherein the attachment mount 40 is operable to replaceably attach thereto each of work attachments 9 of different types, the working machine 1 further includes a storage and/or a memory 50 to record the work attachments 9, and an attachment selector 55 to select one of the work attachments 9 recorded in the storage and/or the memory 50 that is to be used for work, wherein the controller 5 is configured or programmed to recognize the one of the work attachments 9 selected via the attachment selector 55 as a work attachment 9 attached to or to be attached to the attachment mount 40.

With the working machine 1 according to item 3-9, the controller 5 recognizes, as the work attachment 9 attached to the attachment mount 40, the work attachment 9 selected via the attachment selector 55, making it possible, by recognizing the work attachment 9 as such, to allow the steady deliver mode to be performed together with the attachment operation mode.

(Item 3-10) The working machine 1 according to any one of items 3-1 to 3-9, wherein a reference position of the attachment mount 40 that corresponds to an appropriate position of each of work attachments 9 of different types for work is defined, and the controller 5 is configured or programmed to perform the attachment operation mode if the controller 5 determines that a work attachment 9 recognized by the controller 5 is the drive work attachment 9B and that the attachment mount 40 is in the reference position corresponding to the appropriate position of the drive work attachment 9B.

With the working machine 1 according to item 3-10, the controller 5 performs the attachment operation mode if the controller 5 determines that the attachment mount 40 is in the reference position corresponding to the appropriate position of the drive work attachment 9B. Thus, when the drive work attachment 9B is in an inappropriate position other than the reference position, the normal operation mode is maintained. This makes it possible to actuate the actuator 61 by operating the manual operator 12 to adjust the position of the drive work attachment 9B such that the drive work attachment 9B is in the appropriate position, and, when the drive work attachment 9B is brought into the appropriate position, the attachment operation mode is entered.

That is, the attachment operation mode is entered when a condition arises in which the drive work attachment 9B is allowed to be driven and the actuator 61 does not need to be controlled by the manual operator 12.

(Item 3-11) The working machine 1 according to any one of items 3-1 to 3-10, wherein the drive work attachment 9B is a snow blower A18 including a collector 921 to collect snow on a road surface and a discharger 925 to discharge snow collected in the collector 921 in a desired direction, the collector 921 includes a blade 922, an auger 923 located forward of the blade 922, and a hydraulic motor which is one of the at least one hydraulic motor 96 to drive the auger 923, the discharger 925 includes a tubular discharge passage 926 connected to the blade 922 to guide snow collected at the blade 922 in a desired direction, a feed impeller 927 to feed the collected snow into the discharge passage 926, a hydraulic motor which is another of the at least one hydraulic motor 96 to drive the feed impeller 927, and a hydraulic cylinder 95 to change a direction of snow discharge through the discharge passage 926, the hydraulic cylinder 95 being one of the plurality of hydraulic actuators 95, 96, and the controller 5 is configured or programmed to, if the controller 5 recognizes that the drive work attachment 9 attached to the attachment mount 40 is the snow blower A18, perform the attachment operation mode in which the controller 5 actuates the control valve 97 based on the operation state of the manual operator (work manual operator) 12 to cause the hydraulic cylinder 95 to operate, to allow the direction of snow discharge through the discharge passage 926 to be changed as the manual operator 12 is operated.

With the working machine 1 according to item 3-11, if the controller 5 recognizes that the work attachment 9 is a snow blower A18, in the attachment operation mode, the hydraulic motor 96 is driven constantly by being constantly supplied with hydraulic fluid, and the auger 923 and the feed impeller 927 are each also constantly driven (driven to rotate). With this, the auger 923 collects snow on the road surface at the blade 922, and the feed impeller 927 feeds the snow collected at the blade 922 into the discharge passage 926. In contrast, the hydraulic cylinder 95 extends or retracts by the control valve 97 being actuated based on the operation state of the manual operator 12. Accordingly, the direction of snow discharge from the discharge passage 926 is changed according to the operation of the manual operator 12.

(Item 3-12) The working machine 1 according to any one of items 3-1 to 3-11, wherein the drive work attachment 9B is a broom A15 including a rotary brush 901 to brush dust off a road surface, the at least one hydraulic motor 96 to drive the rotary brush 901, and a hydraulic cylinder 95 to change a posture of the rotary brush 901, the hydraulic cylinder being one of the plurality of hydraulic actuators 95, 96, and the controller 5 is configured or programmed to, if the controller 5 recognizes that the drive work attachment 9 attached to the attachment mount 40 is the broom A15, perform the attachment operation mode in which the controller 5 actuates the control valve 97 based on the operation state of the manual operator (work manual operator) 12 to cause the hydraulic cylinder 95 to operate to allow the posture of the rotary brush 901 to be changed as the manual operator (work manual operator) 12 is operated.

With the working machine 1 according to item 3-12, if the controller 5 recognizes that the work attachment 9 is a broom (angle broom) A15, in the attachment operation mode, the hydraulic motor 96 is driven constantly by being constantly supplied with hydraulic fluid, and the rotary brush 901 is also constantly driven (driven to rotate) accordingly. With this, the rotary brush 901 brushes away dust and trash on the road surface. In contrast, the hydraulic cylinder 95 extends or retracts by the control valve 97 being actuated based on the operation state of the manual operator 12. Accordingly, the posture of the rotary brush 901 is changed according to the manner in which the manual operator 12 is operated. That is, the posture of the rotary brush 901 is changed according to the operation of the manual operator 12 by the user (according to the user intention), and the direction in which the rotary brush 901 brushes away dust and trash on the road surface is changed.

(Item 4-1) A working machine 1 including a machine body 2, a traveling device 3 to support the machine body 2 such that the machine body 2 is allowed to travel, an arm 43 supported on the machine body 2 such that the arm 43 is rotatable about a first shaft S1 extending in a lateral direction perpendicular to an up-down direction, an attachment mount 40 attached to the arm 43 to detachably attach a work attachment 9 thereto, the work attachment 9 being operable to perform a function corresponding to work, a hydraulic cylinder 61 to extend and retract by receiving and discharging hydraulic fluid to cause the arm 43 to rotate about the first shaft S1, a manual operator 12 to be operated by a user, and a controller 5 configured or programmed to cause the hydraulic cylinder 61 to extend or retract based on an operation state of the manual operator 12, wherein the controller 5 is configured or programmed to, while the manual operator 12 is not being operated and the traveling device 3 is traveling, if one of an increase or a decrease occurs in a pressure of the hydraulic fluid in the hydraulic cylinder 61, perform a pressure absorbing process including a first process to cause the other of the increase and the decrease in the pressure of the hydraulic fluid in the hydraulic cylinder 61.

With the working machine 1 according to item 4-1, the controller 5 is configured or programmed to, while the manual operator 12 is not being operated and the traveling device 3 is traveling, if one of the increase or the decrease occurs in the pressure of the hydraulic fluid in the hydraulic cylinder(s) 61, cause the other of the increase and the decrease in the pressure of the hydraulic fluid in the hydraulic cylinder(s) 61. Therefore, the other of the increase and the decrease in the pressure of the hydraulic fluid in the hydraulic cylinder(s) 61 would reduce or cancel out the one of the increase or the decrease in the pressure of the hydraulic fluid in the hydraulic cylinder 61. Specifically, the arm(s) 43 is/are caused to move up and down due to vibrations or the like that would occur during travel achieved by the traveling devices 3. The up and down movement of the arm 43 is transmitted to the hydraulic cylinder(s) 61, causing a pressure change, i.e., one of an increase or a decrease, in a pressure of the hydraulic fluid in the hydraulic cylinder(s) 61. In particular, when the work attachment 9 is attached to the attachment mount 40 attached to the arm(s) 43, the work attachment 9 (which is a heavy object) is also caused to move up and down, causing a large pressure change, i.e., one of an increase or a decrease, in a pressure of the hydraulic fluid in the hydraulic cylinder(s) 61. In this regard, the controller 5 performs the first process, of the pressure absorbing process, to cause the other of the increase and the decrease in the pressure of the hydraulic fluid in the hydraulic cylinder(s) 61, so that the one of the increase or the decrease in the pressure of the hydraulic fluid in the hydraulic cylinder(s) 61 is reduced or canceled out.

With this, the pressure change in the hydraulic cylinder(s) 61 is absorbed. That is, with the working machine 1 according to item 4-1, it is possible to reduce the load on the arm(s) 43 that would be caused by vibrations during travel, and possible to eliminate or reduce the likelihood that the arm 43 will become out of control.

(Item 4-2) The working machine 1 according to item 4-1, wherein the pressure absorbing process includes, after the first process, a second process to cause the one of the increase or the decrease in the pressure of the hydraulic fluid in the hydraulic cylinder 61.

With the working machine 1 according to item 4-2, the pressure absorbing process includes a second process, which is performed after the first process, to cause the one of the increase or the decrease in the pressure of the hydraulic fluid in the hydraulic cylinder(s) 61. This makes it possible, in the second process, to eliminate the effect of the first process which was performed to absorb the temporary pressure change caused by vibrations or the like during travel. Specifically, since the pressure change in the hydraulic cylinder(s) 61 caused by vibrations or the like is a temporary change, if nothing is done after the first process, the other of the increase or the decrease in the pressure of the hydraulic fluid caused by the first process would keep the hydraulic cylinder(s) 61 in its extended state or retracted state, making it impossible for the arm(s) 43 to remain in its original posture. In this regard, when one of increase or the decrease is caused in a pressure of the hydraulic fluid in the hydraulic cylinder(s) 61 in the second process, the hydraulic cylinder(s) 61 regains its original state, allowing the arm(s) 43 to be kept in the original posture. This maintains the work attachment(s) 9 attached to the attachment mount(s) 40 in the original position before the occurrence of the pressure change.

(Item 4-3) The working machine 1 according to item 4-2, further including a fluid passage R6*a*, R6*b* connected to the hydraulic cylinder 61 to allow hydraulic fluid to be supplied to and discharged from the hydraulic cylinder 61, and a control valve 76 provided in the fluid passage R6*a*, R6*b* and including an internal flow passage communicable with the fluid passage R6*a*, R6*b*, wherein the controller 5 is configured or programmed to, in the pressure absorbing process, control the control valve 76 such that the degree of opening of the internal flow passage of the control valve 76 is larger in the first process than in the second process.

With the working machine 1 according to item 4-3, the controller 5 is configured or programmed to, in the pressure absorbing process, control the control valve 76 such that the degree of opening of the internal flow passage of the control valve 76 is larger in the first process than in the second process. Therefore, the flow rate of hydraulic fluid supplied to and discharged from the hydraulic cylinder 61 to cause the other of the increase or the decrease in the pressure of the hydraulic fluid in the hydraulic cylinder 61 in the first process is greater than the flow rate of hydraulic fluid supplied to and discharged from the hydraulic cylinder 61 to cause the one of the increase or the decrease in the pressure of the hydraulic fluid in the hydraulic cylinder 61 in the second process. With this, the time taken for the other of the increase and the decrease to be caused in a pressure of the hydraulic fluid in the hydraulic cylinder 61 in the first process is shorter than the time taken for the one of increase or the decrease to be caused in a pressure of the hydraulic fluid in the hydraulic cylinder 61 in the second process. That is, in the pressure absorbing process, the first process is performed quickly, and the second process is performed more slowly than the first process. With this, when the hydraulic cylinder 61 is brought back to its original state (when the second process is performed), the shock on the hydraulic cylinder 61 can be reduced.

(Item 4-4) The working machine 1 according to any one of items 4-1 to 4-3, further including a fluid passage R6*a*, R6*b* connected to the hydraulic cylinder 61 to allow hydraulic fluid to be supplied to and discharged from the hydraulic cylinder 61, and a control valve 76 including a spool 761 movable in a direction perpendicular to the fluid passage R6*a*, R6*b* and operable such that a flow rate of hydraulic fluid in the fluid passage R6*a*, Rob is increased as an amount of movement of the spool 761 increases, wherein the controller 5 is configured or programmed to, in the first process of the pressure absorbing process, increase the amount of movement of the spool 761 and increase a time taken for the spool 761 to move compared to when the pressure absorbing process is not performed.

With the working machine 1 according to item 4-4, the controller 5, in the first process of the pressure absorbing process, increases the amount of movement of (the distance moved by) the spool 761 and increases the time taken for the spool 761 to move compared to when the pressure absorbing process is not performed. Therefore, hydraulic fluid is supplied to and discharged from the hydraulic cylinder 61 in the first process of the pressure absorbing process more slowly than usual (when the pressure absorbing process is not performed). With this, changes in pressure in hydraulic cylinder 61 are absorbed gradually, making it possible to reduce the impact that would be caused by the absorption of pressure changes.

(Item 4-5) The working machine 1 according to any one of items 4-1 to 4-4, further including a fluid passage R6*a*, R6*b* connected to the hydraulic cylinder 61 to allow hydraulic fluid to be supplied to and discharged from the hydraulic cylinder 61, a control valve 97 including a spool 761 movable in a direction perpendicular to the fluid passage R6*a*, R6*b* and operable such that a flow rate of hydraulic fluid in the fluid passage R6*a*, R6*b* is increased as an amount of movement of the spool 761 increases, and an acceleration sensor to detect an acceleration of the machine body 2 along at least the up-down direction, wherein the controller 5 is configured or programmed to, if determining that the acceleration in an upward direction along the up-down direction detected by the acceleration sensor is equal to or greater than a predetermined value, perform the pressure absorbing process to, in the first process, increase the amount of movement of the spool 761 and increase a time taken for the spool 761 to move compared to when the pressure absorbing process is not performed.

With the working machine 1 according to item 4-5, if the controller 5 determines that the acceleration in the upward direction along the up-down direction detected by the acceleration sensor is equal to or greater than a predetermined value, the controller 5 performs the pressure absorbing process to, in the first process, increase the amount of movement of (the distance moved by) the spool 761 and increase the time taken for the spool 761 to move compared to when the pressure absorbing process is not performed. Thus, only when the controller 5 determines that the acceleration in the upward direction along the up-down direction detected by the acceleration sensor is equal to or greater than a prescribed value, i.e., only when the controller 5 determines that up-down vibrations are large, hydraulic fluid is supplied to and discharged from the hydraulic cylinder 61 in the first process of the pressure absorbing process more slowly than usual (when the pressure absorbing process is not performed). That is, when up-down vibrations are small, hydraulic fluid is supplied to and discharged from the hydraulic cylinder 61 quickly in the first process of the pressure absorbing process, whereas, when up-down vibrations are large, hydraulic fluid is supplied to and discharged from the hydraulic cylinder 61 slowly in the first process of the pressure absorbing process. This makes it possible to absorb pressure in a way that is suitable for the amplitude of up-down vibrations.

(Item 4-6) The working machine 1 according to any one of items 4-1 to 4-5, further including a switch to be operated to switch between performing and not performing the pressure absorbing process, wherein the controller 5 is configured or programmed to perform the pressure absorbing process based on an operation of the switch.

With the working machine 1 according to item 4-6, the working machine 1 includes a switch to be operated to switch between performing and not performing the pressure absorbing process, and the controller 5 is configured or programmed to perform the pressure absorbing process based on an operation of the switch, allowing the user to operate the switch depending on need to switch between performing and not performing the pressure absorbing process.

(Item 4-7) The working machine 1 according to item 4-6, wherein the controller 5 is configured or programmed to, under a condition in which the controller 5 has recognized that the work attachment 9 including a fork F for placement of a cargo B is attached to the attachment mount 40 and the switch has been operated to select performing the pressure absorbing process, determine whether or not the cargo B is placed on the fork F based on a pressure of hydraulic fluid in the hydraulic cylinder 61, and, if the controller 5 determines that the cargo B is placed on the fork F, perform the pressure absorbing process.

With the working machine 1 according to item 4-7, the controller 5 is configured or programmed to, under a condition in which the controller 5 has recognized that the work attachment 9 including a fork F for placement of a cargo B is attached to the attachment mount 40 and the switch has been operated to select performing the pressure absorbing process, determine whether or not the cargo B is placed on the fork F based on the pressure of hydraulic fluid in the hydraulic cylinder 61, and, if the controller 5 determines that the cargo B is placed on the fork F, perform the pressure absorbing process. Therefore, when the cargo B is placed on the fork F, variations in pressure are absorbed in the first process and damage to the cargo B is absorbed. When the second process is performed with the cargo B placed on the fork F, the hydraulic cylinders 61 regain its original state, allowing the positions (postures) of the arms 43 and the attachment mount 40 to be kept in the original state. With this, it is possible to maintain the state of the cargo B on the fork F stably.

(Item 4-8) The working machine 1 according to any one of items 4-1 to 4-7, wherein the controller 5 is configured or programmed to include thresholds which are for use when the other of the increase or the decrease is caused in the pressure of hydraulic fluid in the hydraulic cylinder 61 in the first process and which are defined for respective a plurality of types of work attachments 9 attachable to the attachment mount 40, and the controller 5 is configured or programmed to recognize the work attachment 9 attached to or to be attached to the attachment mount 40, and, in the first process, increase or reduce the pressure of hydraulic fluid in the hydraulic cylinder 61 to one of the thresholds that corresponds to the recognized work attachment 9.

With the working machine 1 according to item 4-8, the controller 5 is configured or programmed to, when causing the other of the increase or the decrease in the pressure of hydraulic fluid in the hydraulic cylinder(s) 61 in the first process, increase or reduce the pressure of hydraulic fluid in the hydraulic cylinder(s) 61 to the threshold corresponding to the work attachment 9 attached to the attachment mount 40. This eliminates or reduces the likelihood that the pressure of hydraulic fluid in the hydraulic cylinder 61 will be absorbed more than necessary.

(Item 4-9) The working machine 1 according to item 4-8, wherein the thresholds for the respective work attachments 9 of different types are each defined based on a weight of a corresponding one of the work attachments 9, and are defined such that thresholds for heavier work attachments 9 are greater than thresholds for lighter work attachments 6.

With the working machine 1 according to item 4-9, the thresholds for use in causing the other of the increase or the decrease in a pressure of the hydraulic fluid in the hydraulic cylinder 61 in the first process are defined based on the weight of the work attachments 9 such that thresholds for heavier work attachments 9 are greater than thresholds for lighter work attachments 6. Therefore, when causing the other of the increase or the decrease in the pressure of the hydraulic fluid in the hydraulic cylinder 61 in the first process, if the weight of the work attachment 9 attached to the attachment mount 40 is heavier than a specified weight, the controller 5 increases or reduces the pressure to a greater extent than the cases of lighter work attachments 9. Specifically, heavier work attachments 9 would be subjected to greater impacts from vertical vibrations than lighter work attachments 9. It is possible to reliably absorb the impacts by, in performing the first process, increasing or reducing the pressure to a greater extent when the work attachment attached to the attachment mount 40 is heavy than when the work attachment 9 is light, as described above.

(Item 4-10) The working machine 1 according to any one of items 4-1 to 4-9, wherein a posture of the arm 43 appropriate for travel by the traveling device 3 is defined for each of a plurality of the work attachments 9 of different types attachable to the attachment mount 40, and the controller 5 is configured or programmed to recognize the work attachment 9 attached to the attachment mount 40, and perform the pressure absorbing process when the arm 43 is in the posture appropriate for the recognized work attachment 9.

With the working machine 1 according to item 4-10, the controller 5 performs the pressure absorbing process when the arm 43 is in the posture appropriate for the recognized work attachment 9, making it possible to maintain the work attachment 9 in appropriate position and posture.

(Item 4-11) The working machine 1 according to item 4-8 or according to item 4-9 or 4-10 depending directly or indirectly from item 4-8, further including an identification information reader 15 to read identification information, wherein a plurality of the work attachments 9 of different types have attached thereto respective tags T with respective pieces of identification information unique thereto, the identification information reader 15 is configured or programmed to read, from a tag T of one of the work attachments 9 that is attached to or to be attached to the attachment mount 40, a corresponding piece of identification information that is unique to the one of the work attachments 9, and the controller 5 is configured or programmed to recognize the one of the work attachments 9 that is attached to the attachment mount 40 based on the corresponding piece of identification information read by the identification information reader 15.

With the working machine 1 according to item 4-11, the controller 5 recognizes the one of the work attachments 9 attached to the attachment mount 40 based on the corresponding piece of identification information read by the identification information reader 15, making it possible to automatically recognize the work attachment 9 and then perform the pressure absorbing process suitable for the work attachment 9.

(Item 4-12) The working machine 1 according to item 4-8 or according to any one of items 4-9 to 4-11 depending directly or indirectly from item 4-8, further including a storage and/or a memory 50 to record a plurality of the work attachments 9 of different types, and an attachment selector 55 to select one of the work attachments 9 recorded in the storage and/or the memory 50 that is to be used for work, wherein the controller 5 is configured or programmed to recognize the one of the work attachments 9 selected via the attachment selector 55 as the work attachment 9 attached or to be attached to the attachment mount 40.

With the working machine 1 according to item 4-12, the controller 5 recognizes the one of the work attachments 9 selected via the attachment selector 55 as the work attachment 9 attached or to be attached to the attachment mount 40, making it possible to recognize the work attachment 9 intended by the user and then perform the pressure absorbing process suitable for the work attachment 9.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body;

a traveling device to support the machine body and cause the machine body to travel;

an attachment mount directly or indirectly supported on the machine body to replaceably attach thereto each of a plurality of work attachments of different types thereto, each of the plurality of work attachments being operable to perform a function corresponding to work;

a manual operating instrument to be operated by a user; and a controller configured or programmed to actuate the traveling device based on an operation state of the manual operating instrument; wherein the controller is configured or programmed to:

recognize a work attachment of the plurality of work attachments that is attached to the attachment mount;

directly or indirectly recognize a moment about a pivot of the attachment mount;

extract from a database in a storage a movement condition of the work attachment that is attached to the attachment mount and a travel condition of the working machine based on the work attachment;

associate the movement condition and the travel condition corresponding to the work attachment and the recognized moment with the operation state of the manual operating instrument; and actuate movement of the work attachment and the traveling device according to the movement condition and the travel condition associated with the operation state as the manual operating instrument is operated by the user.

2. The working machine according to claim 1, wherein the controller is configured or programmed to:

associate a travel condition corresponding to the recognized moment with the operation state of the manual operating instrument; and actuate the traveling device according to the travel condition associated with the operation state as the manual operating instrument is operated by the user.

3. The working machine according to claim 2, wherein the controller is configured or programmed to recognize the presence or absence of the moment acting on the attachment mount based on whether or not the work attachment is attached to the attachment mount.

4. The working machine according to claim 2, wherein the travel condition includes a speed change per unit time; and the controller is configured or programmed to:

if the controller determines that there is no moment or the moment is below a predetermined amount, define a smaller speed change as the travel condition than when a larger load is present; and actuate the traveling device according to the defined travel condition as the manual operating instrument is operated by the user.

5. The working machine according to claim 4, wherein the traveling device is operable to change a speed thereof between a first speed stage and a second speed stage which is a higher speed stage than the first speed stage; and the controller is configured or programmed to:

if the controller determines that there is no moment or the moment is below a predetermined amount, define a smaller speed change as the travel condition for when the first speed stage is changed to the second speed stage than when the controller determines that the moment is above a predetermined amount.

6. The working machine according to claim 4, wherein the controller is configured or programmed to recognize an operation speed which is a speed at which the manual operating instrument is operated by the user; and the controller is configured or programmed to:

define, depending on the work attachment attached to the attachment mount, a sudden-operation travel condition which is the travel condition for sudden operation in which the operation speed is higher than a predetermined speed;

associate the defined sudden-operation travel condition with a sudden operation of the manual operating instrument; and when the controller determines that the operation speed of the manual operating instrument is higher than the predetermined speed and that there is the sudden operation, actuate the traveling device according to the defined sudden-operation travel condition associated with the sudden operation as the manual operating instrument is operated by the user.

7. The working machine according to claim 6, wherein a speed change included in the sudden-operation travel condition is smaller than a speed change included in the travel condition for normal operation other than the sudden operation.

8. The working machine according to claim 4, wherein a speed change included in the travel condition is smaller when no work attachments are attached to the attachment mount than when the work attachment is attached to the attachment mount.

9. The working machine according to claim 8, wherein the attachment mount includes a linkage to connect the work attachment thereto;

the linkage includes an engaging portion switchable between an engaging position in which the engaging portion engages with the work attachment to connect the work attachment thereto and a disengaging position in which the engaging portion disengages the work attachment therefrom to disconnect the work attachment therefrom; and the controller is configured or programmed to determine that no work attachments are attached to the attachment mount when the engaging portion is in the disengaging position.

10. The working machine according to claim 2, wherein the controller is configured or programmed to:

define the travel condition depending on a weight of the recognized work attachment.

11. The working machine according to claim 10, further comprising an identification information reader to read identification information;

the work attachments of different types have attached thereto respective tags with respective pieces of identification information unique thereto;

the identification information reader is configured or programmed to read, from a tag of one of the work attachments that is attached to the attachment mount, a corresponding piece of identification information that is unique to the one of the work attachments; and the controller is configured or programmed to recognize the one of the work attachments that is attached to the attachment mount based on the corresponding piece of identification information read by the identification information reader.

12. The working machine according to claim 10, further comprising:

at least one of a storage and a memory to record the work attachments of different types; and an attachment selector to select one of the work attachments recorded in the storage or the memory that is to be used for work; wherein the controller is configured or programmed to recognize the one of the work attachments selected via the attachment selector as the work attachment attached to the attachment mount.

13. The working machine according to claim 12, wherein the storage and/or the memory is operable to store a plurality of the travel conditions corresponding to the work attachments of different types and each associated with the operation state of the manual operating instrument, the plurality of travel conditions each being defined depending on a weight of a corresponding one of the work attachments; and the controller is configured or programmed to:

recognize the one of the work attachments selected via the attachment selector as the work attachment attached to the attachment mount;

extract a corresponding one of the plurality of travel conditions that corresponds to the selected work attachment from the storage and/or the memory; and actuate the traveling device according to the extracted travel condition.

14. The working machine according to claim 1, wherein the controller is configured or programmed to recognize the moment acting on the attachment mount or the moment based on a type of the work attachment attached to the attachment mount.

15. The working machine according to claim 1, wherein the traveling device is operable to achieve straight travel in which the machine body travels straight and pivot turn travel;

the travel condition includes a first travel condition for the straight travel and a second travel condition for the pivot turn travel that differs from the first travel condition; and a speed change included in the second travel condition is smaller than a speed change included in the first travel condition.

16. The working machine according to claim 1, further comprising:

an attachment support structure which is supported on the machine body and which supports the attachment mount; and an actuator to cause the attachment mount to move; wherein the attachment mount is configured to move along a predetermined path in response to driving of the actuator.

17. The working machine according to claim 16, wherein the attachment support structure includes an arm supported on the machine body, the arm having the attachment mount connected thereto;

the arm extends in a front-rear direction perpendicular to an up-down direction, and the attachment mount is located forward of the machine body; and the arm is configured to rotate forward and reverse about a first shaft extending in a lateral direction perpendicular to the up-down direction to raise and lower the attachment mount.

* * * * *